US009513573B2

(12) United States Patent
Tachibana et al.

(10) Patent No.: US 9,513,573 B2
(45) Date of Patent: Dec. 6, 2016

(54) IMAGE FORMING METHOD, IMAGE FORMING APPARATUS, AND PRINTED MATTER PRODUCTION METHOD

(71) Applicants: Hiroto Tachibana, Kanagawa (JP); Hiroyuki Suhara, Kanagawa (JP)

(72) Inventors: Hiroto Tachibana, Kanagawa (JP); Hiroyuki Suhara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/833,510

(22) Filed: Aug. 24, 2015

(65) Prior Publication Data

US 2016/0070195 A1 Mar. 10, 2016

(30) Foreign Application Priority Data

Sep. 4, 2014 (JP) ..... 2014-179765
Sep. 5, 2014 (JP) ..... 2014-180827

(51) Int. Cl.
*G03G 15/00* (2006.01)
*G03G 15/043* (2006.01)

(52) U.S. Cl.
CPC .... *G03G 15/043* (2013.01); *G03G 2215/0431* (2013.01); *G03G 2215/0482* (2013.01)

(58) Field of Classification Search
CPC .. G03G 15/043; G03G 15/041; G03G 15/00; G03G 15/01; G03G 15/0105; G03G 15/2064; G03G 15/50; G03G 15/5037; G03G 2215/0431
USPC ..... 399/115, 131, 251
See application file for complete search history.

(56) References Cited

U.S. PATENT DOCUMENTS 6,177,948 B1 * 1/2001 Estabrooks ..... B41J 2/385 347/129
2005/0179971 A1 8/2005 Amada et al.
(Continued)

FOREIGN PATENT DOCUMENTS

JP 4-120867 4/1992
JP 9-085982 3/1997
(Continued)

OTHER PUBLICATIONS

U.S. Appl. No. 14/705,423, filed May 6, 2015.
(Continued)

*Primary Examiner* — Roy Y Yi
(74) *Attorney, Agent, or Firm* — Oblon, McClelland, Maier & Neustadt, L.L.P.

(57) ABSTRACT

An image forming method includes exposing a surface of an image bearer with light according to an image pattern including an image portion and a non-image portion, the image portion constituted of a plurality of pixels, to form an electrostatic latent image correspondent to the image pattern, comparing the image pattern adjacent to each of the pixels with a comparison pattern constituted of a plurality of pixels to specify at least a group of pixels existing at a boundary with respect to the non-image portion as a group of non-exposure pixels among the pixels constituting the image portion, and executing determination of specifying at least a group of pixels adjacent to the group of non-exposure pixels as a group of high power exposure pixels exposed with light of a higher light power than a predetermined light power required for exposing the image portion among the pixels constituting the image portion.

20 Claims, 41 Drawing Sheets

(56) References Cited

U.S. PATENT DOCUMENTS

| | | | | |
|---|---|---|---|---|
| 2007/0077526 | A1* | 4/2007 | Finders | G03F 1/144 430/322 |
| 2007/0091164 | A1* | 4/2007 | Jodra | B41J 2/442 347/247 |
| 2008/0056746 | A1 | 3/2008 | Suhara | |
| 2008/0170282 | A1 | 7/2008 | Amada et al. | |
| 2009/0034002 | A1 | 2/2009 | Shibaki et al. | |
| 2009/0051982 | A1 | 2/2009 | Suhara | |
| 2009/0220256 | A1 | 9/2009 | Suhara et al. | |
| 2009/0302218 | A1 | 12/2009 | Suhara | |
| 2010/0196052 | A1 | 8/2010 | Suhara | |
| 2012/0059612 | A1 | 3/2012 | Suhara et al. | |
| 2014/0253658 | A1 | 9/2014 | Suhara et al. | |
| 2015/0042740 | A1 | 2/2015 | Suhara et al. | |
| 2015/0177638 | A1 | 6/2015 | Suhara | |

FOREIGN PATENT DOCUMENTS

| | | |
|---|---|---|
| JP | 9-247477 | 9/1997 |
| JP | 2003-251853 | 9/2003 |
| JP | 2004-181868 | 7/2004 |
| JP | 2005-193540 | 7/2005 |
| JP | 2006-344436 | 12/2006 |
| JP | 2008-153742 | 7/2008 |
| JP | 2009-037283 | 2/2009 |
| JP | 2011-186371 | 9/2011 |
| JP | 2014-175738 | 9/2014 |

OTHER PUBLICATIONS

U.S. Appl. No. 14/730,428, filed Jun. 4, 2015.

* cited by examiner

FIG. 24A (1)

| | | | | | | | | |
|---|---|---|---|---|---|---|---|---|
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |

(2)

| | | | | | | | | | |
|---|---|---|---|---|---|---|---|---|---|
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |

(3)

| | | | | | | | | | | |
|---|---|---|---|---|---|---|---|---|---|---|
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |
| 1 | 1 | 1 | 1 | 1 | 1 | 1 | 1 | 1 | 1 | 1 |

(4)

| | | | | | | | | | | | |
|---|---|---|---|---|---|---|---|---|---|---|---|
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |

FIG. 24B (1)

| | | | | | | | | |
|---|---|---|---|---|---|---|---|---|
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |
| 0 | 0 | 2 | 2 | 1 | 2 | 2 | 0 | 0 |

(2)

| | | | | | | | | | |
|---|---|---|---|---|---|---|---|---|---|
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |
| 0 | 0 | 2 | 2 | 1 | 1 | 2 | 2 | 0 | 0 |

(3)

| | | | | | | | | | | |
|---|---|---|---|---|---|---|---|---|---|---|
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |
| 0 | 0 | 2 | 2 | 1 | 1 | 1 | 2 | 2 | 0 | 0 |

(4)

| | | | | | | | | | | |
|---|---|---|---|---|---|---|---|---|---|---|
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |
| 0 | 0 | 2 | 2 | 1 | 1 | 1 | 1 | 2 | 2 | 0 | 0 |

| | | | | | | | | | | | | | | | | | | | | | | | |
|---|---|---|---|---|---|---|---|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 0 | 0 | 0 | 0 | 0 | 0 | 1 | 1 | 1 | 1 | 1 | 1 | 1 | 1 | 1 | 1 | 1 | 1 | 0 | 0 | 0 | 0 | 0 | 0 |
| 0 | 0 | 0 | 0 | 0 | 0 | 1 | 1 | 1 | 1 | 1 | 1 | 1 | 1 | 1 | 1 | 1 | 1 | 0 | 0 | 0 | 0 | 0 | 0 |
| 0 | 0 | 0 | 0 | 0 | 0 | 1 | 1 | 1 | 1 | 1 | 1 | 1 | 1 | 1 | 1 | 1 | 1 | 0 | 0 | 0 | 0 | 0 | 0 |
| 0 | 0 | 0 | 0 | 0 | 0 | 1 | 1 | 1 | 1 | 1 | 1 | 1 | 1 | 1 | 1 | 1 | 1 | 0 | 0 | 0 | 0 | 0 | 0 |
| 0 | 0 | 0 | 0 | 0 | 0 | 1 | 1 | 1 | 1 | 1 | 1 | 1 | 1 | 1 | 1 | 1 | 1 | 0 | 0 | 0 | 0 | 0 | 0 |
| 0 | 0 | 0 | 0 | 0 | 0 | 1 | 1 | 1 | 1 | 1 | 1 | 1 | 1 | 1 | 1 | 1 | 1 | 0 | 0 | 0 | 0 | 0 | 0 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |

FIG. 31

281' 281'

| | | | | | | | | | | | | | | | | | | | | | | | |
|---|---|---|---|---|---|---|---|---|---|---|---|---|---|---|---|---|---|---|---|---|---|---|---|
| 0 | 0 | 2 | 2 | 1 | 1 | 1 | 1 | 1 | 1 | 0 | 0 | 0 | 0 | 1 | 1 | 1 | 1 | 1 | 1 | 2 | 2 | 0 | 0 |
| 0 | 0 | 0 | 0 | 0 | 0 | 0 | 0 | 2 | 2 | 0 | 0 | 0 | 0 | 2 | 2 | 0 | 0 | 0 | 0 | 0 | 0 | 0 | 0 |
| 0 | 0 | 0 | 0 | 0 | 0 | 0 | 0 | 2 | 2 | 2 | 2 | 2 | 2 | 2 | 2 | 0 | 0 | 0 | 0 | 0 | 0 | 0 | 0 |
| 0 | 0 | 0 | 0 | 0 | 0 | 0 | 0 | 2 | 2 | 2 | 2 | 2 | 2 | 2 | 2 | 0 | 0 | 0 | 0 | 0 | 0 | 0 | 0 |
| 0 | 0 | 0 | 0 | 0 | 0 | 0 | 0 | 2 | 2 | 2 | 2 | 2 | 2 | 2 | 2 | 0 | 0 | 0 | 0 | 0 | 0 | 0 | 0 |
| 0 | 0 | 0 | 0 | 0 | 0 | 0 | 0 | 2 | 2 | 2 | 2 | 2 | 2 | 2 | 2 | 0 | 0 | 0 | 0 | 0 | 0 | 0 | 0 |
| 0 | 0 | 0 | 0 | 0 | 0 | 0 | 0 | 2 | 2 | 0 | 0 | 0 | 0 | 2 | 2 | 0 | 0 | 0 | 0 | 0 | 0 | 0 | 0 |
| 0 | 0 | 2 | 2 | 1 | 1 | 1 | 1 | 1 | 1 | 0 | 0 | 0 | 0 | 1 | 1 | 1 | 1 | 1 | 1 | 2 | 2 | 0 | 0 |

281' 281'

IMAGE FORMING METHOD, IMAGE FORMING APPARATUS, AND PRINTED MATTER PRODUCTION METHOD

CROSS-REFERENCE TO RELATED APPLICATIONS

This patent application is based on and claims priority pursuant to 35 U.S.C. §119 to Japanese Patent Applications Nos. 2014-180827 and 2014-179765, filed on Sep. 5, 2014 and Sep. 4, 2014 respectively in the Japan Patent Office, the entire disclosure of which is hereby incorporated by reference herein.

BACKGROUND

1. Technical Field

The present invention relates to an image forming method, an image forming apparatus and a printed matter production method.

2. Description of the Related Art

In recent years, in an electrophotographic process for forming images, demands for high image quality and high stabilization have been increased. Images are known to deteriorate before developed, i.e., when they are latent images.

Japanese published unexamined application No. JP-2005-193540-A discloses a method of making an irradiation energy per unit pixel in writing a solid image larger than that when an input image area is smaller than a specific value.

An attention line having a 2-pixel width in a horizontal direction and an attention line in an oblique direction are subjected to pattern matching with a 1×4 pixel detection pattern. Further, Japanese published unexamined application No. JP-2008-153742-A discloses a method of modulating brightness in addition to line width correction to increase brightness of one pixel.

Further, Japanese published unexamined application No. JP-2012-15864-A discloses a method of increasing irradiation intensity onto a low-density area of an edge portion to decrease a potential difference between high-density area and a low-density area of the edge portion.

Furthermore, Japanese published unexamined application No. JP-2007-190787-A discloses a method of thinning out or adding irradiation pixels to make light energies emitted from light sources even.

SUMMARY

Accordingly, one object of the present invention is to provide an image forming method capable of forming an image having high latent image MTF (Modulation Transfer Function) resolution.

Another object of the present invention is to provide an image forming apparatus using the image forming method.

A further object of the present invention is to provide a printed matter production method using the image forming method.

These objects and other objects of the present invention, either individually or collectively, have been satisfied by the discovery of an image forming method including exposing a surface of an image bearer with light according to an image pattern including an image portion and a non-image portion, the image portion constituted of a plurality of pixels, to form an electrostatic latent image correspondent to the image pattern, comparing the image pattern adjacent to each of the pixels with a comparison pattern constituted of a plurality of pixels to specify at least a group of pixels existing at a boundary with respect to the non-image portion as a group of non-exposure pixels among the pixels constituting the image portion, and executing determination of specifying at least a group of pixels adjacent to the group of non-exposure pixels as a group of high power exposure pixels exposed with light of a higher light power than a predetermined light power required for exposing the image portion among the pixels constituting the image portion.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding portions throughout and wherein:

FIG. 24A (1) to (4) are image data and 24B (1) to (4) are exposure patterns of 24A (1) to (4) respectively when the process of folding both ends is applied to line patterns having (1) 9 dot width, (2) 10 dot width, (3) 11 dot width and (4) 12 dot width;

FIG. 25A is image data, FIG. 25B is an exception process and FIG. 25C is a process of folding both ends after the exception process;

FIG. 31 is a schematic diagram illustrating an exposure pattern of the image data is determined on the basis of flowchart in FIG. 30;

DETAILED DESCRIPTION

Figure 1:
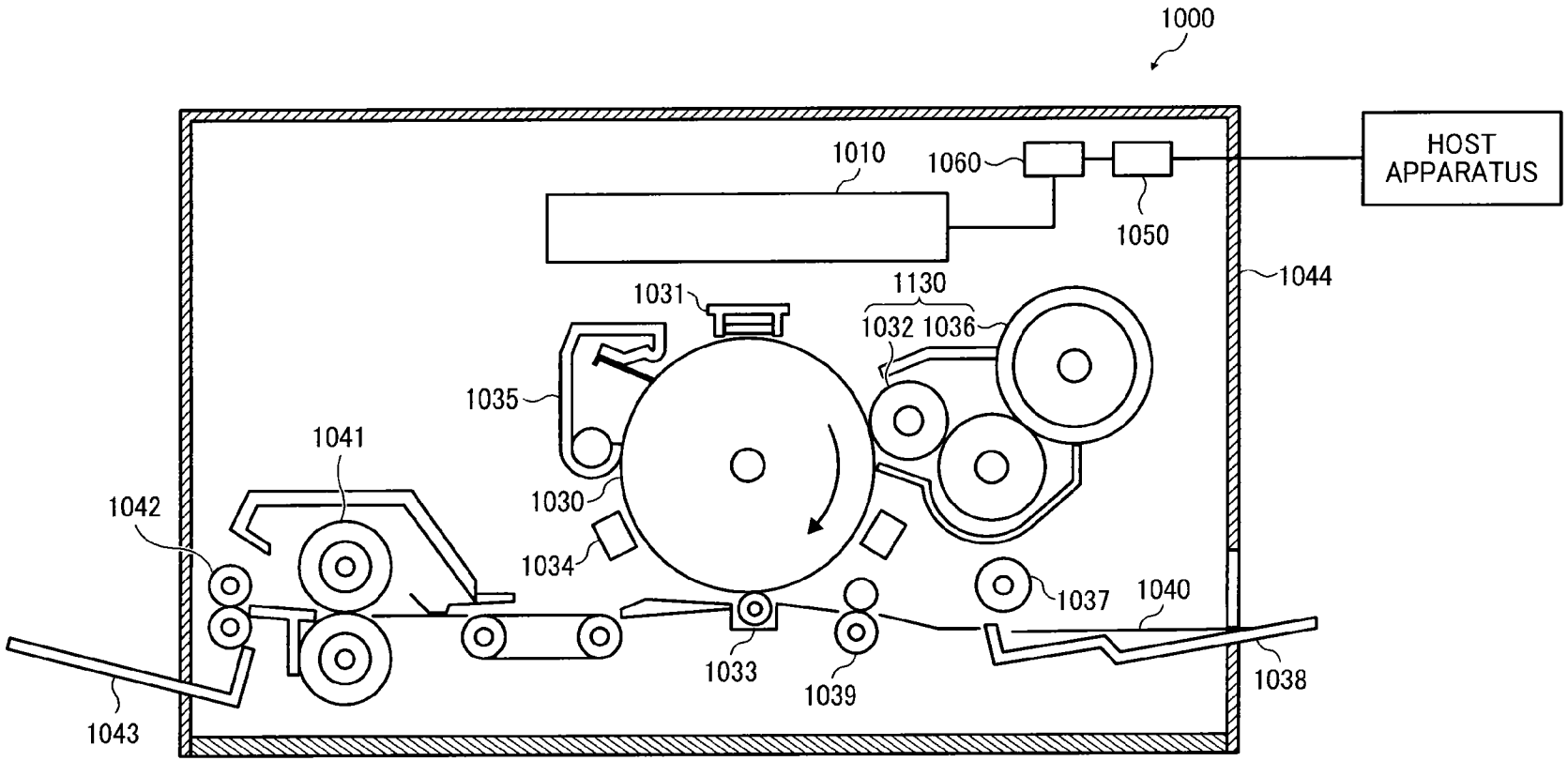
FIG. 1 is a central cross-sectional diagram illustrating an embodiment of an image forming apparatus according to the present invention.

The present invention provides an image forming method capable of forming an image having high latent image MTF (Modulation Transfer Function) resolution.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Image Forming Apparatus

First, an embodiment of the image forming apparatus of the present invention is explained.

A laser printer 1000 in FIG. 1 includes a photoreceptor drum 1030, and a charger 1031, an optical scanner 1010, an image developer 1130, a transferer 1033 and a cleaning unit 1035 along a rotational direction of the photoreceptor drum 1030 in this order therearound.

The charger 1031 executes a charging process. The optical scanner 1010 executes an exposure process. The image developer 1130 executes a developing process. The transferer 1033 executes a transfer process. The cleaning unit 1035 executes a cleaning process.

A discharge unit 1034 is located between the transferer 1033 and the cleaning unit 1035 as well.

The image developer 1130 includes a toner cartridge 1036 and a developing roller 1032 applying a toner fed from the toner cartridge 1036 onto the surface of the photoreceptor drum 1030 to visualize a latent image thereon with the toner.

The transferer 1033 transfers a toner image on the surface of the photoreceptor drum 1030 to a recording paper 1040 drawn out from paper feeding tray 1038 by a paper feeding roller 1037. A front end of the recording paper 1040 is positioned by a registration roller 1039, and the recording paper is ejected through a fixer 1041 to a paper ejection tray 1043 by a paper ejection roller 1042 in synchronization with the toner image on the surface of the photoreceptor drum 1030.

In addition, the laser printer 1000 includes a communication controller 1050 and a printer controller 1060.

The communication controller 1050 controls bi-directional communication with a host apparatus (for example, an information processing apparatus such as a PC) via a network or the like.

The printer controller 1060 includes a Central Processing Unit (CPU) and a Read Only Memory (ROM), which are not illustrated. In addition, the printer controller 1060 includes a Random Access Memory (RAM) and an Analog/Digital (A/D) converter. Here, the printer controller 1060 overall controls the components in response to requests from the host apparatus and transmits image information of the host apparatus to the optical scanner 1010.

The ROM stores a program which is written in code readable by the CPU and various data used to execute the program.

The RAM is a temporary writable memory for a task of the CPU.

The A/D converter converts an analog signal into a digital signal.

The photoreceptor drum 1030 is a latent image bearer of a cylindrical member, and a photoreceptor layer is formed on the surface thereof. That is, the surface of the photoreceptor drum 1030 is a scanning surface. In addition, the photoreceptor drum 1030 is rotated by a driving mechanism (not illustrated) in the arrow direction in FIG. 1.

The charger 1031 uniformly charges the surface of the photoreceptor drum 1030. Here, for example, a contact type charging roller where a small amount of ozone is generated or a corona charger using corona discharge may be used for the charger 1031.

Figure 2:
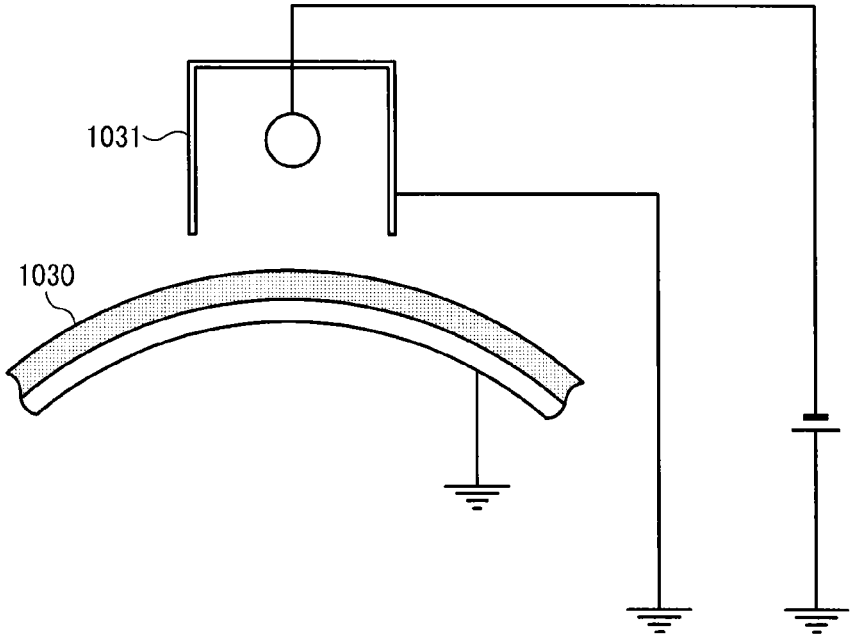
FIG. 2 is a schematic diagram illustrating a corotron type charger of the image forming apparatus.
Figure 3:
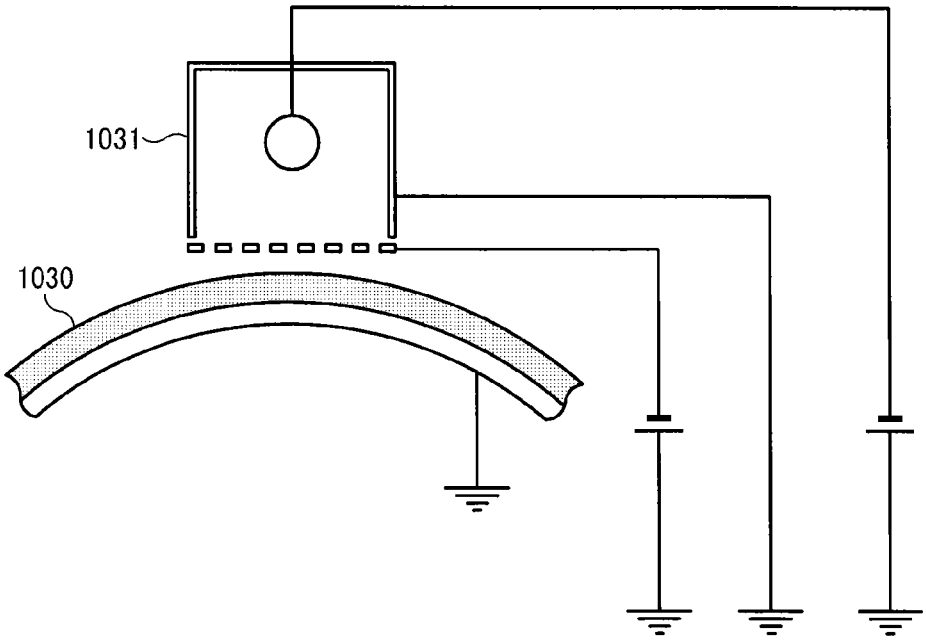
FIG. 3 is a schematic diagram illustrating a scorotron type charger of the image forming apparatus.

FIG. 2 is a schematic diagram illustrating a corotron type charger of the image forming apparatus. In addition, FIG. 3 is a schematic diagram illustrating a scorotron type charger of the image forming apparatus. Here, the charger 1031 may be the corotron type charger illustrated in FIG. 2, may be the scorotron type charger illustrated in FIG. 3, or may be a roller type charger (not illustrated).

Incidentally, the above-described components of the laser printer 1000 are accommodated at predetermined positions inside a printer chassis 1044.

Returning to FIG. 1, the optical scanner 1010 performs exposure by scanning the surface of the photoreceptor drum 1030 charged by the charger 1031 with light flux modulated based on the image information of the printer controller 1060. The optical scanner 1010 forms the electrostatic latent image correspondent to the image information on the surface of the photoreceptor drum 1030.

The electrostatic latent image formed by the optical scanner 1010 is moved toward the image developer 1130 according to the rotation of the photoreceptor drum 1030. Incidentally, details of the optical scanner 1010 will be described later.

The toner cartridge 1036 contains the toner (developer). The toner is supplied from the toner cartridge 1036 to the image developer 1130.

The image developer 1130 develops the electrostatic latent image by applying the toner supplied from the toner cartridge 1036 to the latent image formed on the surface of the photoreceptor drum 1030. Here, the image (hereinafter, referred to as a "toner image") where the toner is adhered is moved toward the transferer 1033 according to the rotation of the photoreceptor drum 1030.

The paper feeding tray 1038 contains the recording paper 1040. The paper feeding roller 1037 is disposed in the vicinity of the paper feeding tray 1038.

The paper feeding roller 1037 draws the recording paper 1040 out from the paper feeding tray 1038 one by one. The recording paper 1040 is drawn out from the paper feeding tray 1038 toward a gap between the photoreceptor drum 1030 and the transferer 1033 in accordance with the rotation of the photoreceptor drum 1030.

The transferer 1033 is applied with a voltage having a polarity opposite to the toner in order to electrically attract the toner of the surface of the photoreceptor drum 1030 to the recording paper 1040. Due to the voltage, the toner image of the surface of the photoreceptor drum 1030 is transferred to the recording paper 1040. The recording paper 1040 where the toner image is transferred is transported to the fixer 1041.

In the fixer 1041, heat and pressure are applied to the recording paper 1040, so that the toner is fixed on the recording paper 1040. Here, the recording paper 1040 where the toner is fixed is ejected through the paper ejection roller 1042 to the paper ejection tray 1043 to be sequentially stacked on the paper ejection tray 1043, so that a printed matter is produced.

The discharge unit 1034 neutralizes the surface of the photoreceptor drum 1030.

The cleaning unit 1035 removes the toner remaining on the surface of the photoreceptor drum 1030 (residual toner). The surface of the photoreceptor drum 1030 where the residual toner is removed is returned to a position facing the charger 1031.

In the image forming apparatus according to the present invention, the electrostatic latent image is formed by the charger, the optical scanner as an exposing device, the photoreceptor, and the image processor for converting the image pattern into an optical output.

Thus, in the electrophotography method, in the charging process, the photoreceptor as one latent image bearer is uniformly charged. In addition, in the electrophotography method, in the exposure process, charges are partially escaped by irradiating the photoreceptor with light. By doing so, in the electrophotography method, the electrostatic latent image can be formed on the photoreceptor.

Configuration of Optical Scanner

Next, a configuration of the optical scanner 1010 constituting the image forming apparatus will be described.

Figure 4:
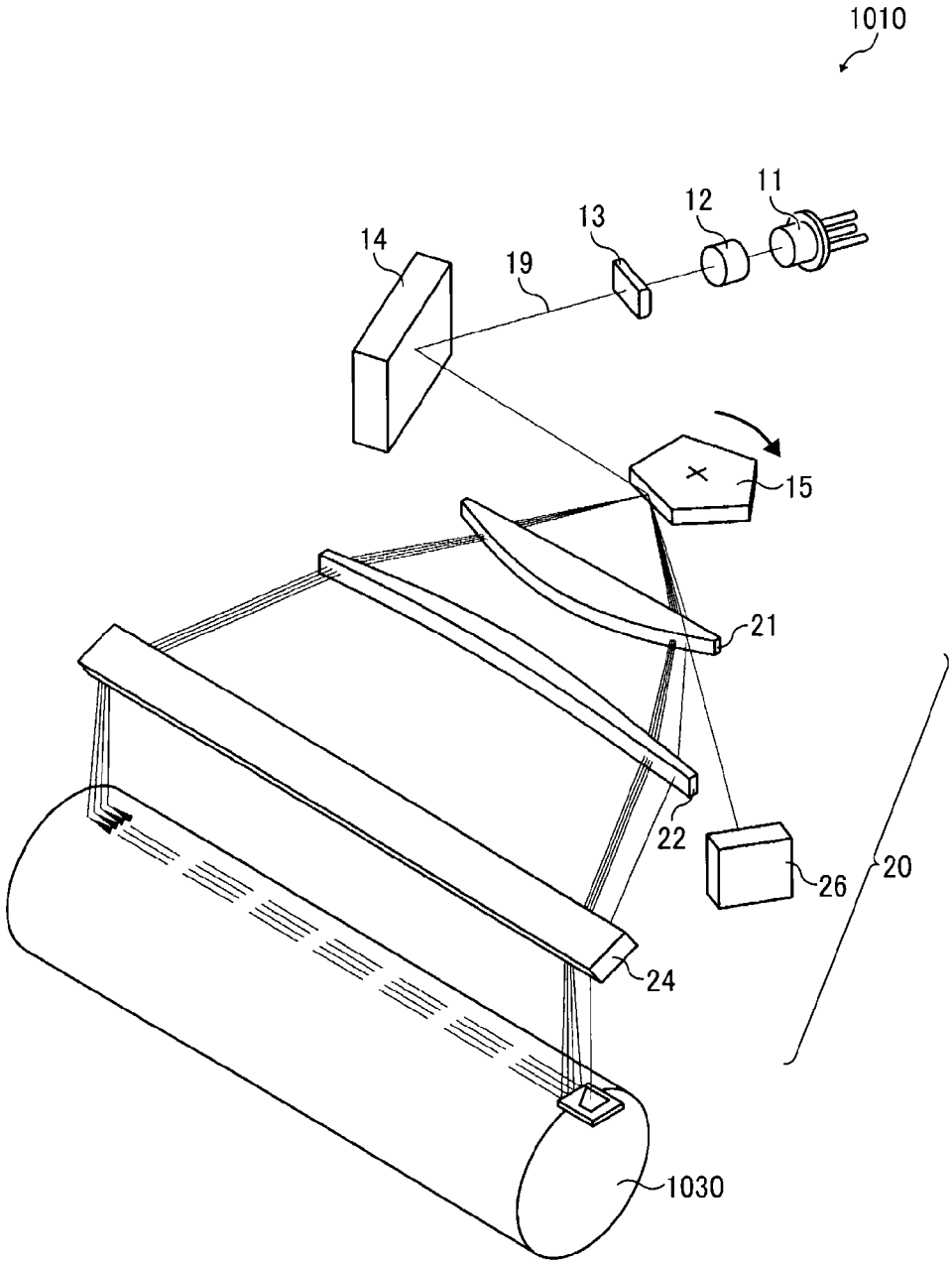
FIG. 4 is a schematic diagram illustrating an example of an optical scanner constituting the image forming apparatus.

FIG. 4 is a schematic diagram illustrating an example of the optical scanner 1010. As illustrated in the figure, the optical scanner 1010 includes a light source 11, a collimator lens 12, a cylindrical lens 13, a folding mirror 14, a polygon mirror 15, and a first scanning lens 21. In addition, the optical scanner 1010 further includes a second scanning lens 22, a folding mirror 24, a synchronization detection sensor 26, and a scanning controller (not illustrated).

Figure 38:
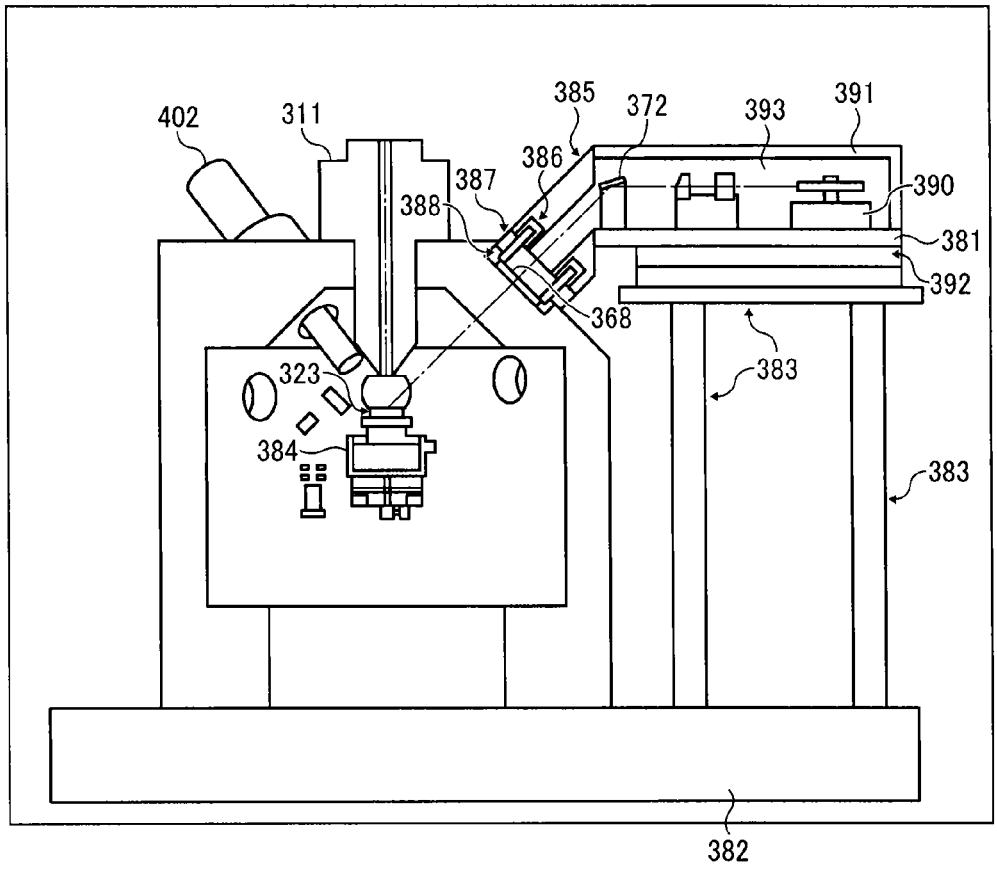
FIG. 38 is a cross-sectional diagram illustrating a vacuum chamber equipped in the image forming apparatus.

Here, the optical scanner 1010 is assembled at a predetermined position of an optical housing 381 in FIG. 38.

Incidentally, in the description hereinafter, the direction along the longitudinal direction (rotation axis direction) of the photoreceptor drum 1030 is called the Y axis direction of the XYZ three-dimensional rectangular coordinate system, the direction along the rotation axis of the polygon mirror 15 is called the Z axis direction, and the direction perpendicular to the Y and Z axes is called the X axis direction.

In addition, in the description hereinafter, the direction correspondent to the main-scanning direction of each optical member is called the "main-scanning corresponding direction", and the direction correspondent to the sub-scanning direction is called the "sub-scanning corresponding direction".

Here, the light source 11 may be constructed by using a semiconductor laser (Laser Diode: LD), a light emitting diode (Light Emitting Diode: LED), or the like.

Figure 5:
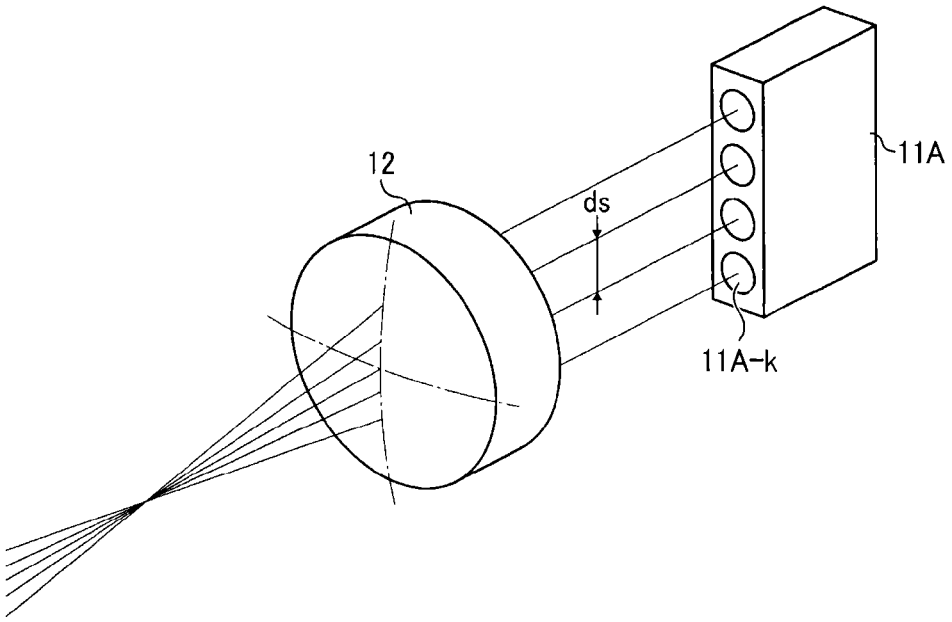
FIG. 5 is a schematic diagram illustrating an example of a light source of the optical scanner.

FIG. 5 is a schematic diagram illustrating an example of the light source of the optical scanner 1010. In the figure, a light source 11A as a multi-beam light source is a semiconductor laser array constructed by arraying four semiconductor lasers. In addition, the light source 11A is disposed to be perpendicular to the optical axis direction of the collimator lens 12.

Figure 6:
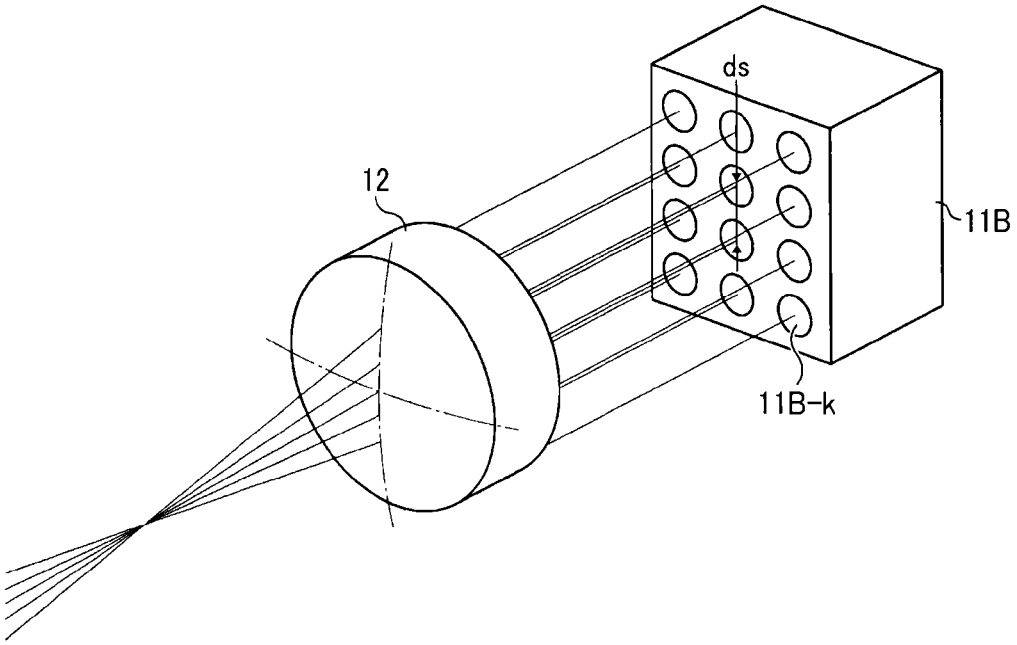
FIG. 6 is a schematic diagram illustrating another example of the light source of the optical scanner.

FIG. 6 is a schematic diagram illustrating another example of the light source of the optical scanner 1010. In the figure, a light source 11B is a vertical cavity surface emitting laser (VCSEL) having a wavelength of, for example, 780 nm where light emitting points are arranged in a plane including the Y and Z axis directions.

When all the light-emitting units are orthogonally projected on a virtual line extending in the sub-scanning corresponding direction, light-emitting units are arrayed such that intervals between the light-emitting units are equal. In the description hereinafter, a "light-emitting unit interval" denotes a distance between centers of two light-emitting units.

The light source 11B has, for example, a total of twelve light emitting points 11B-k, that is, three light emitting points in the horizontal direction (main-scanning direction, Y axis direction) and four light emitting points in the vertical direction (sub-scanning direction, Z axis direction).

In addition, in the case where the light source 11B is applied to the optical scanner 1010, respective scan lines may be scanned with three light emitting points arranged in the horizontal direction, so that four scan lines in the vertical direction are simultaneously scanned.

Returning to FIG. 4, the collimator lens 12 is disposed on the optical path of the light emitted from the light source 11 to control the light to be parallel light or substantially parallel light.

The cylindrical lens 13 converges the light passing through the collimator lens 12 only in the Z axis direction (sub-scanning direction) in the vicinity of a deflecting reflection plane of the polygon mirror 15.

The cylindrical lens 13 forms an image of light 19 emitted from the light source 11 as a line image elongated in the main-scanning direction (Y axis direction) in the vicinity of a reflection plane of the folding mirror 14.

The folding mirror 14 reflects the light having passed through the cylindrical lens 13 and imaged, toward the polygon mirror 15.

In addition, the optical system disposed on the optical path between the light source 11 and the polygon mirror 15 is also called a pre-deflector optical system.

The polygon mirror 15 is a polygon mirror rotating around the rotation axis perpendicular to the longitudinal direction (rotation axis direction) of the photoreceptor drum 1030. Here, each mirror plane of the polygon mirror 15 is a deflecting reflection plane.

A driving Integrated Circuit (IC) (not illustrated) applies appropriate clock to a motor unit (not illustrated), so that the polygon mirror 15 is rotated at a desired constant speed.

The polygon mirror 15 is rotated at a constant speed in the arrow direction by the motor unit, and a plurality of light beams reflected on the deflecting reflection planes becomes respective deflecting beams to be deflected at a constant angular velocity.

The first scanning lens 21, the second scanning lens 22, the folding mirror 24, and the synchronization detection sensor 26 constitute a scanning optical system. The scanning optical system is disposed on the optical path of the light deflected by the polygon mirror 15.

The first scanning lens 21 is disposed on the optical path of the light deflected by the polygon mirror 15.

The second scanning lens 22 is disposed on the optical path of the light through the first scanning lens 21.

The folding mirror 24 is an elongated plane mirror and folds the optical path of the light through the second scanning lens 22 to the direction toward the photoreceptor drum 1030.

That is, the photoreceptor drum 1030 is irradiated with the light deflected by the polygon mirror 15 through the first scanning lens 21 and the second scanning lens 22, so that light spots are formed on the surface of the photoreceptor drum 1030.

The light spot of the surface of the photoreceptor drum 1030 is moved along the longitudinal direction of the photoreceptor drum 1030 according to the rotation of the polygon mirror 15. Here, the movement direction of the light spot on the surface of the photoreceptor drum 1030 is the "main-scanning direction", and the rotation direction of the photoreceptor drum 1030 is the "sub-scanning direction".

The synchronization detection sensor 26 receives the light from the polygon mirror 15 and outputs a signal (photoelectric conversion signal) according to a received light amount to the scanning controller. Here, the output signal of the synchronization detection sensor 26 is also called a "synchronization detection signal".

As illustrated in FIG. 4, in the optical scanner 1010, by the scanning using one deflecting reflection plane of the polygon mirror 15, a plurality of lines on the scanning surface of the photoreceptor drum 1030 is simultaneously scanned. A buffer memory inside the image processor controlling a light emitting signal of each light emitting point stores print data for one line correspondent to each light emitting point.

The print data are read out for each deflecting reflection plane of the polygon mirror 15, and a light beam is turned on and off on the scan line on the photoreceptor drum 1030 as the latent image bearer according to the print data, so that the electrostatic latent image is formed along the scan line.

Figure 7:
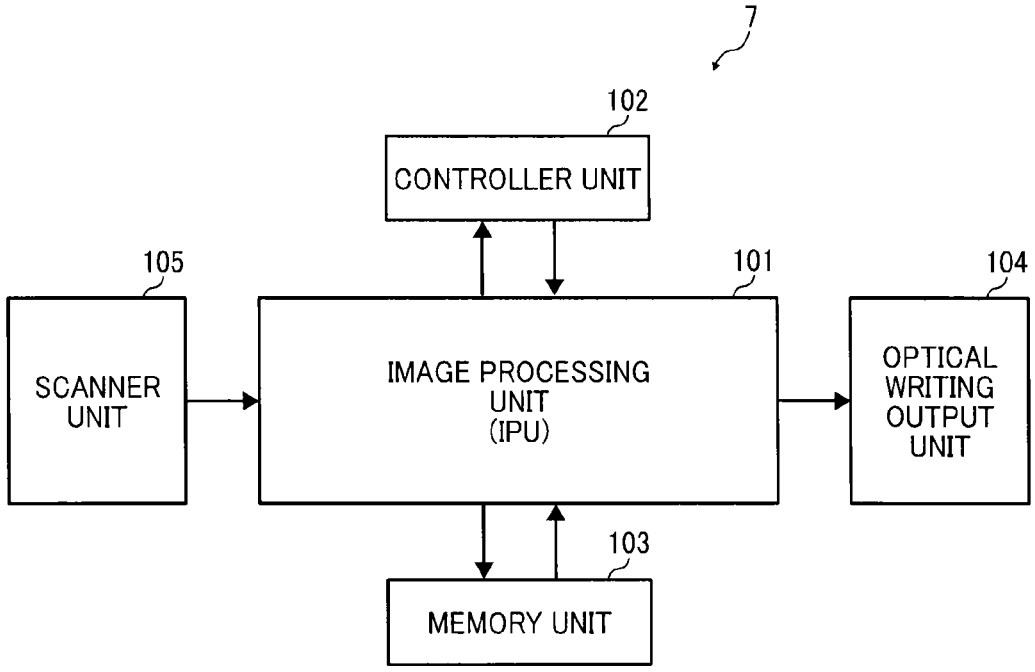
FIG. 7 is a block diagram illustrating an image processor of the image forming apparatus.

FIG. 7 is a block diagram illustrating the image processor of the image forming apparatus. As illustrated in the figure, the image processor 7 includes an image processing unit (Image Processing Unit: IPU) 101, a controller 102, a memory 103, an optical writing output unit 104, and a scanner unit 105.

The controller 102 performs processes of rotation, repeating, collection, compression, decompression, and the like on the image data and after that, outputs the processed image data to the IPU again.

In the memory 103, a lookup table for storing various data is prepared.

The optical writing output unit 104 performs optical modulation of the light source 11 according to the lighting data by a control driver and forms the electrostatic latent image on the photoreceptor drum 1030.

The optical writing output unit 104 determines an exposure pattern by time concentration exposure, based on an input signal from a gradation processor 101*f* described later. The optical writing output unit 104 forms an electrostatic latent image, based on the exposure pattern.

The optical writing output unit 104 can determine an exposure pattern after various image processes by the image processor 101 described later. Namely, the time concentration exposure described later determines an effective exposure pattern.

The formed electrostatic latent image causes the image developer 1130, the transferer 1033, and the like above described to form an image on the recording paper.

The scanner unit 105 reads the image and generates image data such as Red, Green, and Blue (RGB) data based on the image.

Figure 8:
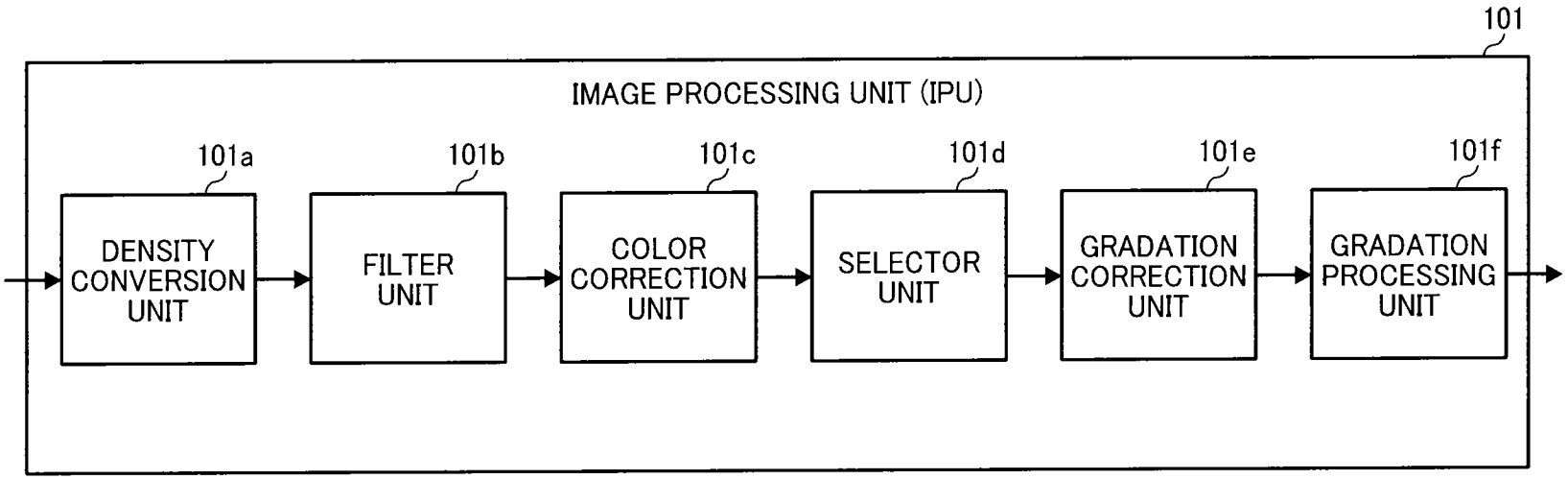
FIG. 8 is a block diagram illustrating an image processing unit of the image processor.

FIG. 8 is a block diagram illustrating the image processor 101. As illustrated in the figure, image processor 101 includes a density converter 101*a*, a filter 101*b*, a color corrector 101*c*, a selector 101*d*, a gradation corrector 101*e*, and a gradation processor 101*f*.

The density converter 101*a* converts the RGB image data of the scanner 105 into the density data by using the lookup table and outputs the density data to the filter 101*b*.

The filter 101*b* performs image correction processes such as a smoothing process or an edge enhancing process on the density data input from the density converter 101*a* and output the density data after the image correction processes to the color corrector 101*c*. The color corrector 101*c* performs a color correction (masking) process.

Under the control of the image processor 101, the selector 101*d* selects any of Cyan (C), Magenta (M), Yellow (Y), and Key Plate (K) from the image data input from the color corrector 101*c*. The selector 101*d* outputs the data of selected C, Y, M, and K to the gradation corrector 101*e*.

The gradation corrector 101*e* stores the data of C, M, Y, and K input from the selector 101*d* in advance. In the gradation corrector 101*e*, a γ curve from which linear characteristics are obtained is set for the input data.

The gradation processor 101*f* performs a gradation process such as a dither process on the image data input from the gradation corrector 101*e* and outputs the resulting signal to the optical writing output unit 104.

Optical Writing Output Unit

The optical writing output unit 104 controls the light source to drive. The optical writing output unit 104 is, e.g., a controller driving a LD.

Figure 9:
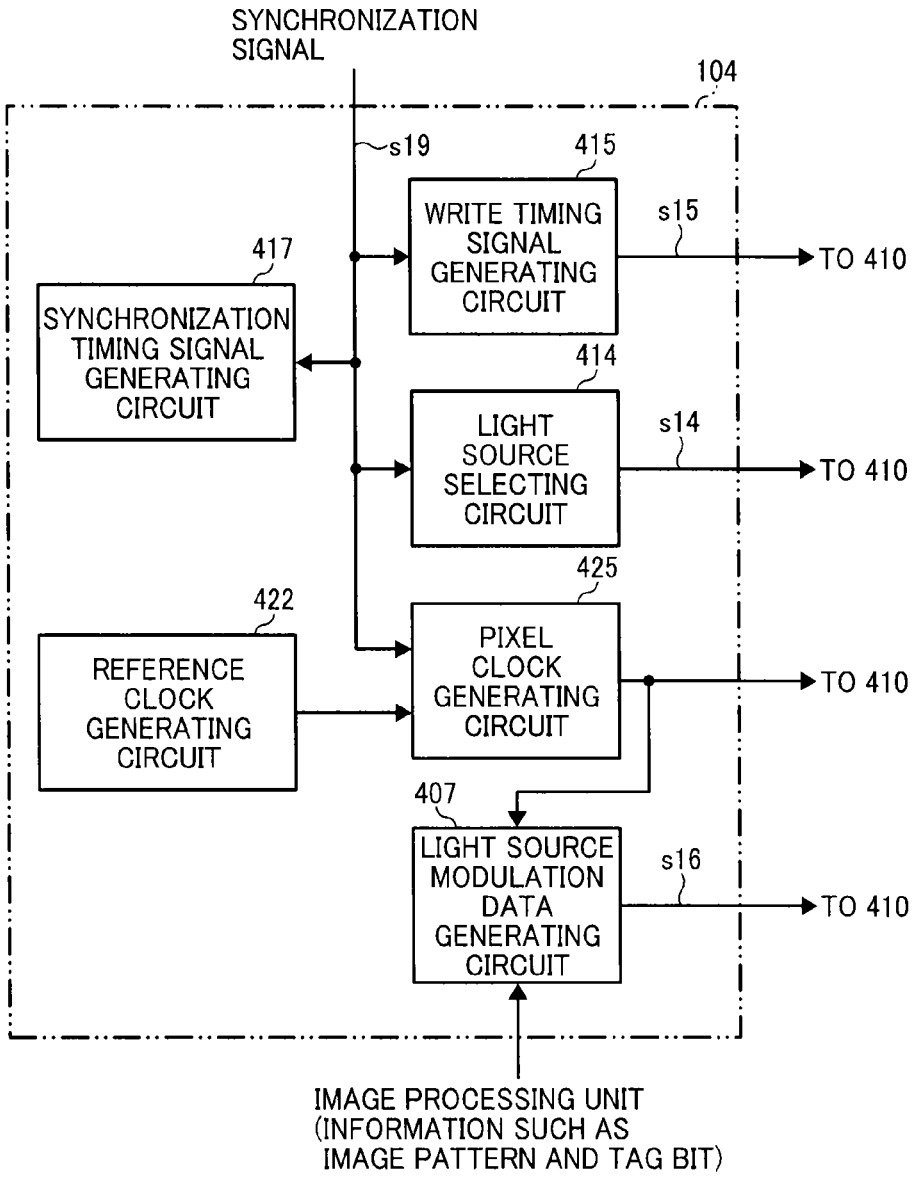
FIG. 9 is a block diagram illustrating an optical writing unit of the image processor.

As illustrated in FIG. 9, optical writing output unit 104 includes a reference clock generating circuit 422 and a pixel clock generating circuit 425. In addition, the light source driving control unit 1019 includes a light source modulation data generating circuit 407, a light source selecting circuit 414, a write timing signal generating circuit 415, and a synchronization timing signal generating circuit 417.

Incidentally, in FIG. 9, the arrows illustrate the representative flows of signals and information, but the arrows do not illustrate all the connection relationship between the respective blocks.

The reference clock generating circuit 422 generates a high frequency clock signal which is used as a reference of the entire optical writing output unit 104.

The pixel clock generating circuit 425 mainly includes a Phase Locked Loop (PLL) circuit. The pixel clock generating circuit 425 generates a pixel clock signal based on a synchronization signal s19 and a high-frequency clock signal of the reference clock generating circuit 422.

Here, the pixel clock signal is configured such that the frequency is the same as that of the high-frequency clock signal and the phase is coincident with that of the synchronization signal s19.

Therefore, the pixel clock generating circuit 425 controls the writing position for each scanning by synchronizing the image data with the pixel clock signal.

Here, the generated pixel clock signal is supplied as a kind of the driving information to a light source driver 410 and is also supplied to the light source modulation data generating circuit 407. The pixel clock signal supplied to the light source modulation data generating circuit 407 is supplied to the light source driver 410 as a clock signal for writing data s16.

The light source selecting circuit 414 is a circuit used in the case where a plurality of the light sources is used and outputs a signal designating the selected light-emitting unit. The output signal s14 of the light source selecting circuit 414 is supplied as a kind of the driving information to the light source driver 410.

Exposure Method (1)

Next, the exposure method in the embodiment of the image forming method according to the present invention will be described.

In the image forming method according to the embodiment, the optical output waveform used for the latent image formation is a waveform for exposing the photoreceptor for a predetermined time with the light power value required to obtain a target image density in the image portion including the line image or the solid image.

In addition, the image portion is composed of a plurality of pixels and is a portion for forming an image by adhering toner in the image pattern. In addition, the non-image portion is a portion where no toner is adhered in the image pattern and no image is formed.

In the description hereinafter, the image density as a target is called a "target image density". In addition, in the description hereinafter, a predetermined light power value required to obtain the target image density is called a "target exposure output value". In addition, in the description hereinafter, a predetermined time for exposing the entire pixels of the image portion with the target exposure output value to obtain the target image density is called a "target exposure time".

In addition, in the description hereinafter, an exposure method of exposing for the target exposure time with the target exposure output value is called "standard exposure". In addition, in the embodiment, the solid image denotes an image portion having an area larger than that of a line image.

In addition, in the description hereinafter, the exposing the photoreceptor with the light power value (first light power value) higher than the target exposure output value for the exposure time shorter than the target exposure time is called "time concentration exposure". In addition, in the description hereinafter, the time concentration exposure may also be called TC (Time Concentration) exposure.

Figure 10:
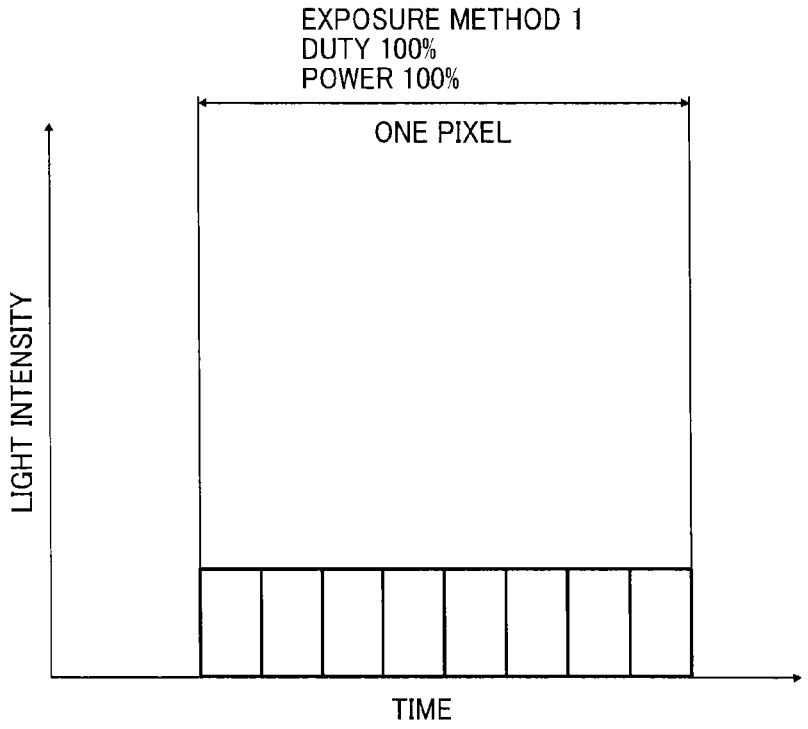
FIG. 10 is a schematic diagram illustrating an image portion of image data exposed with a predetermined light power value required for exposing the image portion.

FIG. 10 is a schematic diagram illustrating an example of a standard exposure method. As illustrated in the figure, the exposure method (hereinafter, referred to as an "exposure method 1") according to the standard exposure of the reference example is a waveform for exposing the photoreceptor for the target exposure time with the target exposure output value as described above with respect to the 1-dot image portion including the line image or the solid image. Here, the target exposure output value is set to 100% of the light power value, and the target exposure time is set to a duty ratio of 100%.

Figure 11:
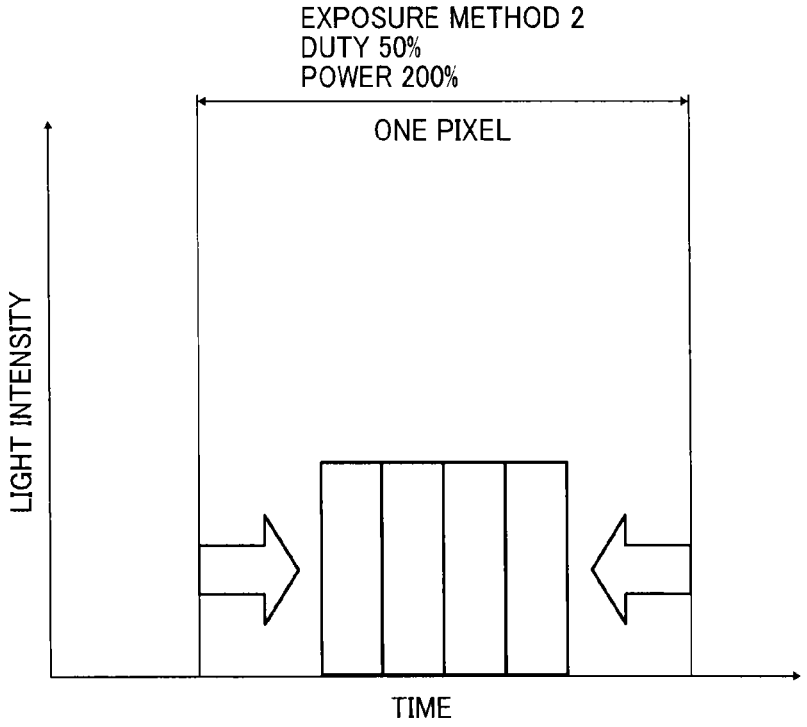
FIG. 11 is a schematic diagram illustrating an embodiment of exposure method used by the image forming apparatus.

FIG. 11 is a schematic diagram illustrating an example of the image forming method according to the present invention. As illustrated in the figure, in the exposure method (hereinafter, referred to as an "exposure method 2") according to the TC exposure according to the embodiment, the photoreceptor is exposed with the target exposure output value being set to 200% of the light power value and with the target exposure time being set to a duty ratio of 50%. Here, when the width of the image portion is set to one, the width of the exposing section is ⅝ pixels.

Figure 12:
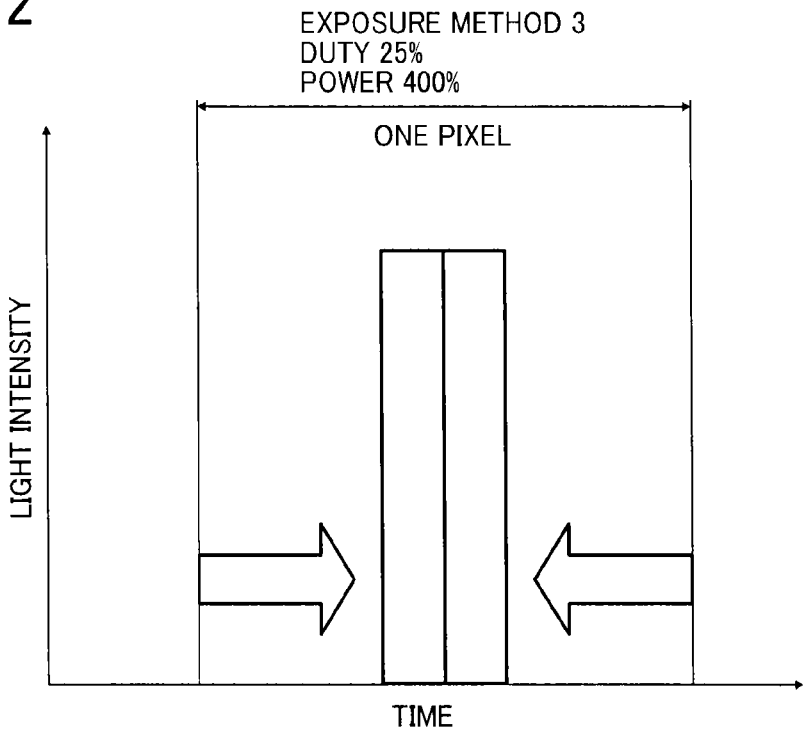
FIG. 12 is a schematic diagram illustrating another embodiment of exposure method used thereby.

FIG. 12 is a schematic diagram illustrating another example of the image forming method according to the present invention. As illustrated in the figure, in the exposure method (hereinafter, referred to as an "exposure method 3") according to the time concentration exposure according to the embodiment, the photoconductor is exposed with the target exposure output value being set to 400% of the light power value and with the target exposure time being set to a duty ratio of 25%. Here, if the width of the image portion is set to one, the width of the exposing section is ⅜ pixels.

Figure 13:
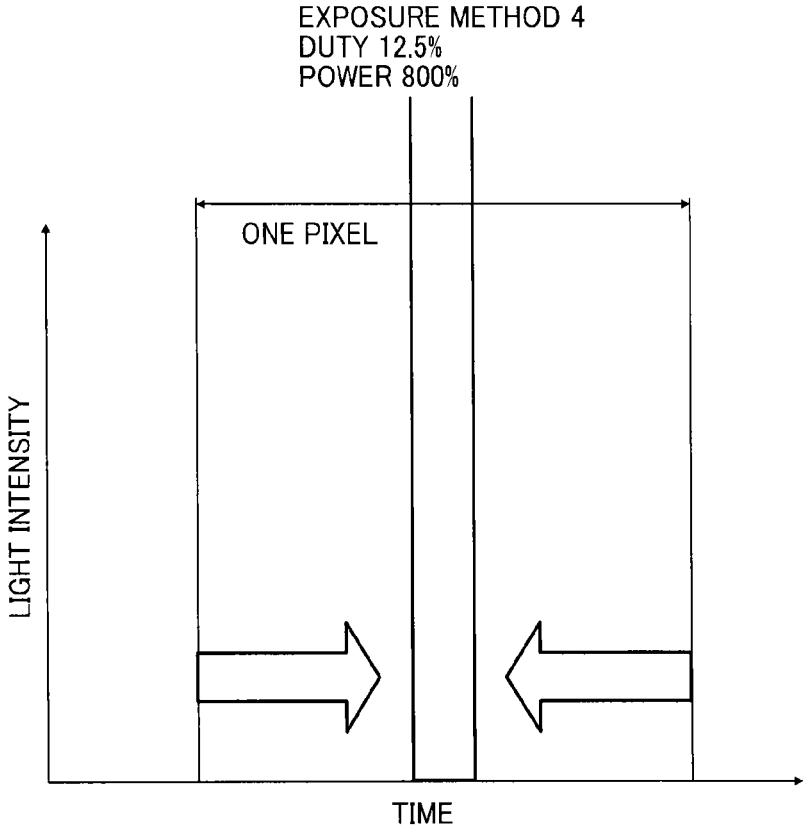
FIG. 13 is a schematic diagram illustrating a further embodiment of exposure method used thereby.

FIG. 13 is a schematic diagram illustrating still another example of the image forming method according to the present invention. As illustrated in the figure, in the exposure method (hereinafter, referred to as an "exposure method 4") according to the time concentration exposure according to the embodiment, the photoconductor is exposed with target exposure output value being set to 800% of the light power value and with the target exposure time being set to a duty ratio of 12.5%. Here, when the width of the image portion is set to one, the width of the exposing section is ⅛ pixels.

In the above-described exposure methods 2 to 4, the pulse widths are smaller than that of the exposure method 1. That is, in the exposure methods 2 to 4, the formed latent image becomes small when the exposure is performed with the same light amount as that of the exposure method 1, and therefore the light amounts are controlled according to the pulse widths so that the integrated light amounts during the latent image formation period are equivalent to each other.

That is, in the exposure methods 2 to 4 according to the time concentration exposure, the exposure is performed with a small pulse width and a strong light intensity in comparison with the exposure method 1 according to the standard exposure.

Incidentally, in the description heretofore, in the exposure methods 2 to 4, the light power value is set so that the integrated light amount is constant. However, in the image forming method according to the present invention, it is not limited thereto.

Figure 14:
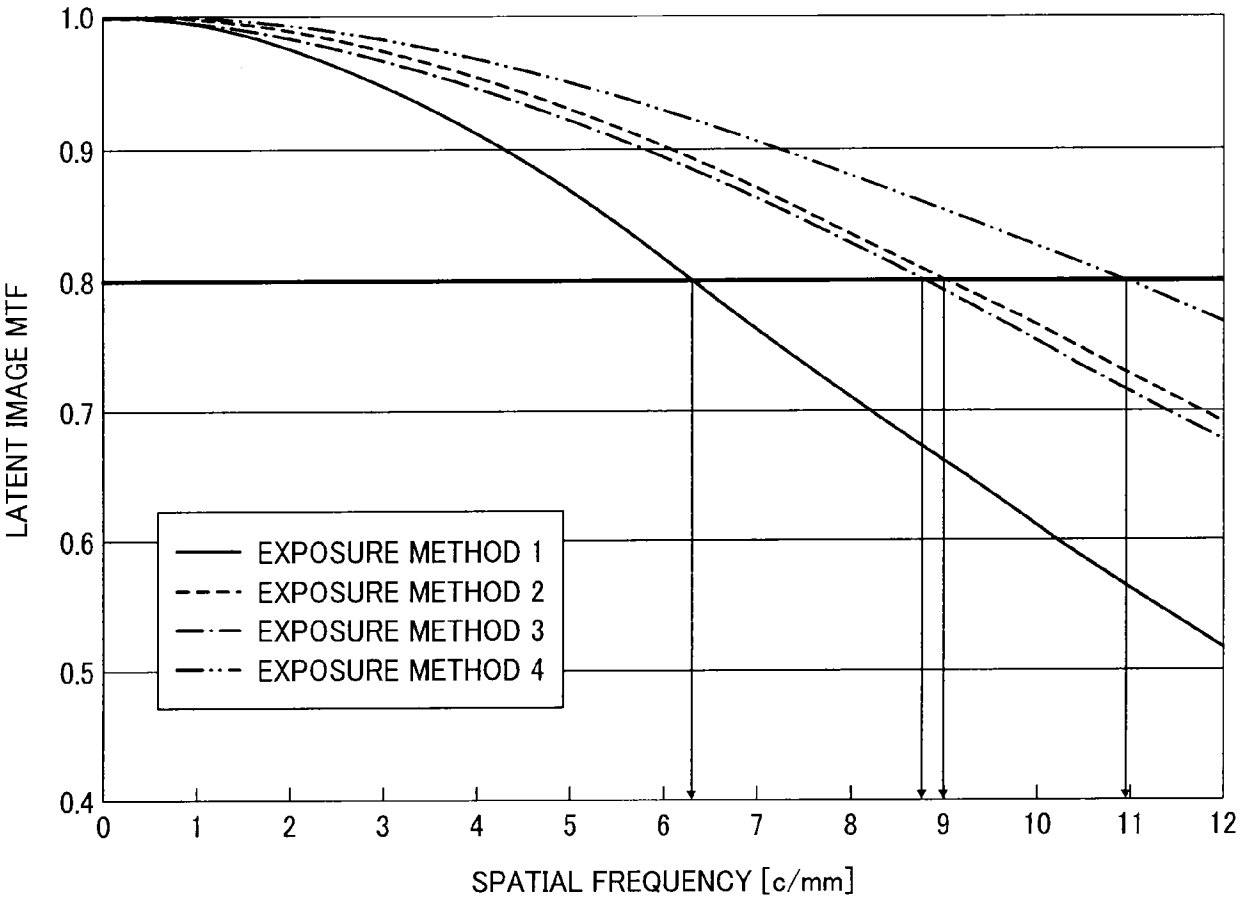
FIG. 14 is a graph showing a relationship between a spatial frequency and a latent image MTF for each of the exposure methods.

FIG. 14 is a schematic diagram illustrating the measurement result of a latent image MTF in a vertical direction when a beam spot diameter used for the exposure is 70 μm (main-scanning direction)×90 μm (sub-scanning direction). The horizontal axis is a spatial frequency and the vertical axis is a latent image MTF. In the exposure methods 2 to 4, a latent image MTF shows a high value up to a high frequency band in comparison with the exposure method 1.

In the exposure methods 2 to 4, the smaller-diameter latent image can be stably formed in comparison with the exposure method 1. Particularly, it is illustrated that, among the exposure methods 2 to 4, the exposure method 4 where the pulse width is smallest is appropriate for the stable formation of the small-diameter latent image.

In the exposure methods 2 to 4, since the exposure is performed with the small pulse width and the strong light intensity, the latent image resolution is improved in comparison with the exposure method 1. That is, it is illustrated that, according to the exposure methods 2 to 4 used for the image forming method according to the present invention, the small-diameter latent image can be stably formed in comparison with the exposure method 1 used for the image forming method of the related art.

In the image forming method according to the present invention, in the case where the stability of a latent image in a high-frequency region, that is, a latent image having a small diameter is emphasized, the exposure method according to the TC exposure has a superiority to the case where exposure is performed with a small beam spot diameter according to the exposure method of the related art. Here, the optimal beam spot diameter according to the difference of the output images is determined by the latent image MTF at the maximum spatial frequency required as the output image.

The exposure method according to the TC exposure should be further noted that the width of the latent image electric vector is narrow in comparison with other means and this means that the latent image electric vector is increased as well as the resolution is improved.

In addition, in the image forming method according to the present invention, unlike the case where the exposure is performed by controlling the light source through the power modulation or the pulse width modulation, the integrated light amount is equal to the case where the exposure is performed with the target exposure output value. For this reason, in the image forming method according to the present invention, the adhesion amount of toner or the total image density is not substantially different from the case where the exposure is performed with the target exposure output value.

As described above, in the case of the PM modulation where the irradiation can be performed with a light power value P1 higher than a target exposure output value P0 at the time of forming a solid image density, a ratio (TCR) of light power values is defined as TCR=P1/P0.

In this case, in the exposure method according to the embodiment, a width of a longitudinal line is compressed to 1/TCR, and the exposure is performed with the light power value higher than the target exposure output value at the time of the solid image density. By doing so, according to the exposure method according to the embodiment, an image having a high MTF resolution can be formed.

In the exposure method according to the embodiment, the narrow range of the image portion where the image is to be formed in the image pattern is exposed by concentrating strong light. By doing so, in the exposure method according to the embodiment, the fidelity of the micro-sized output image pattern smaller than the beam diameter size (the influence of the size of the beam diameter cannot be ignored) can be improved, and the image pattern can be adjusted with a desired image density.

That is, according to the exposure method according to the embodiment, the output image compatibly realizing the formation of the micro-sized image pattern and the desired image density can be formed.

In addition, the exposure method according to the embodiment can be easily applied to any image pattern without performing any particular process such as edge detection or character information recognition.

Therefore, according to the exposure method according to the embodiment, even in the case where object information cannot be obtained from a computer when the image data are converted into the light source modulation data, the image pattern can be generated.

In addition, according to the exposure method according to the embodiment, the output image compatibly realizing the formation of the micro-sized image pattern and the desired image density can be formed without associating the image data and the light source modulation data for each character.

In addition, the exposure method according to the embodiment uses the PM+PWM modulation which is a combination of the Phase Modulation (PM) and the Pulse Width Modulation (PWM). In addition, according to the exposure method according to the embodiment, the integrated light amount of the image pattern during the exposing period may be the same value as the standard exposure by using the TC exposure where the maximum light power is intentionally set to be strong.

Here, according to the exposure method according to the embodiment, the resolution of the image pattern can be improved by forming a depth latent image without changing the image density of the image pattern.

In the exposure method according to the embodiment, the light power value is set such that the one or more pixels (pixel groups) inside the image portion existing at the boundary between the image portion and the non-image portion included in the image pattern become non-exposure pixels. Here, the group that is not exposed inside the image portion existing at the boundary between the image portion and the non-image portion included in the image pattern is called a group of non-exposure pixels. In addition, in the exposure method according to the embodiment, the exposure is performed with the light power value obtained by adding the light power value for the pixel group adjacent to the group of non-exposure pixels (in the vicinity of the group of non-exposure pixels) and the light power value for the group of non-exposure pixels.

Namely, the total of values of drawing a predetermined light power value from light power value of light exposing a high power exposure pixel equals to the total of values of drawing a light power value of light exposing a non-exposed pixel from a predetermined light power value.

This forms an exposure pattern having a high latent image MTF resolution.

Example of Forming Line Image

Next, an example of formation of a line image (determining an exposure pattern thereof) by the exposure method according to the embodiment will be described. The exposure pattern is an exposure light power pattern for each 1 dot correspondent to image data.

In addition, in the description hereinafter, in the figure, the Y axis direction (main-scanning direction) is set to the horizontal direction, and the Z axis direction (sub-scanning direction) is set to the vertical direction.

Figure 15A:
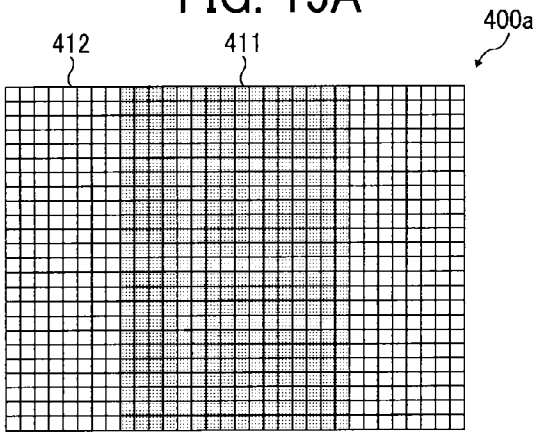
FIGS. 15A, 15B, 15C and 15D are schematic diagrams illustrating exposure patterns when a standard exposure method, an embodiment of exposure method of the present invention, another embodiment of exposure method thereof and a further embodiment of exposure method thereof are applied to line patterns, respectively.

FIG. 15A illustrates an exposure pattern 400*a* of a line image according to the standard exposure. The exposure pattern 400*a* includes an exposure pixel group 411 and a group of non-exposure pixels 412. The exposure pixel group 411 is a pixel group subjected to a standard exposure. The group of non-exposure pixels 412 is a pixel group which is not exposed.

The exposure pixel group 411 coincides with an image portion of a line image. The group of non-exposure pixels 412 coincides with a non-image portion of a line image.

Figure 15B:
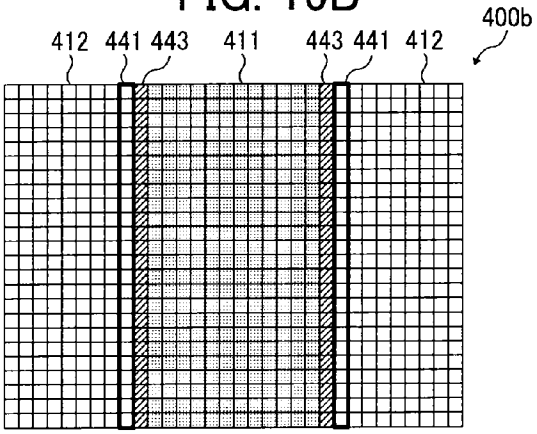
Figure 15C:
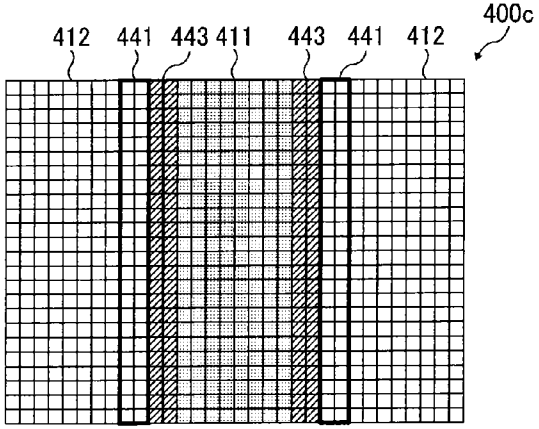
Figure 15D:
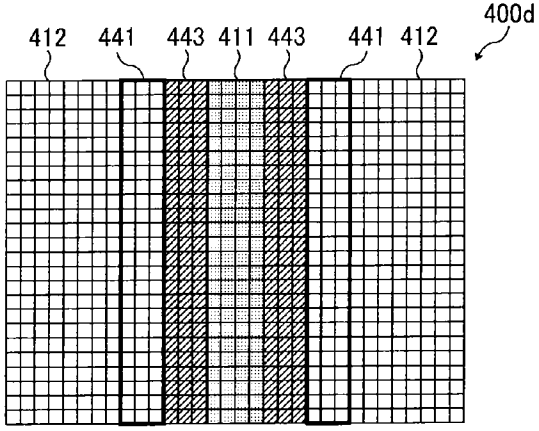
Figure 15D:
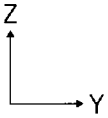

In addition, FIG. 15B illustrates an exposure pattern 400*b* of a line image where one dot at the boundary between the image portion and the non-image portion is set to a group of high power exposure pixels 443. In addition, FIG. 15C illustrates an exposure pattern 400*c* of a line image where two dots at the boundary between the image portion and the non-image portion 412 are set to a group of high power exposure pixels 443. In addition, FIG. 15D illustrates an exposure pattern 400*d* of a line image where three dots at the boundary between the image portion and the non-image portion 412 are set to a group of high power exposure pixels 443.

The group of high power exposure pixels 443 is a pixel group subjected to TC exposure with the first light power value.

In all the exposure patterns 400*a*, 400*b*, 400*c*, and 400*d* illustrated in FIGS. 15A, 15B, 15C, and 15D, the minimum pixel is 4800 dpi, and the spatial frequency is 6 c/mm. In the exposure patterns 400*a*, 400*b*, 400*c*, and 400*d*, a bold longitudinal line (line in the Z axis direction) is formed every 8×8 dots (correspondent to 600 dpi).

That is, the exposure pattern 400*a* illustrated in FIG. 15A includes an exposure portion (matching with the image portion) 411 and a non-image portion 412 composed of two vertical lines having 600 dpi. Here, the size of one pixel is about 5 μm.

In the exposure method according to the embodiment, the light power value is set such that, in the exposure pattern 400*b*, the pixel groups (for example, a plurality of images where one pixel in the Y axis direction is arranged in one row in the Z axis direction) existing at the boundary between the image portion and the non-image portion 412 become the non-exposure portion 441. Here, also in the examples hereinafter, the non-exposure portion 441 corresponds to the above-described group of non-exposure pixels. In addition, in the exposure method according to the embodiment, the pixel groups (for example, a plurality of the pixel groups where one pixel in the Y axis direction is arranged in one row in the Z axis direction) existing at the boundary between the exposure portion 411 and the non-exposure portion 441 are set as the group of high power exposure pixels 443.

In addition, in the exposure method according to the embodiment, when a magnification ratio of the TC exposure to the standard exposure is 2, the group of high power exposure pixels 443 is exposed with twice the light power. At this time, since the non-exposure portion 441 is not exposed, the integrated light amount of the entire exposure pattern 400*b* is the same as that of the exposure pattern 400*a*.

In addition, in the exposure method according to the embodiment, the number of pixels of the non-exposure portion 441 and the group of high power exposure pixels 443 may be set to an arbitrary number of pixels in the main-scanning direction or the sub-scanning direction.

The exposure pattern 400*c* is set such that the non-exposure portion 441 and the group of high power exposure pixels 443 have a width of two pixels in the Y axis direction. In addition, the exposure pattern 400*d* is set such that the non-exposure portion 441 and the group of high power exposure pixels 443 have a width of three pixels in the Y axis direction.

Figure 16:
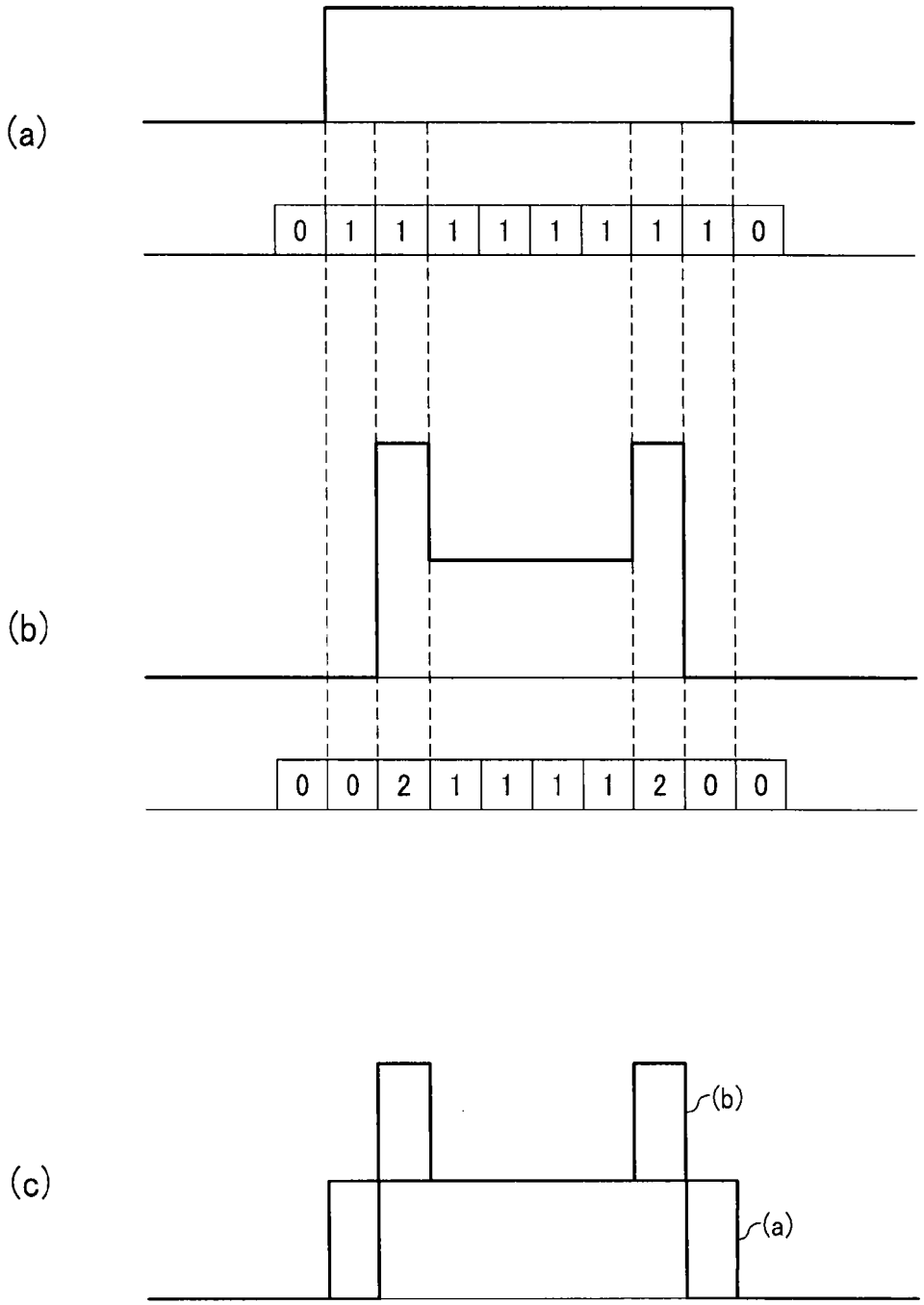
FIGS. 16(*a*), (*b*) and 1(*c*) are schematic diagrams illustrating an exposure pattern 400*a* in FIG. 15A, an exposure pattern 400*b* in FIG. 15B and an overlapped exposure pattern of 400*a* and 400*b* respectively.

In FIG. 16, the horizontal axis denotes the dots in the Y axis direction in FIG. 15, and the vertical axis denotes the light power values of the respective dots. Namely, "0" represents a non-exposure pixel (light power value is 0), "1" represents an exposure pixel, "2" represents a high power exposure pixel having a light power value twice as much as the exposure pixel, and "x" represents a random pixel.

As illustrated in FIG. 16A, in the exposure pattern 400*a* according to the standard exposure, the multiples of the light power values of all the dots in the Y axis direction are one, and the exposure is performed with the uniform light power value.

On the other hand, as illustrated in FIG. 16B, in the exposure pattern 400*b* according to the time concentration exposure, since the pixels (boundary pixels) existing at the boundary between the image portion and the non-image portion become the non-exposure portions, the multiples of the light power values of the non-exposure portions are zero (light power values are zero). In addition, in the exposure pattern 400*b*, since the pixels existing at the boundary between the image portion and the non-exposure portion become the group of high power exposure pixels, the multiples of the light power values of the group of high power exposure pixels are two.

In addition, as illustrated at in FIG. 16C, by comparing the waveform (a) of the light power value according to the standard exposure and the waveform (b) of the light power value according to the TC exposure, both ends portions of the waveform (a) according to the standard exposure become the non-exposure portions in the waveform (b) according to the TC exposure.

Next, the light power values of the non-exposure portion in the waveform (a) according to the standard exposure is added to the light power values of the group of high power exposure pixels correspondent to the both ends portions of the waveform (b) according to the TC exposure. That is, the group of high power exposure pixels corresponds to, so to speak, a process of increasing the light power value of the end portion of the image pattern by folding the light power value inwards.

Figure 17:
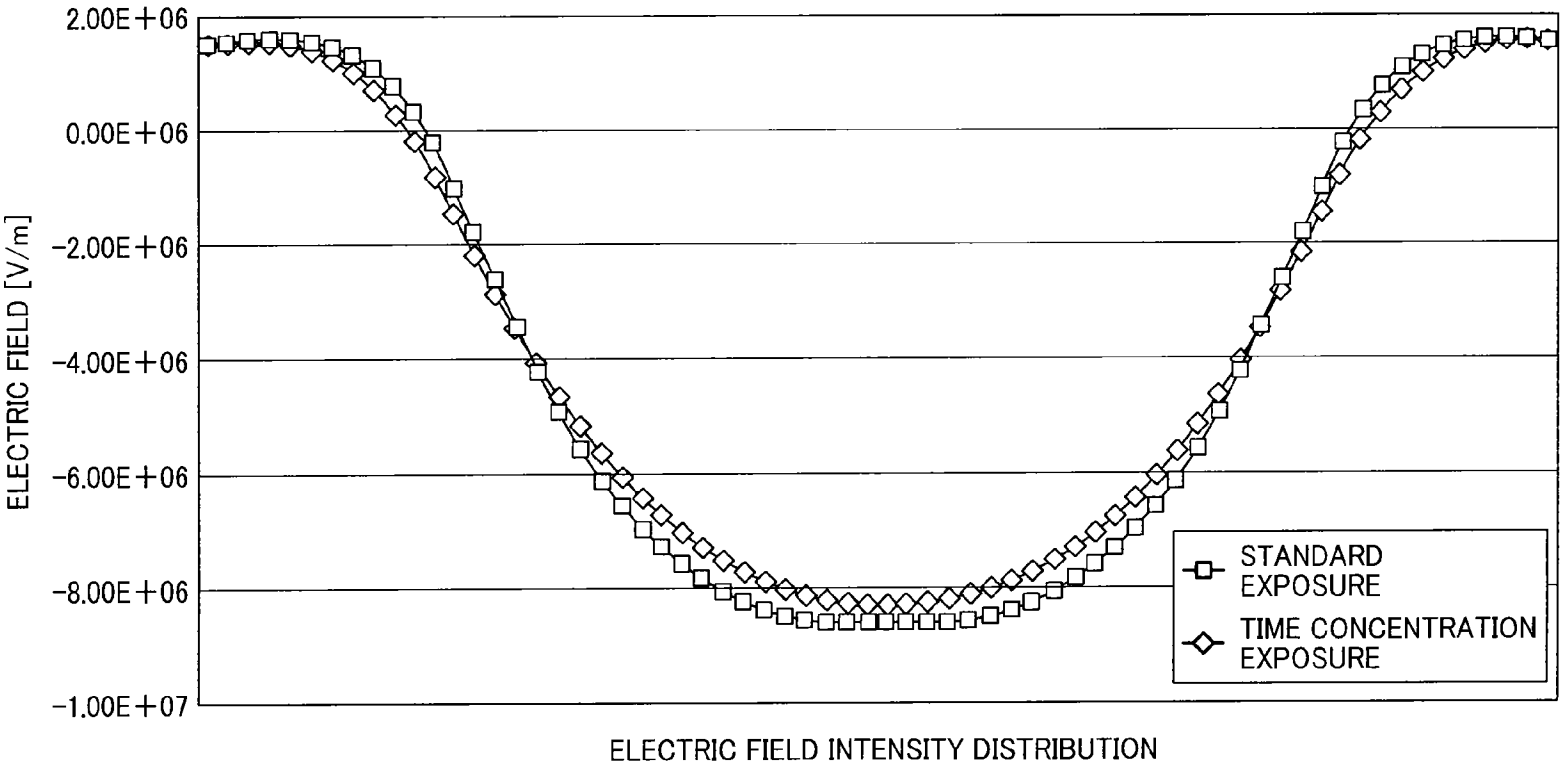
FIG. 17 is a graph illustrating electric field intensity distributions of latent images of the exposure patterns of FIGS. 16(*a*) to 16(*c*)

FIG. 17 illustrates the electric field intensity distribution of latent image of the image portion according to the standard exposure and the electric field intensity distribution of latent image of the image portion according to the TC exposure where replacement of the group of non-exposure pixels and the group of high power exposure pixels for two dots is performed.

By comparing the electric field intensity distribution of latent image according to the standard exposure and the electric field intensity distribution of latent image according to the TC exposure, it is found out that the TC exposure is useful for the image formation because the width of the peak portion of the electric field intensity is small and the slope of change of the electric field intensity is large (edge is steep).

A process of adding only one dot is called 1-dot process mode and a process of adding two dots is called 2-dot process mode. Hereafter, different mode names are used according to the number of dots added. The above is an example of the 2-dot process mode.

Comparison between Image Data and Comparison Pattern

A determination flow of TC exposure pattern is explained. The image forming apparatus 1000 compares plural comparison patterns previously stored in the writing output unit 104 with image data to determine a TC exposure pattern.

Figure 18:
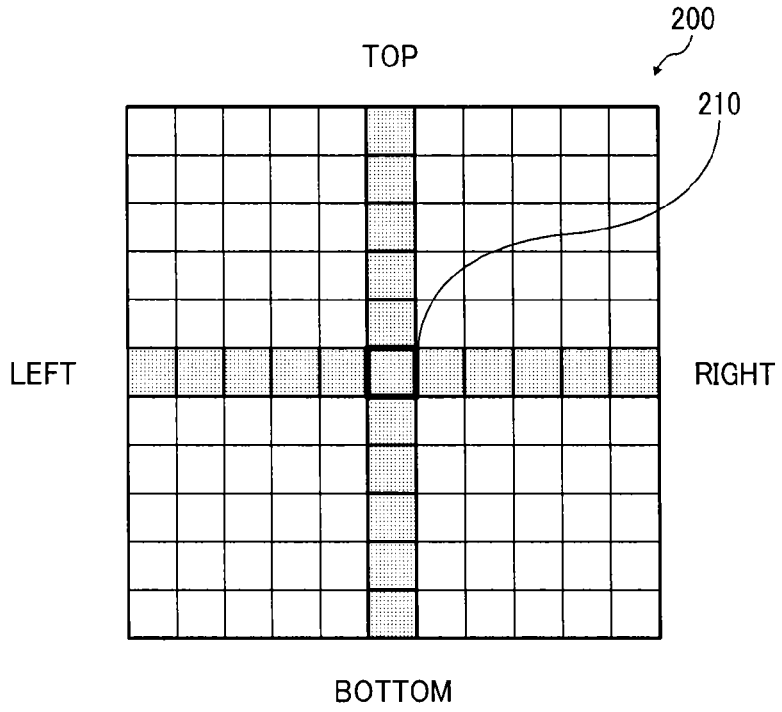
FIG. 18 is a schematic diagram illustrating a comparison pattern used in the image forming apparatus.

As illustrated in FIG. 18, a comparison pattern 200 is an array having a digital value of 0 or 1. The comparison pattern is, e.g., a square including vertical 11 pixels and horizontal 11 pixels. A pixel at the center of the comparison pattern 200 is an attention position 210.

The comparison pattern 200 is compared with image data. Arrays of the comparison pattern 200 and those of the image data are compared to search for the image data identical with the comparison pattern 200. When the image data identical with the comparison pattern 200 is detected, an exposure intensity of a pixel of image data equivalent to the attention position 210, i.e., an attention pixel is determined.

The number of pixels of the comparison pattern 200 is not limited to the above. In FIG. 18, the comparison pattern 200 has a two-dimensional array, but may have a one-dimensional array.

The larger the number of pixels of the comparison pattern 200, the more precisely the exposure intensity can be determined because various patterns are abstracted. However, the larger the number of pixels of the comparison pattern 200, the larger the number of gates and the lower the responsiveness. Therefore, the number of pixels of the comparison pattern 200 should be properly selected.

Figure 19:
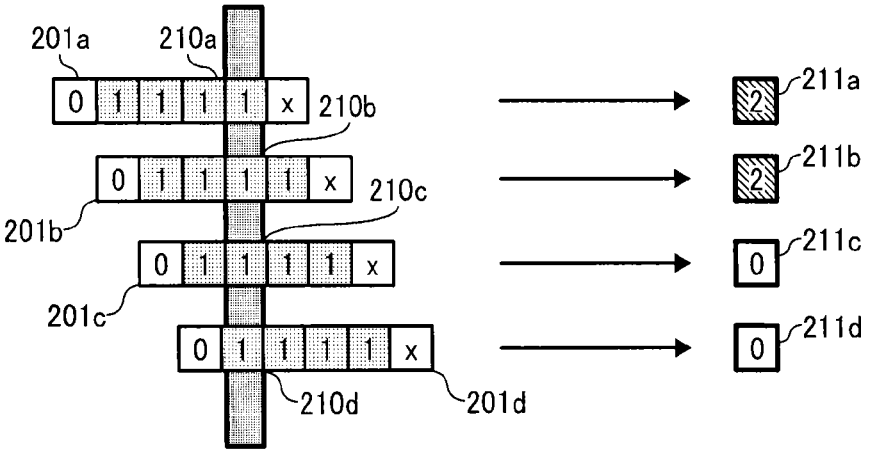
FIG. 19 is a schematic diagram illustrating the image forming apparatus determines an exposure pattern according to the comparison pattern.

FIG. 19 is a schematic diagram illustrating determining a TC exposure pattern with a 2-dot process mode of an attention pixel 211 of image data correspondent to attention positions 210*a* to 210*d* in comparison with compression patterns 201*a* to 201*d*.

The compression patterns 201*a* to 201*d* are one-dimensional arrays of "0111x" from the left, and x is a random value.

The attention position 210*a* of the comparison pattern 201*a* is the fifth pixel from the left. The attention position 210*b* of the comparison pattern 201*b* is the fourth pixel from the left. The attention position 210*c* of the comparison pattern 201*c* is the third pixel from the left. The attention position 210*d* of the comparison pattern 201*d* is the second pixel from the left.

Image data in FIG. 19 have the same arrays as the compression patterns 201*a* to 201*d*.

When the comparison pattern 201*a* is detected, an exposure intensity of an attention pixel 211*a* is determined to be 2. When the comparison pattern 201*b* is detected, an exposure intensity of an attention pixel 211*b* is determined to be 2.

When the comparison pattern 201*c* is detected, an exposure intensity of an attention pixel 211*c* is determined to be 0. When the comparison pattern 201*d* is detected, an exposure intensity of an attention pixel 211*d* is determined to be 0.

The compression patterns 201*a* to 201*d* are compared with image data to determine a TC exposure pattern correspondent to the image data to be "00022x".

This process is called "left folding process" because the left end of image data is a non-exposure pixel and an end of a TC exposure pixel adjacent to the non-exposure portion is a group of high power exposure pixels.

Figure 20A:
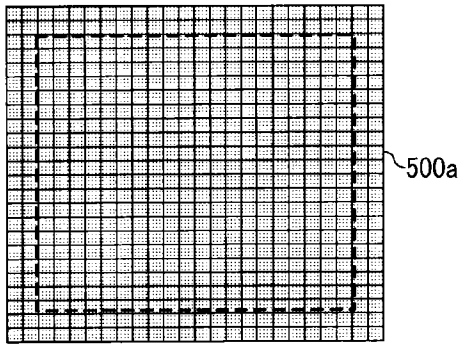
FIGS. 20A to 20E are schematic diagrams illustrating exposure patterns of other image data are determined according to the comparison pattern.

FIG. 20A to 20E are schematic diagrams illustrating the process of determining an exposure pattern is applied to a two-dimensional image. In FIG. 20A, image data 500*a* is exposed with a uniform light power value, and an outer frame of the image portion is a non-image portion.

Figure 20B:
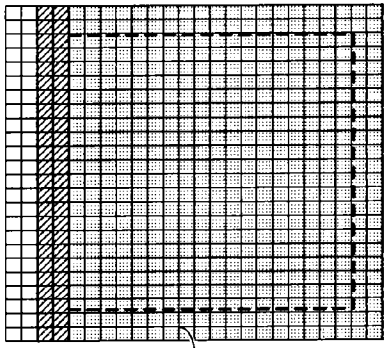
Figure 20C:
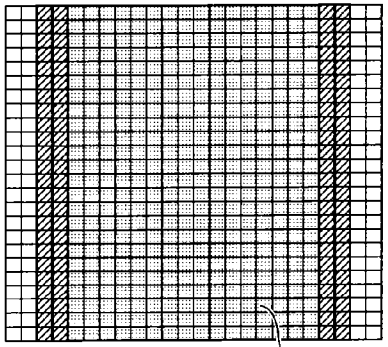

FIG. 20B is an exposure pattern 500*b* after the comparison patterns 201*a* to 201*d* are compared with image data 500*a*. FIG. 20C is an exposure pattern 500*c* after comparison patterns 201*a*' to 201*d*' which are inverted comparison patterns 201*a* to 201*d* to right and left are compared with an exposure pattern 500*b*.

This process is called "right folding process" because the right end of image data is a non-exposure pixel and an end of a TC exposure pixel adjacent to the non-exposure portion is a group of high power exposure pixels.

Figure 20D:
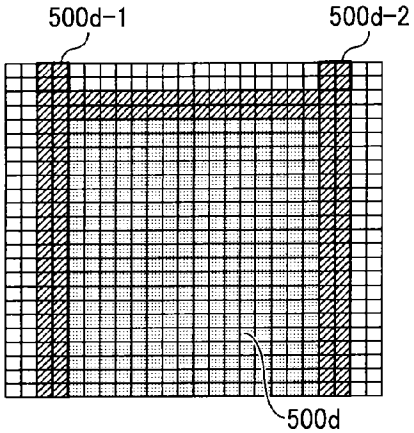

FIG. 20D is an exposure pattern 500*d* after comparison patterns 201*ar* to 204*dr* which are rotated comparison patterns 201*a* to 201*d* by 90° are compared with an exposure pattern 500*c*. The rotated comparison patterns 201*ar* to 204*dr* are, i.e., 01111x from the top.

This process is called "top folding process" because the top end of image data is a non-exposure pixel and an end of a TC exposure pixel adjacent to the non-exposure portion is a group of high power exposure pixels.

When exposure intensities of attention pixels 211*ar* to 211*dr* are maximum light powers, the exposure intensities before the relevant comparison patterns are used as they are. Namely, light power values of pixels in areas 500*d*-1 and 500*d*-2 are 2 before the comparison patterns 201*ar* to 204*dr* are compared.

When the maximum light power is 2, light power values of pixels in areas 500*d*-1 and 500*d*-2 are 2 even after the comparison patterns 201*ar* to 204*dr* are compared.

The exposure pattern 500*d* is different in shape from the original image data and has projections formed by the areas 500*d*-1 and 500*d*-2. However, the end exposure patter is smaller than a beam size. Therefore, images correspondent to the areas 500*d*-1 and 500*d*-2 are not formed.

Figure 20E:
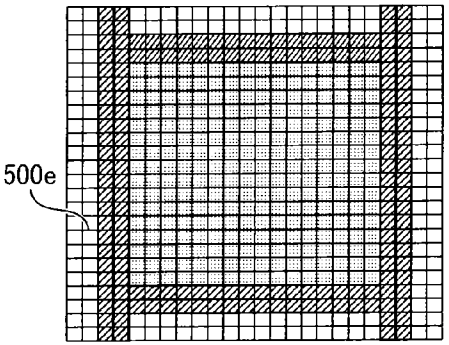

FIG. 20E is an exposure pattern 500*e* after comparison patterns 201*ar*' to 201*dr*' which are inverted comparison patterns 201*ar* to 201*dr* to top and bottom are compared with an exposure pattern 500*d*. When exposure intensities of attention pixels 211*ar*' to 211*dr*' are maximum light powers, the exposure intensities before the relevant comparison patterns are used as they are.

This process is called "bottom folding process" because the bottom end of image data is a non-exposure pixel and an end of a TC exposure pixel adjacent to the non-exposure portion is a group of high power exposure pixels.

Figure 21:
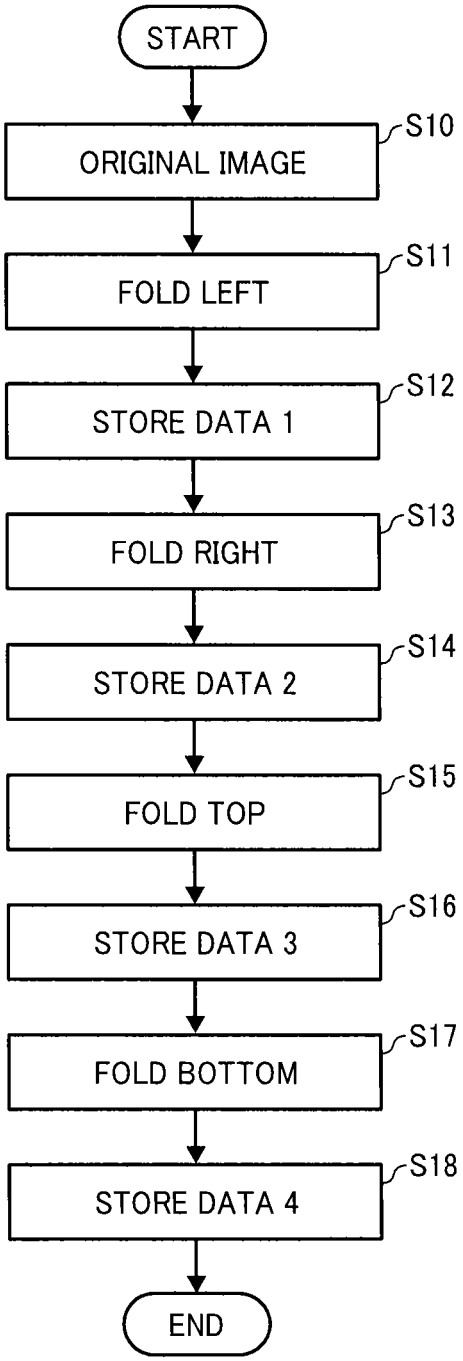
FIG. 21 is a flowchart of an exposure method used in the image forming apparatus.

FIG. 21 is a flowchart explaining the process in FIG. 20. The original image data 500*a* is compared with the comparison patterns 201*a* to 201*d* to do "left folding process" and determine the exposure pattern 500*b* (STEP S11).

The exposure pattern 500*b* determined by the "left folding process" is stored by a process of "data storage 1" STEP S12).

The exposure pattern 500*b* is compared with the comparison patterns 201*a*' to 201*d*' to do "right folding process" and determine the exposure pattern 500*c* (STEP S13).

The exposure pattern 500*c* determined by the "right folding process" is stored by a process of "data storage 2" STEP S14).

The exposure pattern 500*c* is compared with the comparison patterns 201*ar* to 201*dr* to do "top folding process" and determine the exposure pattern 500*d* (STEP S15).

The exposure pattern 500*d* determined by the "top folding process" is stored by a process of "data storage 3" STEP S16).

The exposure pattern 500*d* is compared with the comparison patterns 201*ar*' to 201*dr*' to do "bottom folding process" and determine the exposure pattern 500*e* (STEP S17).

The exposure pattern 500*e* determined by the "bottom folding process" is stored by a process of "data storage 4" STEP S18).

The writing output unit 104 exposes each pixel with an exposure intensity of the exposure pattern 500*e* to form an electrostatic latent image on a latent image bearer.

In FIG. 21, folding processes are made in order of left, right, top and bottom, but may be made in different orders.

Thus, an image having high latent image MTF resolution is formed. The comparison patterns increase process speed because a light power value is determined without simple operations such as addition process and multiplication process on a circuit.

Both Ends Folding Process

Next, "both ends folding process" determining exposure patterns of left and right ends or top and bottom ends at the same time is explained.

Figure 22:
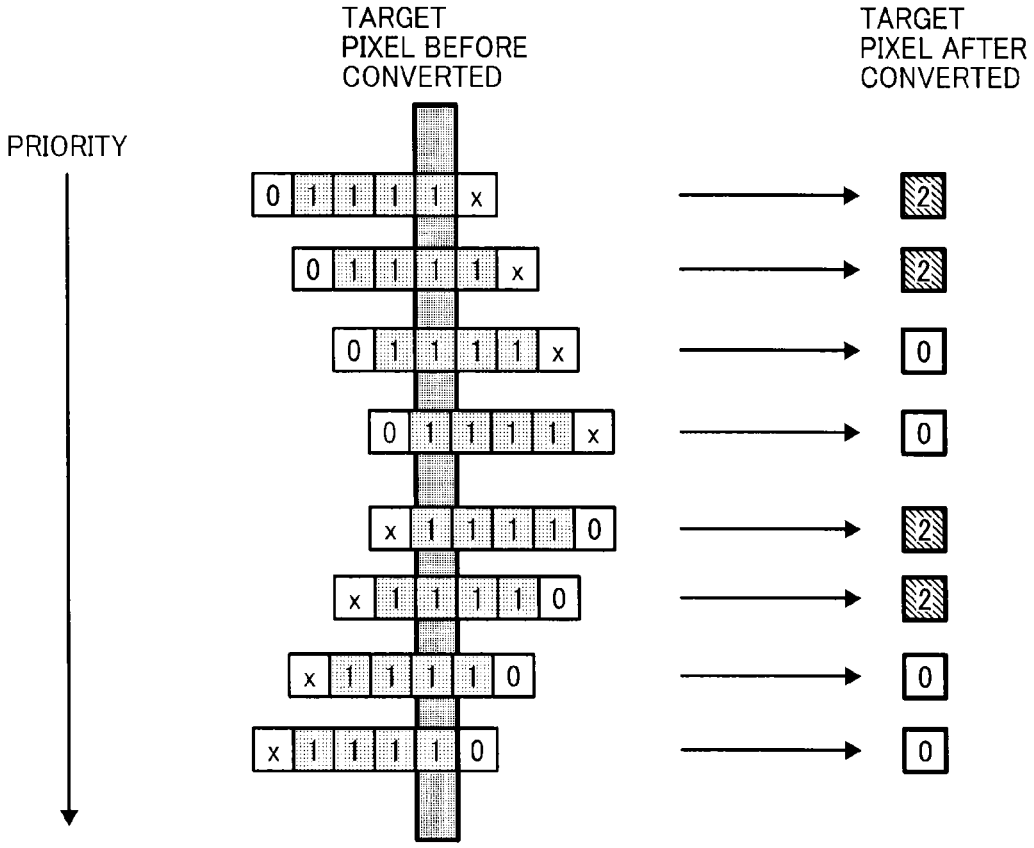
FIG. 22 is a schematic diagram illustrating an embodiment of process of folding both ends according to the comparison pattern in the image forming apparatus.

As illustrated in FIG. 22, image data is compared with 8 comparison patterns 201*a* to 201*d* and 210*a*' to 201*d*' to determine an exposure pattern. Then, a data storing process is made. Namely, in FIG. 21, "data storage 1" and "data storage 2" process are made, but a data storing process is made once in the both ends folding process.

Namely, the number of data storage in the both ends folding process is a half of the flow in FIG. 21.

Figure 23:
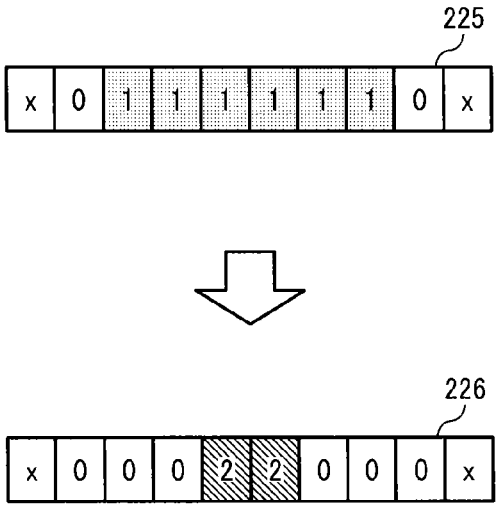
FIG. 23 is a schematic diagram illustrating an exposure pattern when the process of folding both ends is applied to image data of a line pattern having 6 dot width.

FIG. 23 is a schematic diagram illustrating an exposure pattern when the both ends folding process is applied to a line pattern. The both ends folding process is properly made on a line pattern having a width not less than 9 dots.

When applied to a dot-shaped pattern, the top and bottom ends folding process is made in addition to the left and right ends folding process. Either of the top and bottom ends folding process and the left and right ends folding process may be prior to the other.

In FIG. 21, the comparison patterns 201*a*' to 201*d*' in the right folding process are compared with the exposure pattern 500*b* after the left folding process. When the left and right ends folding process is made, the comparison patterns 201*a* to 201*d* and 210*a*' to 201*d*' are all compared with the image data 500*a*. Therefore, the right folding process is made without storing the exposure pattern 500*b* after the left folding process.

In terms of process speed of image forming apparatus, the exposure pattern determination flow is preferably completed in one clock per one pixel. A flow storing and calling data for plural times delays process speed of a circuit or needs a vast memory.

The both ends folding process determines the exposure intensities of the both ends at the same time to decrease the number of storing data in FIGS. 20 and 21.

Exception Process (1)

Next, an exception process made before the both ends folding process is explained.

FIG. 23 is a schematic diagram illustrating an exposure pattern 226 when the process of folding both ends is applied to image data 225 of a line pattern having 6 dot width by the 2 dot process mode.

An integrated value of light power value when image data is subjected to normal exposure is 600%. An integrated value of exposure intensity correspondent to the exposure pattern 226 is 400%. The integrated value of total light power value is lower than that of the normal exposure due to the both ends folding process. Therefore, when the exposure pattern 226 is exposed, the resultant image is blurred with low image density.

A pixel having erroneously become a non-exposure pixel in the both ends folding process is converted into a high power exposure pixel by the exception process. The exception process compares comparison pattern different from those of the both ends folding process with image data to determine a pixel to be converted into a high power exposure pixel.

The exception process is preferably made when image data has a width of the number of exposure pixels less than twice the total of exposure pixels converted to non-exposure pixels and high power exposure pixels in the both ends folding process.

In the both ends folding process by 2 dot process mode, non-exposure pixel is 2 dot and high power exposure pixel is 2 dot, and total of the pixels are 4 dot. Therefore, when the image data has an image portion width less than 8 dot, an exception process is made.

Figure 25A:
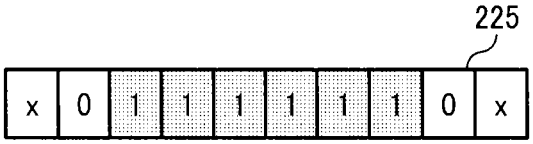
FIGS. 25A to 25C are schematic diagrams illustrating an exception process of the image data of the line pattern having 6 dot width.

FIG. 25A is image data 225 which is a 6 dot line pattern. A comparison pattern used in exception process corresponds to the image data 225. Namely, the comparison pattern used in the exception process is "x01111110x" from the right.

Figure 25B:
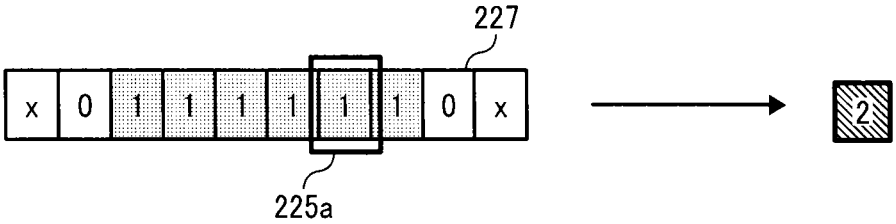

As illustrated in FIG. 25B, the exception process determines a pixel 225*a*, 2 dot from the right, to be "2", i.e., a high power exposure pixel, and a pattern 227 after process.

Figure 25C:
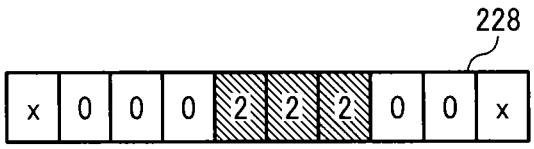

As illustrated in FIG. 25C, the pattern 227 after process is subjected to the both ends folding process. Then, pixels having light power values determined by the exception process are not subjected to the both ends folding process. Therefore, the pixel 225*a* keeps a light power value as "2".

An integrated value of light power value correspondent to an exposure pattern 228 after the both ends folding process is 600%. Namely, the exception process enables it to make the both ends folding process without lowering the integrated value of light power value.

In the above explanations, folding processes in one direction are made, but an exception process determining exposure patterns of the left and right ends or the top and bottom ends at the same time may be made. The exception process determining exposure patterns of the left and right ends at the same time is called "left and right exception process". The exception process determining exposure patterns of the top and bottom ends at the same time is called "top and bottom exception process".

Figure 26:
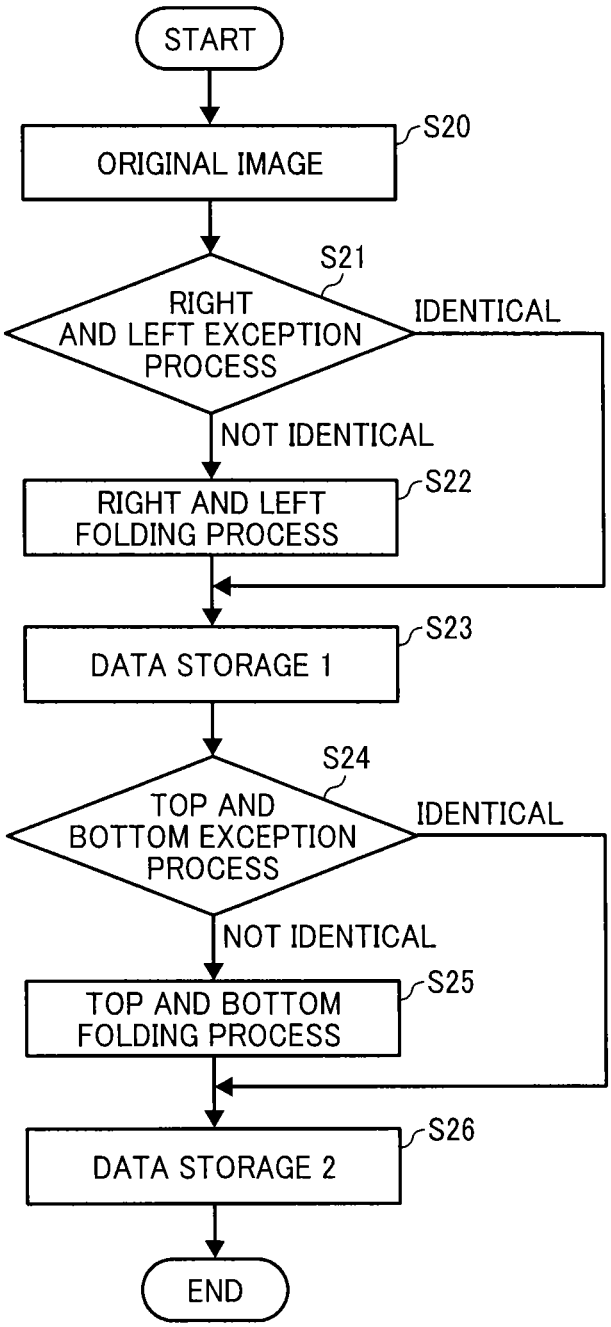
FIG. 26 is a flowchart of the exception process.

As illustrated in FIG. 26, each pixel of an original each image is subjected to left and right exception process first (STEP S21).

A pixel the light power value of which has not been determined by the left and right exception process is subjected to the left and right ends folding process (STEP S22). Then, a data storing process is made (STEP S23).

A pixel the light power value of which has been determined by the left and right exception process is not subjected to the left and right ends folding process, and a data storing process is made (STEP S23).

Next, the exposure pattern stored at STEP S23 is subjected to the top and bottom exception process (STEP S24).

A pixel the light power value of which has not been determined by the top and bottom exception process is subjected to the top and bottom ends folding process (STEP S25). Then, a data storing process is made (STEP S26).

A pixel the light power value of which has been determined by the top and bottom exception process is not subjected to the top and bottom ends folding process, and a data storing process is made (STEP S23).

The exception process forms high-quality images even when having narrow width.

Exception Process (2)

Another embodiment of the exception process is explained. This is different from the above embodiment in that the left and right folding process and exception process use one-dimensional array comparison patterns, and that the top and bottom folding process and exception process use two-dimensional array comparison patterns.

The exception process using the two-dimensional array comparison patterns is effectively used in an exposure pattern determination flow doing data storing process just once in particular.

Figure 27:
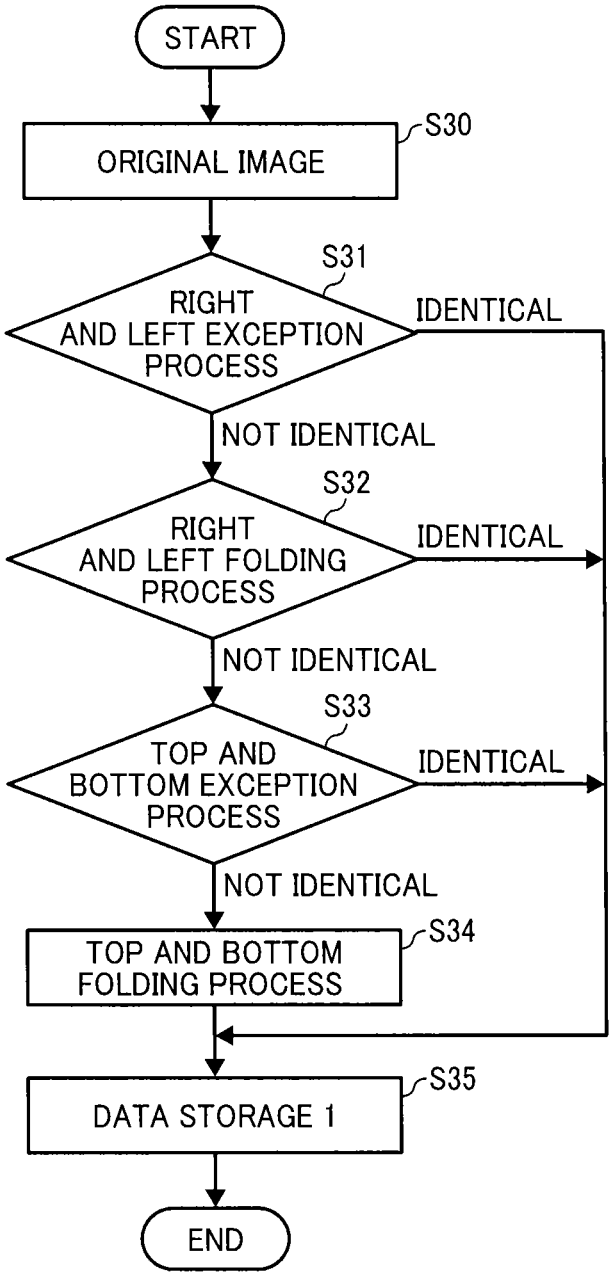
FIG. 27 is a flowchart of determining an exposure pattern, storing data only once.

FIG. 27 illustrates an exposure pattern determination flow 27 doing data storing process just once.

First, each pixel of an original image is subjected to left and right exception process (STEP S31).

A pixel the light power value of which has not been determined by the left and right exception process is subjected to the left and right ends folding process (STEP S32).

A pixel the light power value of which has not been determined by the left and right folding process is subjected to the top and bottom exception process (STEP S33).

A pixel the light power value of which has not been determined by the top and bottom exception process is subjected to the top and bottom ends folding process (STEP S34). Then, a data storing process is made (STEP S35).

A pixel the light power value of which has been determined by the left and right exception process, the left and right ends folding process or the top and bottom exception process is not subjected to the following process, and a data storing process is made (STEP S35).

An exposure pattern obtained when the determination flow 27 is executed using one-dimensional array comparison patterns for all the processes is explained.

As illustrated in FIG. 28, image portions having the complicated shape of a corner and T are explained.

Figure 29A:
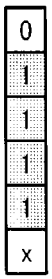
FIG. 29A is a one-dimensional array comparison pattern.

A one-dimensional comparison pattern as illustrated in FIG. 29A is used for the top and bottom ends folding process.

Figures 28A, 28B:
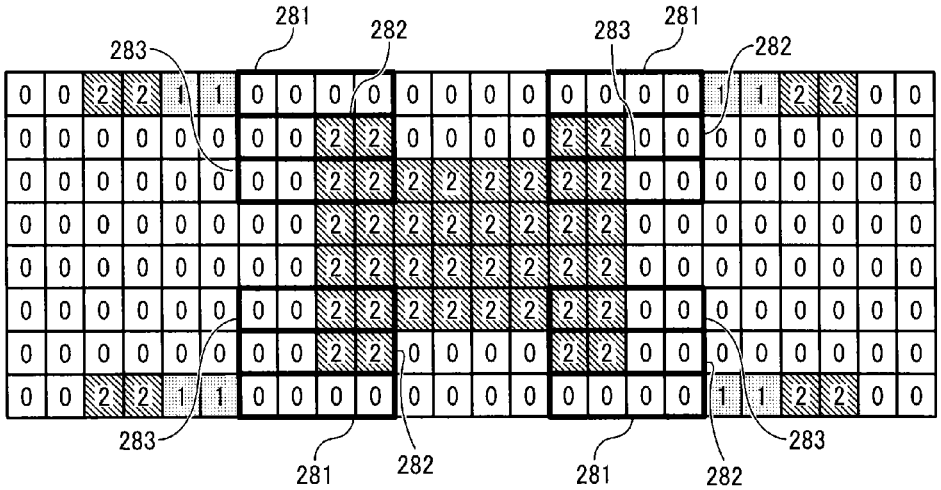
FIG. 28A is an example of image data and FIG. 28B is a schematic diagram illustrating an exposure pattern of the image data is determined on the basis of the flowchart.

FIG. 28B illustrates an exposure pattern after the FIG. 28A is subjected to the both ends folding process using one-dimensional comparison patterns. A pixel group 281 surrounded by a bold frame is a non-exposure pixel. Therefore, an integrated value of light power value of all the exposure patterns is lower than that of a normal exposure by 13%.

This is because the comparison pattern is compared with image data in the left and right ends folding process and the top and bottom ends folding process.

The pixel group 281 is not identical with the comparison pattern in the left and right ends folding process. Therefore, the light power value after the left and right ends folding process is 1. Then, the pixel group 281 is determined to be a non-exposure pixel in the top and bottom ends folding process.

When an exposure pixel is converted into a non-exposure pixel, an exposure pixel adjacent to a pixel group to be converted is converted into a high power exposure pixel such that an integrated value of the exposure intensity is fixed before and after the process.

When the top and bottom ends folding process is made, pixel groups 281 and 282 are non-exposure pixels, a pixel group 283 is converted into a high power exposure pixel. However, in this embodiment, the left and right ends folding process is made before the top and bottom ends folding process, and the pixel groups 282 and 283 have identical comparison patterns due to the left and right ends folding process and determined light power values.

Therefore, even when the pixel group 281 is a non-exposure pixel, a pixel adjacent to a pixel group to be converted is not converted into a high power exposure pixel. Namely, the pixel group 281 need not be converted into a non-exposure pixel.

In this case, two-dimensional array comparison patterns are used in the top and bottom ends folding process such that a pixel group is not a non-exposure pixel when a pixel adjacent thereto is not converted into a high power exposure pixel.

Specifically, the tow-dimensional array comparison pattern preferably has a "1" array at left and right of a pixel adjacent to an attention pixel just for the number of pixels in a process direction among pixels the light power of which are determined by the top and bottom ends folding process.

In other words, the two-dimensional array comparison pattern is symmetric, and an attention pixel is placed on an axis of symmetry thereof. The number of pixels on one side of the two-dimensional array is not less than twice the sum of number of continuous pixels in one line, determined by non-exposure pixels and high power exposure pixels.

Figure 29B:
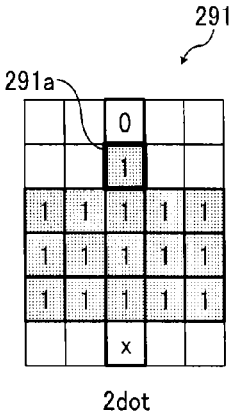
FIG. 29B is a two-dimensional array comparison pattern.

FIG. 29B illustrates a comparison pattern 291 used in the top and bottom ends folding process when one pixel is a non-exposure pixel and one pixel adjacent thereto is a high power exposure pixel. Therefore, two lines of "1" array are located at both left and right of a pixel adjacent to an attention pixel 291*a*.

Figure 29C:
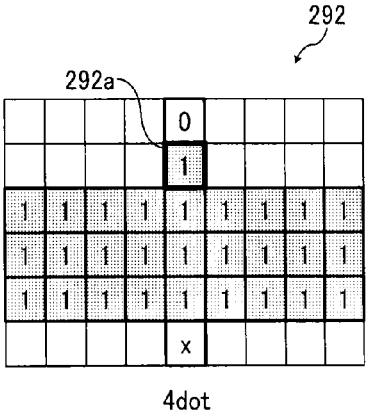
FIG. 29C is another embodiment of the two-dimensional array comparison pattern.

FIG. 29C illustrates a comparison pattern 292 used when two pixels are non-exposure pixels and two pixel adjacent thereto are high power exposure pixels. Therefore, four lines of "1" array are located at both left and right of a pixel adjacent to an attention pixel 292*a*.

Figure 29D:
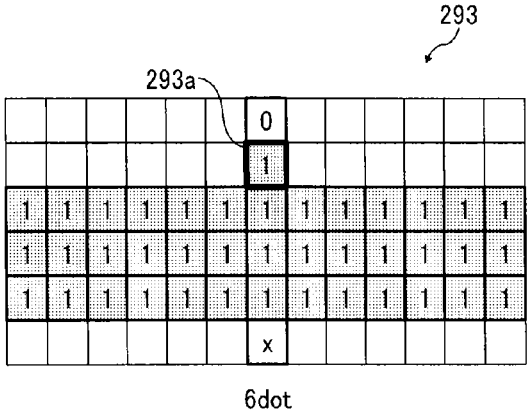
FIG. 29D is a further embodiment of the two-dimensional array comparison pattern.

FIG. 29D illustrates a comparison pattern 293 used when three pixels are non-exposure pixels and three pixel adjacent thereto are high power exposure pixels. Therefore, six lines of "1" array are located at both left and right of a pixel adjacent to an attention pixel 293*a*.

Figure 30:
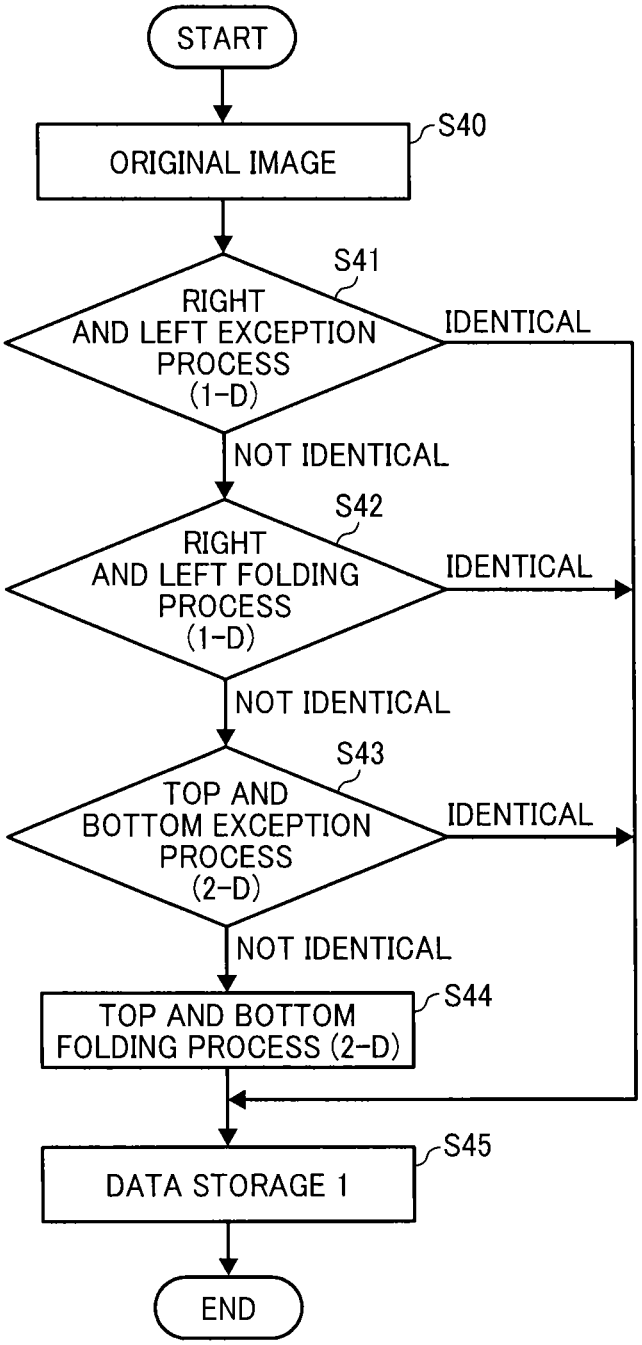
FIG. 30 is a flowchart of determining an exposure pattern using the one-dimensional array comparison pattern and the two-dimensional array comparison pattern.

As illustrated in FIG. 30, a determination flow 30 uses a one-dimensional array comparison pattern in the left and right exception process and the left and right ends folding process, and a two-dimensional array comparison pattern in the top and bottom exception process and the top and bottom ends folding process.

First, each pixel of an original image is subjected to left and right exception process (STEP S41).

A pixel the light power value of which has not been determined by the left and right exception process is subjected to the left and right ends folding process (STEP S42).

Next, a pixel the light power value of which has not been determined by the left and right folding process is subjected to the top and bottom exception process (STEP S43).

A pixel the light power value of which has not been determined by the top and bottom exception process is subjected to the top and bottom ends folding process (STEP S44). Then, a data storing process is made (STEP S45).

A pixel the light power value of which has been determined by the left and right exception process, the left and right ends folding process or the top and bottom exception process is not subjected to the following process, and a data storing process is made (STEP S45).

FIG. 31 illustrates an exposure pattern after the determination flow 27 including subjecting FIG. 28A to the top and bottom ends folding process using the comparison pattern 291. A light power value of a pixel group 281' is determined to be 1.

Thus, the left and right ends folding process using a one-dimensional array comparison pattern and the top and bottom ends folding process using a one-dimensional array comparison pattern correctly determine an exposure pattern. Total light quantity added by high exposure can be equalized to total light quantity reduced by exposure thereby Exposure Method (2)

Another embodiment of the exposure method in the image forming method according to the present invention will be described, focusing differences with the above-mentioned embodiment.

In this embodiment of the exposure method, the number of non-exposure pixels or high power exposure pixels may separately be used according to the performance, the image area in the image pattern, the forms of the image pattern such as black letters, hollow letters, lines and figures.

FIGS. 32A to 32D are schematic diagrams illustrating examples of light power value addition processes for exposure patterns. As illustrated in the figure, in the exposure method according to the embodiment, one to four dots of the exposure patterns of the images formed with 4800 dpi are set to the non-exposure portions, and the light power values are added to other pixels.

Figure 32A:
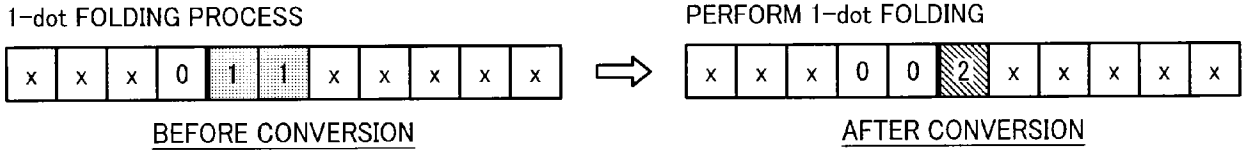
FIGS. 32A to 32D are schematic diagrams for explaining 1 dot, 2 dot, 3 dot and 4 dot folding processes respectively.
Figure 32B:
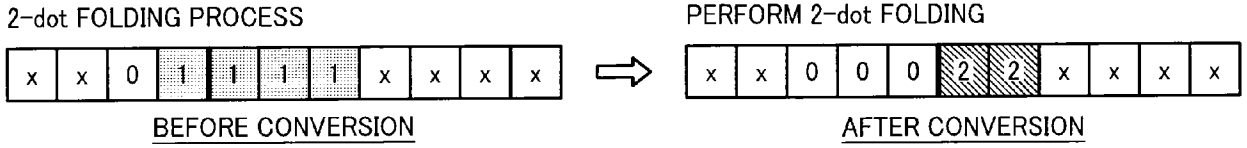
Figure 32C:
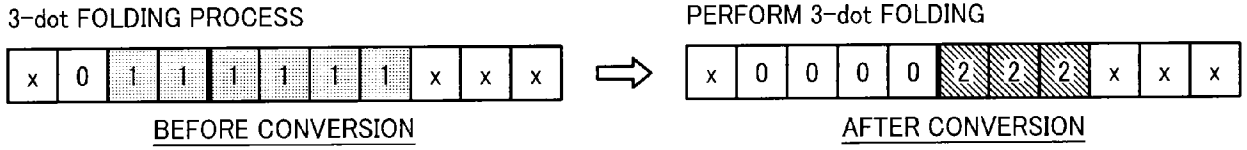
Figure 32D:
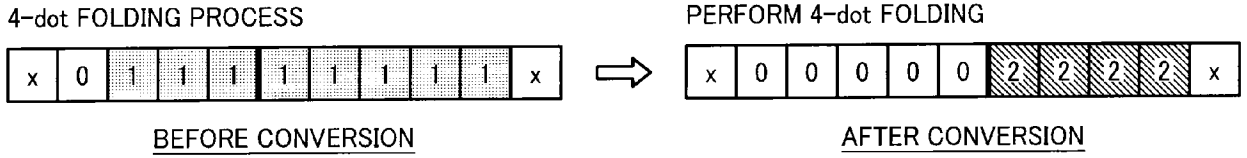

FIG. 32A illustrates an example of the addition of a 1-dot process mode. In addition, FIG. 32B illustrates an example of the addition of a 2-dot process mode. In addition, FIG. 32C illustrates an example of the addition of a 3-dot process mode. In addition, FIG. 32D illustrates an example of the addition of a 4-dot process mode.

As illustrated in FIGS. 32A to 32D, in the exposure method according to the embodiment, with respect to an arbitrary number of the exposure pixels which are arrayed symmetrically, pattern matching is performed to determine whether or not the exposure pixels exist at the corresponding positions when the folding is performed about a virtual symmetric axis. In this manner, the light power value is added to the pixel of the counter side about the symmetric axis, so that the numeric value of the exposure pixel of the counter side becomes "2".

Figure 33A:
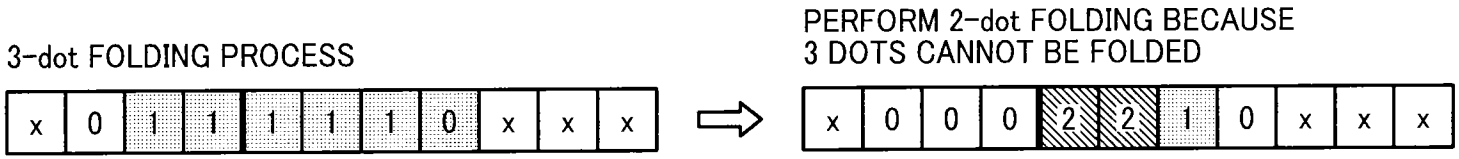
FIG. 33A is a schematic diagram illustrating 2 dot folding process on image data of a line pattern having 5 dot width.
Figure 33B:
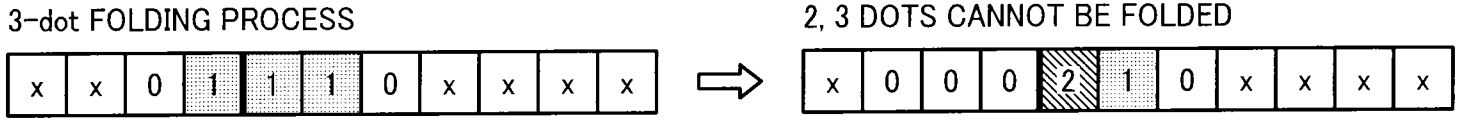
FIG. 33B is a schematic diagram illustrating 1 dot folding process on image data of a line pattern having 3 dot width.

FIGS. 33A and 33B are schematic diagrams illustrating other examples of the addition processes.

FIG. 33A illustrates an example of the addition of a 3-dot process mode. In addition, FIG. 33B illustrates another example of the addition of the 3-dot process mode.

As illustrated in FIGS. 33A and 33B, in the exposure method according to the embodiment, unlike the above-described addition process of exposure pixels which are symmetrically arrayed, even in the case where the exposure pixels do not exist at the corresponding positions when the folding is performed about a virtual symmetric axis, the addition process can be performed.

That is, in the exposure method according to the embodiment, when the addition process is to be performed, in the case where the exposure pixels of the adding side are already the pixels after the addition of the light power value, the addition process may be performed only on the exposure pixels on which the addition can be performed.

More specifically, as illustrated in FIGS. 33A and 33B, in the case where folding cannot be performed in the 3-dot process mode, a process of adding only two dots or a process of adding only one dot can be performed.

As described heretofore, according to the exposure method according to the embodiment, the pixels which are added with the light power values can be appropriately processed so as not to be added again.

As for the folding processes when the number of pixels is less than a designated process mode, pixels having the larger numbers may be processed in order. A light source driver 410 includes a selector 34 selecting a process mode.

Figure 34:
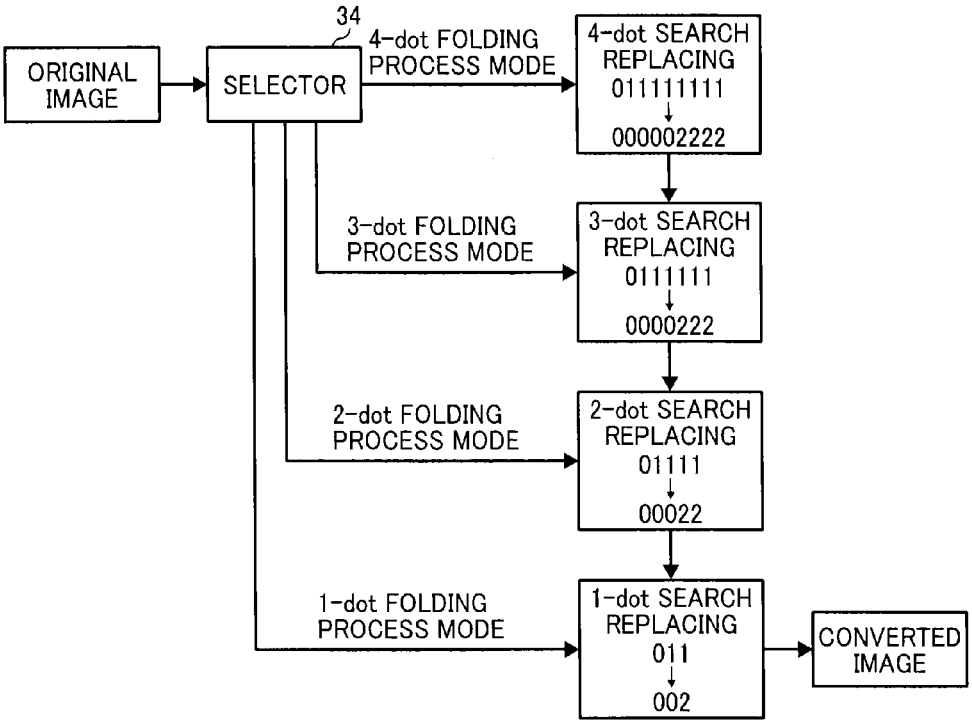
FIG. 34 is a block diagram illustrating 1 to 4 dot folding processes.

As illustrated in FIG. 34, when a 4-dot process mode is set, the selector 34 selects a 4-dot process mode first. The light source driver 410 compares with a comparison pattern for the 4-dot process mode. When identical with the comparison pattern, a folding process of the 4-dot process mode is made.

Next, the selector 34 selects the 3-dot process mode. The light source driver 410 compares with a comparison pattern for the 3-dot process mode. When identical with the comparison pattern, a folding process of the 3-dot process mode is made. This is the same for a 2-dot process mode and a 1-dot process mode.

Thus, the folding processes when the number of pixels is less than a designated process mode is made in order can form high-quality images even for a portion where an image portion has too few pixels to do the designated folding process.

In the image forming method of the present invention, at least 2 image qualities, i.e., a first image quality (normal image quality mode) and a second image quality may be selected. The first image quality is formed by standard exposure.

The second image quality is formed by an exposure at a light power value higher than the first light power value on at least a group of pixels existing at a boundary with respect to the non-exposure portion among the pixels constituting the image portion.

Example of Formation of Character Image

Next, an example of application of the exposure method according to the embodiment to a micro-sized (three-point) character image will be described.

Figure 35A:
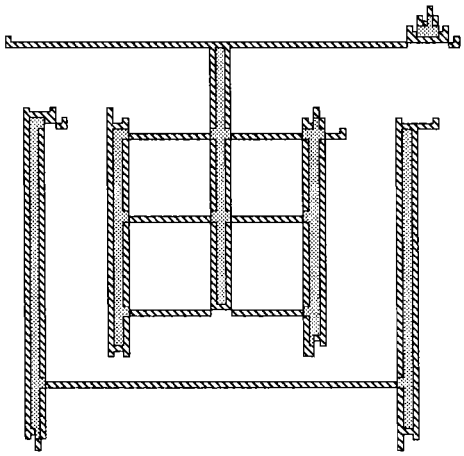
FIGS. 35A and 35B are schematic diagrams illustrating exposure patterns of character images according to the exposure method of the embodiment.
Figure 35B:
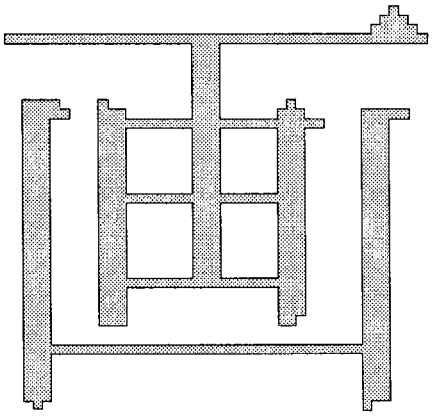

FIGS. 35A and 35B are schematic diagrams illustrating exposure patterns of character images according to the exposure method of the embodiment. FIG. 35A illustrates an exposure pattern of a Chinese character "画" which is determined by the 2-dot process mode. FIG. 35B illustrates an exposure pattern which is exposed according to the standard exposure.

Figure 36A:
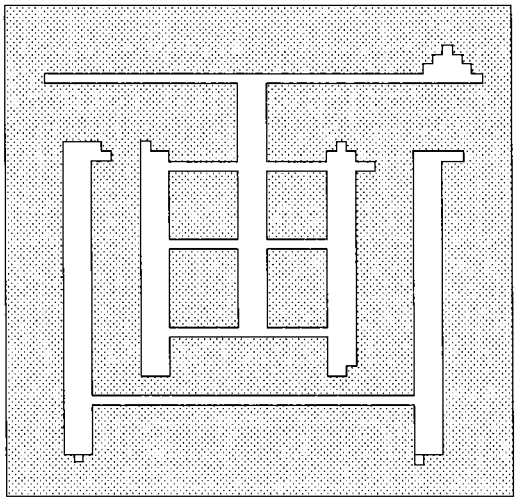
FIGS. 36A and 36B are schematic diagrams illustrating exposure patterns of outline character images according to the exposure method of the embodiment.
Figure 36B:
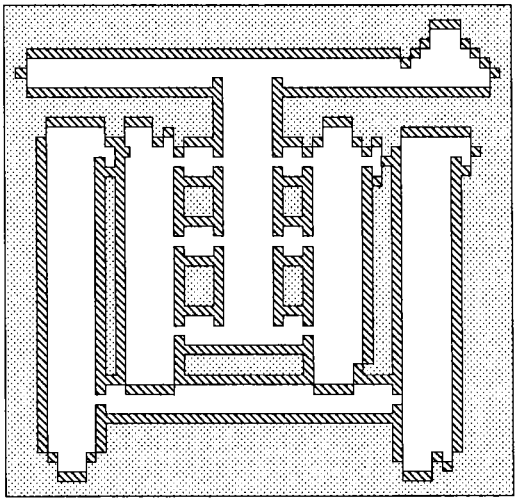

FIGS. 36A and 36B are schematic diagrams illustrating exposure patterns of outline character images according to the exposure method of the embodiment. FIG. 36A illustrates an outline exposure pattern of a Chinese character "画" which is exposed according to the standard exposure. In addition, FIG. 36B illustrates an exposure pattern determined by the 4-dot process mode.

As illustrated in FIGS. 32A, 32B, 33A and 33B, the exposure method according to the embodiment can be applied to color reversed characters (outline characters) as well as normal colored characters.

That is, according to the exposure method according to the embodiment, when the image data are converted into the light source modulation data, even in the case where object information cannot be obtained from the information processing device, the exposure patterns of various images such as a character image, an reversed character image, a dither, and a line image can be generated.

In addition, in the exposure method according to the embodiment, the effect can be enhanced by selecting the folding process modes for the exposure pattern according to the characteristics of the image pattern.

In general, since the periphery of the void and reversed characters illustrated in FIGS. 36A and 36B is influenced by the exposure, the electric field intensity of the white background is reduced, so that the white background can be easily buried in the colored portion. For this reason, in the exposure method according to the embodiment, it is preferable that the light power value according to the time concentration exposure be increased by setting the number of pixels of the group of high power exposure pixels and the non-exposure portion to be large.

In addition, in the exposure method according to the embodiment, in the dither portion such as halftone, in the case where textures or artifacts occur due to influence with other processes, the number of pixels in the group of high power exposure pixels and the non-exposure portion may be reduced. When the number of pixels which are to be added is one dot, there is almost no disadvantage according to the exposure method according to the embodiment, and the effect of reduction in weak electric field can be obtained.

For this reason, in the exposure method according to the embodiment, in the case where a black character, a white character, or dither can be identified by using tag information identifying a type (character or line) of an object on which the addition process for the group of high power exposure pixels is to be performed, the number of pixels in the group of high power exposure pixels and the non-exposure portion can be appropriately arranged.

As a specific example, in the case of a normal character or line image, pixels existing at the boundary between the image portion and the non-image portion are attached with a tag in advance. On the other hand, in the case of a reversed character or reversed line image, pixels existing at the boundary between the image portion and the non-image portion are attached with a tag, and with respect to dither or others are treated in the same manner as the case where dither is not applied.

Therefore, in each image attached with the tag, a black character or a black line is set to the 3-dot folding process mode, an outline character or an outline line is set to the 4-dot folding process mode, and a dither is set to the 2-dot folding process mode in advance, for example.

First, the light source modulation data generating circuit 407 described in FIG. 9 detects the boundary pixel between the image portion and the non-image portion of the exposure pattern and determines from a tag bit of the boundary pixel (information specifying an attribute of an image pattern) of the boundary pixel whether the tag is zero or one.

Here, in the case where the tag bit is one, the light source modulation data generating circuit 407 determines that the image is a black character or a black line and performs the 3-dot folding process mode.

Next, in the case where the tag bit is zero, light source modulation data generating circuit 407 determines that the image is a white character or a white line and performs the 4-dot folding process mode.

In the case where the tag bit is neither zero nor one, the light source modulation data generating circuit 407 determines that the image is a dither portion and performs the 2-dot folding process mode.

In this manner, in the exposure method according to the embodiment, based on the information such as an image pattern of a received image or a tag bit of the image supplied from the controller, it is recognized whether the image is a normal character, a reversed character, or a dither portion and the optimal number of folded pixels according to each image is set.

That is, according to the exposure method according to the embodiment, since the light power value of the TC exposure can be made stronger or weaker, it is possible to provide an optimal image capable of showing the best performance of the image forming apparatus.

Configuration of Electrostatic Latent Image Measurement Device

Next, a configuration of the electrostatic latent image measurement device capable of checking an electrostatic latent image state formed by the exposure method according to the embodiment will be described.

Figure 37:
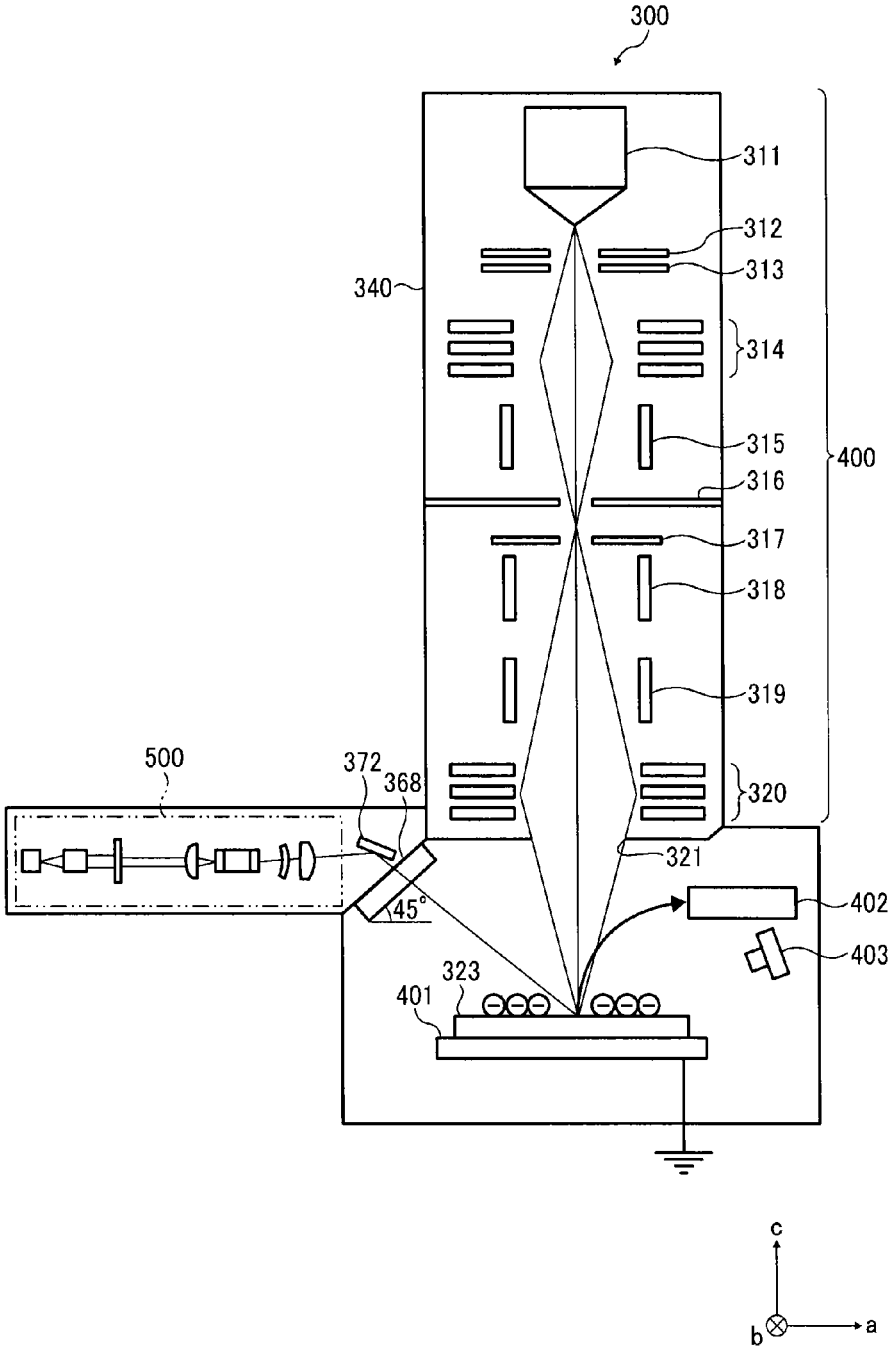
FIG. 37 is a central cross-sectional diagram illustrating an example of an electrostatic latent image measurer.

An electrostatic latent image measurement device 300 in FIG. 37 includes a charged particle irradiation system 400, an optical scanner 1010, a sample stage 401, a detector 402, an LED 403, a control system (not illustrated), an ejection system (not illustrated), and a driving power source (not illustrated).

The charged particle irradiation system 400 is disposed inside a vacuum chamber 340. Here, the charged particle irradiation system 400 includes an electron gun 311, an extraction electrode 312, an acceleration electrode 313, a condenser lens 314, a beam blanker 315, and a partition plate 316. In addition, the charged particle irradiation system 400 includes a movable aperture stop 317, a stigmator 318, a scanning lens 319, and an objective lens 320.

In addition, in the description hereinafter, the optical axis direction of each lens is described as a c-axis direction, and two directions perpendicular to each other in the plane perpendicular to the c-axis direction are described as an a-axis direction and a b-axis direction.

The electron gun 311 generates an electron beam as a charged particle beam.

The extraction electrode 312 is disposed in the −c direction from the electron gun 311 to control the electron beam generated by the electron gun 311. The acceleration electrode 313 is disposed in the −c direction from the extraction electrode 312 to control energy of the electron beam.

The condenser lens 314 is disposed in the −c direction from the acceleration electrode 313 to converge the electron beam.

The beam blanker 315 is disposed in the −c direction from the condenser lens 314 to turn on/off the electron beam irradiation.

The partition plate 316 is disposed in the −c direction from the beam blanker 315 and has an opening at the center thereof.

The movable aperture stop 317 is disposed in the −c direction from the partition plate 316 to adjust a beam diameter of the electron beam that has passed through the opening of the partition plate 316.

The stigmator 318 is disposed in the −c direction from the movable aperture stop 317 to correct astigmatism.

The scanning lens 319 is disposed in the −c direction from the stigmator 318 to deflect the electron beam that has passed through the stigmator 318, in an ab plane.

The objective lens 320 is disposed in the −c direction from the scanning lens 319 to converge the electron beam that has passed through the scanning lens 319. The electron beam that has passed through the objective lens 320 passes through a beam emitting opening portion 321 and irradiates the surface of a sample 323.

Each lens or the like is connected to the driving power source (not illustrated).

In addition, the charged particles denote particles influenced by an electric field or a magnetic field. Here, as the beam of irradiating the charged particles, for example, ion beams may be used instead of the electron beam. In this case, a liquid metal ion gun or the like is used instead of the electron gun.

The sample 323 is a photoreceptor and includes a conductive supporting body, a charge generation layer (CGL) and a charge transport layer (CTL).

The charge generation layer includes a charge generation material (CGM) and is formed in a surface of the +c side of the conductive supporting body. The charge transport layer is formed in the surface of the +c side of the charge generation layer.

When the sample 323 is exposed in the state where the surface (surface in the +c side) is charged, light is absorbed by the charge generation material of the charge generation layer, so that charge carriers having two polarities of positive and negative polarities are generated. Due to the electric field, some of the carriers are injected to the charge transport layer, and others thereof are injected to the conductive supporting body.

Due to the electric field, the carriers injected to the charge transport layer are moved to the surface of the charge transport layer and are coupled with the charges of the surface to disappear. Accordingly, on the surface (surface in the +c side) of the sample 323, a charge distribution, that is, an electrostatic latent image is formed.

The optical scanner 1010 includes a light source, a coupling lens, an opening plate, a cylindrical lens, a polygon mirror, and a scanning optical system 393. In addition, the optical scanner 1010 also includes a scanning mechanism (not illustrated) for scanning the light with respect to the direction parallel to the rotation axis of the polygon mirror.

The scanning optical system includes a light source, a scanning lens and an optical deflector. The optical deflector is, e.g., a polygon scanner 390.

The polygon scanner 390 is located on a horizontal parallel mobile carriage 392 with an optical housing 381.

Light emitted from the optical scanner 1010 irradiates the surface of the sample 323 through a reflection mirror 372, an outer light shielding tube 385, a labyrinth 386, a light shielding member 387, an inner light shielding tube 388 and a glass window 368.

On the surface of the sample 323, the irradiation position of the light emitted from the optical scanner 1010 is varied in the two directions perpendicular to each other on the plane perpendicular to the c-axis direction due to deflection in the polygon mirror and deflection in the scanning mechanism.

At this time, the varying direction of the irradiation position due to the deflection in the polygon mirror is the main-scanning direction, and the varying direction of the irradiation position due to the deflection in the scanning mechanism is the sub-scanning direction.

Here, the a-axis direction is set as the main-scanning direction, and the b-axis direction is set as the sub-scanning direction.

In this manner, the electrostatic latent image measurement device 300 can two-dimensionally scan the surface of the sample 323 with the light emitted from the optical scanner 1010. That is, the electrostatic latent image measurement device 300 can form a two-dimensional electrostatic latent image on the surface of the sample 323.

As illustrated in FIG. 38, the optical scanner 1010 includes an entrance window through which a light flux capable of entering the vacuum chamber 340 from outside at an angle of 45° relative to a vertical axis of the vacuum chamber. Namely, the scanning optical system 393 is located outside of the vacuum chamber 340.

Thus, vibration or electromagnetic waves generated by a driving motor of the polygon mirror does not influence a trajectory of the electron beam. Therefore, the influence of disturbance on the measurement result can be suppressed.

The detector 402 is disposed in the vicinity of the sample 323 to detect secondary electrons of the sample 323.

The LED 403 is disposed in the vicinity of the sample 323 to emit light for illumination of the sample 323. The LED 403 is used to erase the charges remaining on the surface of the sample 323 after the measurement.

In addition, the optical housing 381 retaining the scanning optical system 393 may cover the entire scanning optical system 393 with a cover 391 so as to block external light (harmful light) incident into the vacuum chamber.

In the scanning optical system 393, the scanning lens has fθ characteristics, and when an optical polarizer is rotated at a certain speed, the light beam is designed to be moved at a substantially constant speed with respect to an image plane. In addition, in the scanning optical system, the beam spot diameter is also designed to be substantially constant during the scanning.

In the electrostatic latent image measurement device 300, since the scanning optical system is disposed to be separated from the vacuum chamber, there is small influence of direct propagation of the vibration generated from the driving of an optical deflector such as a polygon type scanner to the vacuum chamber 340.

A vibration-proof means such as dampers may be located between a vibration removal board 382 and a structural body 383 retaining the scanning optical system 393. The vibration-proof means can further reduce vibration transmitted to the vacuum chamber 340.

In the electrostatic latent image measurement device 300, by installing the scanning optical system 393, any arbitrary latent image pattern including a line pattern can be formed in a generating line direction of the photoreceptor.

In addition, in order to form a latent image pattern at a predetermined position, the synchronization detection sensor 26 for sensing a scanning beam of an optical deflecting unit may be installed.

In addition, the shape of the sample 323 may be a planar surface or a curved surface.

Electrostatic Latent Image Measurement Method

Next, an electrostatic latent image measurement method will be described.

Figure 39:
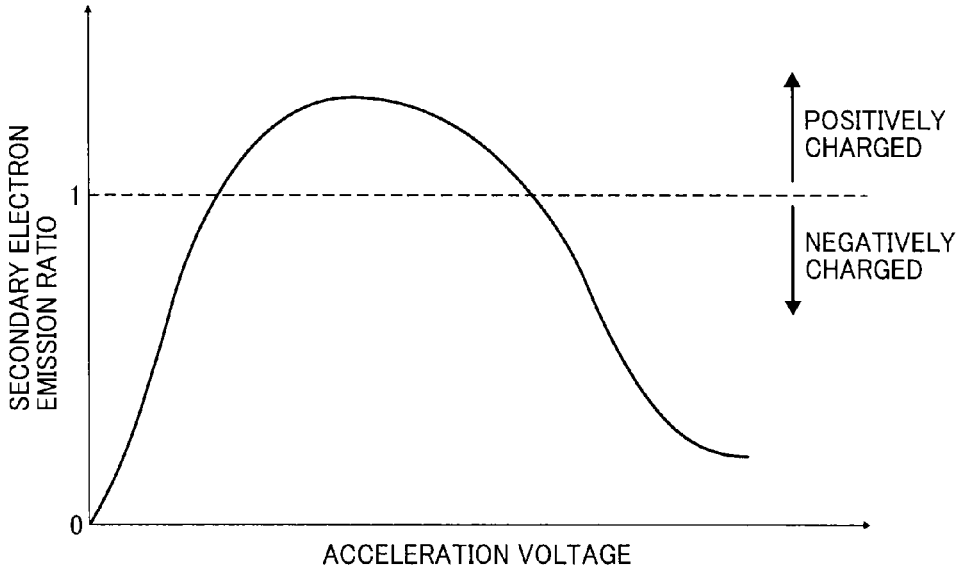
FIG. 39 is a schematic diagram illustrating a relationship between an acceleration voltage and charging.
Figure 40:
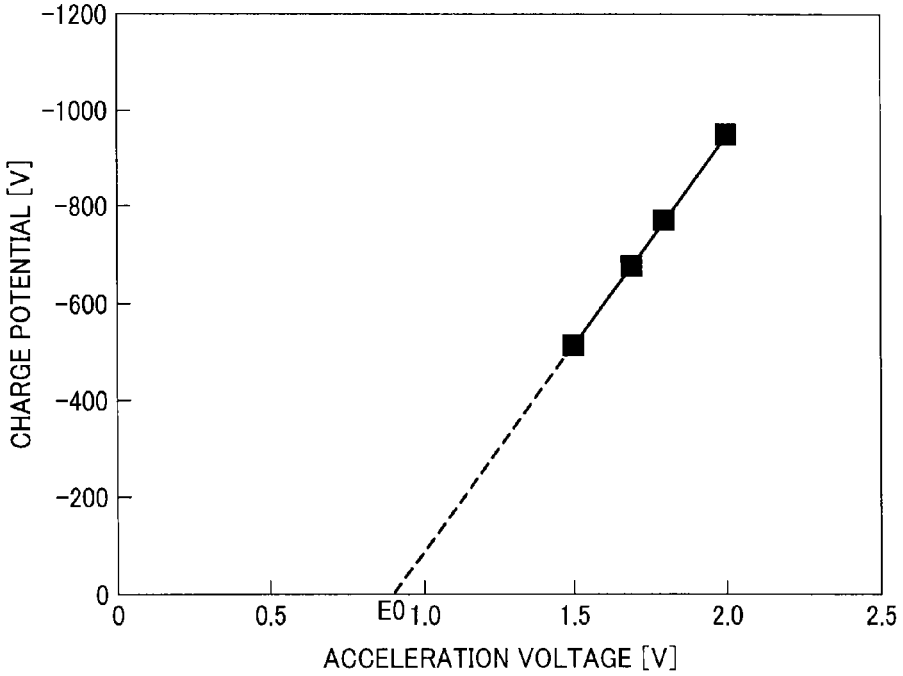
FIG. 40 is a graph illustrating a relationship between the acceleration voltage and a charge potential.

FIG. 39 is a schematic diagram illustrating a relationship between the acceleration voltage and the charging. First, during the electrostatic latent image measurement, in the electrostatic latent image measurement device 300, the sample 323 of the photoreceptor is irradiated with the electron beam.

As an acceleration voltage |Vacc| which is the voltage applied to the acceleration electrode 313, a voltage higher than the voltage in which a secondary electron emission ratio of the sample 323 becomes one is set. By setting the acceleration voltage in this manner, since the amount of the incident electrons is larger than the amount of the emission electrons in the sample 323, the electrons are accumulated in the sample 323, so that charge-up occurs. As a result, in the electrostatic latent image measurement device 300, the surface of the sample 323 can be charged uniformly with negative charges.

FIG. 39 is a graph illustrating a relationship between the acceleration voltage and the charge potential. As illustrated in the figure, there is a certain relationship between the acceleration voltage and the charge potential. For this reason, in the electrostatic latent image measurement device 300, by appropriately setting the acceleration voltage and the irradiation time, the same charge potential as that of the photoreceptor drum 1030 in the image forming apparatus 1000 can be formed on the surface of the sample 323.

Incidentally, as an irradiation current is large, a target charge potential can be achieved in a short time. Therefore, in this case, the irradiation current is set to be several nano amperes (nA).

After that, in the electrostatic latent image measurement device 300, the amount of electrons which are incident on the sample 323 is set to 1/100 times to 1/1000 times so that the electrostatic latent image can be observed.

The electrostatic latent image measurement device 300 two-dimensionally performs optical scanning on the surface of the sample 323 by controlling the optical scanner 500 and forms the electrostatic latent image on the sample 323. In addition, the optical scanner 500 is controlled such that the light spot having a desired beam diameter and beam profile is formed on the surface of the sample 323.

By the way, although the exposure energy necessary for forming the electrostatic latent image is defined according to the sensitivity characteristics of the sample, the exposure energy is typically about 2 to 10 mJ/m$^2$. In addition, in some cases, in the case of a sample of low sensitivity, the necessary exposure energy is 10 mJ/m$^2$ or more. That is, the charge potential or the necessary exposure energy is set in accordance with the photosensitivity characteristics of the sample or the process conditions. Here, the exposure conditions of the electrostatic latent image measurement device 300 are set to be the same as the exposure conditions in accordance with the image forming apparatus 1000.

Therefore, in such a case, the environment of electrostatic field or the trajectory of electrons is calculated in advance, and the detection result is corrected based on the calculation result, so that it is possible to obtain a profile of the electrostatic latent image at a high accuracy.

As described above, by using the electrostatic latent image measurement device 300, it is possible to obtain a charge distribution of an electrostatic latent image, a surface potential distribution, an electric field intensity distribution, and an electric field intensity in the direction perpendicular to the sample surface at the respective high accuracies.

Electrostatic Latent Image Forming Method

Next, an embodiment of an electrostatic latent image forming method of the present invention is explained.

In the image forming method according to the embodiment, an optical output waveform used for a latent image formation is a waveform for exposing a photoreceptor for a predetermined time with a light power value required to obtain a target image density in the image portion including a line image or a solid image.

In addition, the image portion is composed of a plurality of pixels and is a portion for forming an image by adhering toner in the image pattern. In addition, the non-image portion is a portion where no toner is adhered in the image pattern and no image is formed.

In the description hereinafter, the image density as a target is called a "target image density". In addition, in the description hereinafter, a predetermined light power value required to obtain the target image density is called a "target exposure output value". In addition, in the description hereinafter, a predetermined time for exposing the entire pixels of the image portion with the target exposure output value to obtain the target image density is called a "target exposure time".

In the description hereinafter, the image density as a target is called a "target image density". In addition, in the description hereinafter, a predetermined light power value required to obtain the target image density is called a "target exposure output value". In addition, in the description hereinafter, a predetermined time for exposing the entire pixels of the image portion with the target exposure output value to obtain the target image density is called a "target exposure time".

In addition, in the description hereinafter, the exposing the photoreceptor with the light power value higher than the target exposure output value for the exposure time shorter than the target exposure time is called "time concentration exposure". In the time concentration exposure, for example, when one pixel is exposed, a target exposure output value for 3 pixels is added to that for 1 pixel, i.e., a light power value for 4 pixels in total is exposed for an exposure time for 1 pixel.

In addition, in the description hereinafter, the time concentration exposure may also be called TC (Time Concentration) exposure.

Image forming apparatuses are required to produce images at higher speed, and used for simple printing as on-demand printing systems and required to produce images having higher quality and definition.

An image forming apparatus using the exposure method 1 has a method of downsizing a beam size of exposure and forming a small electrostatic latent image to increase image resolution.

However, downsizing the beam size causes higher cost. A ratio of the cost of downsizing the beam size in total cost of the image forming apparatus is increasing as well. Therefore, a microscopic electrostatic latent image needs forming even without downsizing the beam size of exposure.

In addition, an electrophotographic image forming apparatus is required to reproduce characters having a microscopic size. Particularly, it is required to produce images of recognizable characters having a microscopic size equivalent to a few points of 1200 dpi and recognizable hollow reversed characters having a microscopic size.

In the electrophotographic image forming apparatus, the result of each charging, exposing, developing, transferring and fixing process largely influence upon quality of the resultant image. Particularly, the state of an electrostatic latent image formed on a photoreceptor in the exposing process is an important element directly influencing upon behavior of toner particles. Therefore, in the image forming apparatus, improving the electrostatic latent image formed on a photoreceptor in the exposing process is quite important to form high-quality images.

The electrostatic latent image forming method in this embodiment concentratively exposes a narrow range of an image portion forming an image in an image pattern with intensive light. Thus, the electrostatic latent image forming method in this embodiment improves loyalty of the resultant image pattern having a microscopic size smaller than a beam diameter (being unable to ignore influence of the beam diameter) and controls the image pattern to have desired image density.

Namely, the electrostatic latent image forming method in this embodiment produces an image having an image pattern having a microscopic size and a desired image density.

In addition, the electrostatic latent image forming method in this embodiment can be applied to an arbitrary image pattern without specific processes such as edge detection and recognition of character information.

Therefore, the electrostatic latent image forming method in this embodiment is capable of producing an image pattern even when object information is unobtainable from a computer in converting image data into light source modulation data.

The electrostatic latent image forming method in this embodiment is capable of producing an image having an image pattern having a microscopic size and a desired image density without corresponding image data to light source modulation data.

The electrostatic latent image forming method in this embodiment uses a combination of PM (Phase Modulation) and PWM (Pulse Width Mofulationl) PM+PWM modulation. The electrostatic latent image forming method uses a TC exposure in which maximum light power is intentionally strengthened to equalize an integrated light quantity of an image pattern when exposed to that of standard exposure.

The electrostatic latent image forming method in this embodiment forms a deep latent image to increase resolution of image pattern without changing density thereof.

In the exposure method according to the embodiment, the light power value is set such that the one or more pixels (pixel groups) inside the image portion existing at the boundary between the image portion and the non-image portion included in the image pattern become non-exposure pixels. Here, the group that is not exposed inside the image portion existing at the boundary between the image portion and the non-image portion included in the image pattern is called a group of non-exposure pixels. In addition, in the exposure method according to the embodiment, the exposure is performed with the light power value obtained by adding the light power value for the pixel group adjacent to the group of non-exposure pixels (in the vicinity of the group of non-exposure pixels) and the light power value for the group of non-exposure pixels.

Thus, the electrostatic latent image forming method in this embodiment is capable of forming a high-quality image pattern.

Exposure Pattern Forming Example

Next, an exposure pattern forming example by the electrostatic latent image forming method of the embodiment is explained. In the following explanation, the control of an exposure time and an optical power level on the pixel in the main scanning direction in an image pattern when exposed unless referred to in particular.

Figure 41:
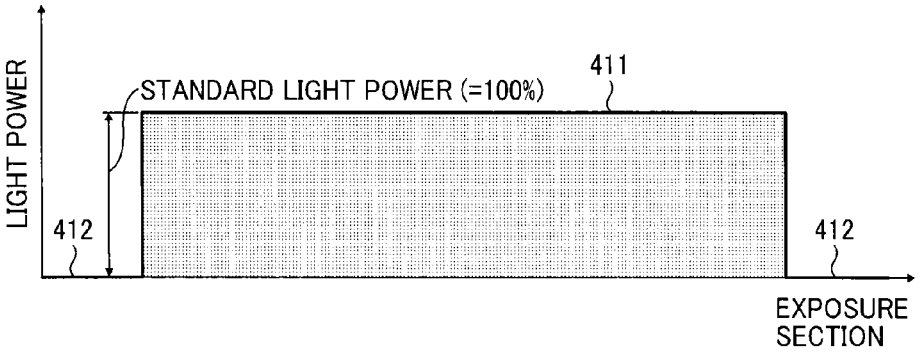
FIG. 41 is a schematic diagram illustrating an example of exposure pattern when a part of an image pattern us exposed at a predetermined light power value.

FIG. 41 is a schematic diagram illustrating an example of exposure pattern when a part of an image pattern us exposed at a predetermined light power value. In FIG. 41, as a comparative examples of exposure pattern by the electrostatic latent image forming method of the embodiment, a specific section is exposed at a predetermined light power value (target exposure power value=100%) to form one scanned portion of the image pattern as a an image portion 411. In the image pattern, a non-image portion 412 which is not the image portion 411 is not exposed.

Figure 42:
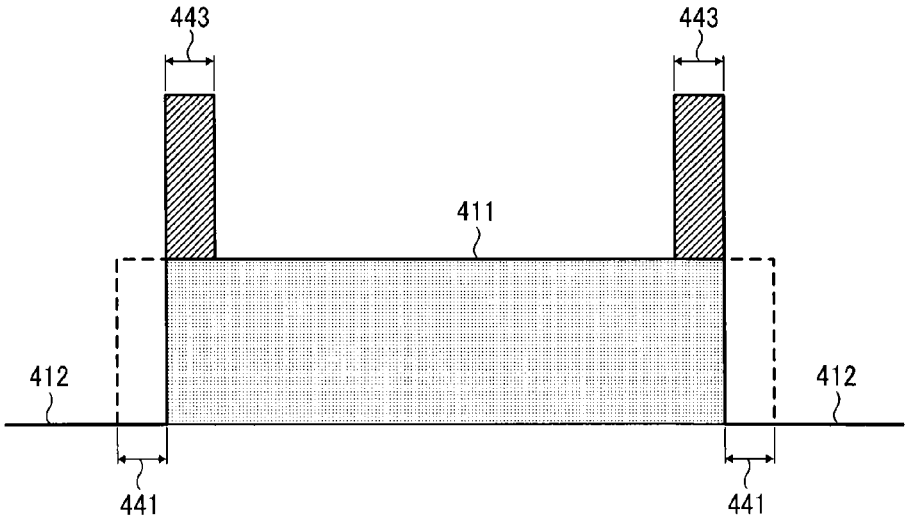
FIG. 42 is a schematic diagram illustrating an example of exposure pattern when a boundary pixel with a non-image portion is exposed as a high power exposure pixel group.

FIG. 42 is a schematic diagram illustrating an example of exposure pattern when a boundary pixel with a non-image portion is exposed as a high power exposure pixel group. In FIG. 42, the electrostatic latent image forming method of the embodiment does not expose an edge portion of an image portion 411 among pixel groups forming the image portion 411 present at a boundary with a non-image portion 412 as a non-exposure pixel group 441.

In the electrostatic latent image forming method of the embodiment, a pixel group at a boundary with the non-exposure pixel group 441 among the pixel groups forming the image portion 411 is a high power exposure pixel group 443. The electrostatic latent image forming method of the embodiment executes a TC exposure with a light power value (integrated energy) which is a sum a predetermined light power value (target exposure power value) needed to expose the pixel groups and a light power value needed to expose the non-exposure pixel group 441.

The high power exposure pixel group 443 may be said a TC pixel. An integrated energy added to the TC pixel may be said a TC integrated energy.

In FIG. 42, the edge of the image portion 411 is exposed at a light power value of 200% of the target exposure power value. In the embodiment, a ratio of the light power value to the target exposure power value when all or a part of the integrated energy of the non-exposure pixel group 441 is added to the TC pixel is written "TCOO %", and this is referred to as a TC value hereafter. In the image pattern in FIG. 42, the high power exposure pixel group 443 is exposed at "TC200%".

Figure 43:
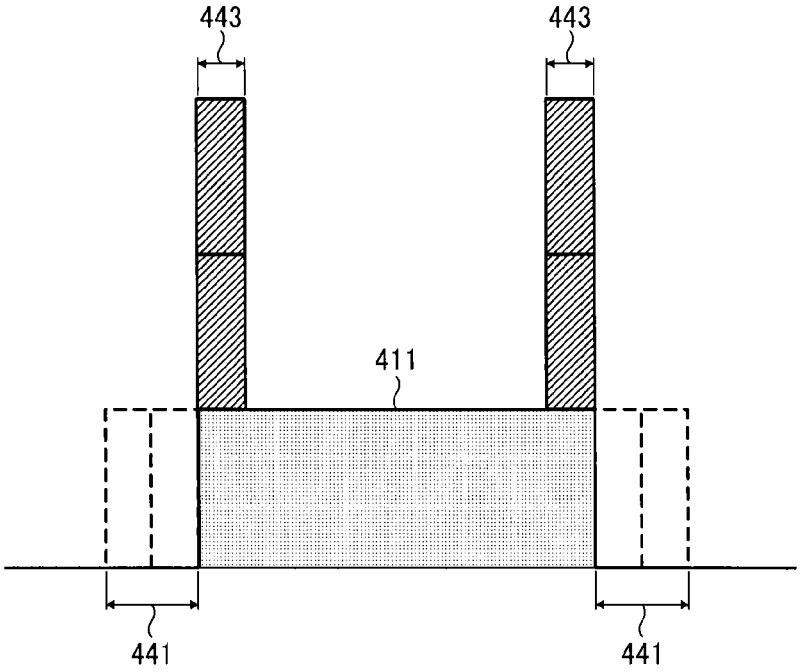
FIG. 43 is a schematic diagram illustrating another example of exposure pattern when a boundary pixel with a non-image portion is exposed as a high power exposure pixel group.

FIG. 43 is a schematic diagram illustrating another example of exposure pattern when a boundary pixel with a non-image portion is 412 exposed as a high power exposure pixel group 443. As FIG. 43 shows, in the electrostatic latent image forming method of the embodiment may regard 2 pixels in the main scanning direction as the non-exposure pixel group 441 to improve sharpness of the edge portion of the image portion 411. In this case, high power exposure pixel group 443 (TC pixel) may be 2 pixels at the boundary between the image portion 411 and the non-exposure pixel group 441 in correspondence with the number of pixels thereof.

When each of the non-exposure pixel group 441 and the high power exposure pixel group 443 have 2 pixels, a light power value to the high power exposure pixel group 443 is 300% of the target exposure power value (TC300%).

Figure 44:
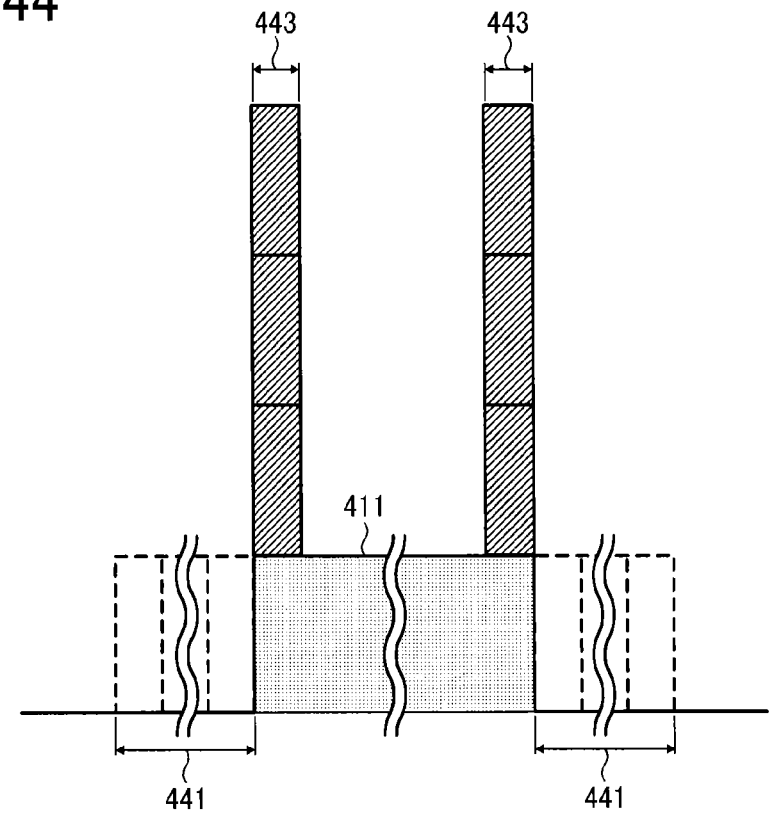
FIG. 44 is a schematic diagram illustrating a further example of exposure pattern when a boundary pixel with a non-image portion is exposed as a high power exposure pixel group.

FIG. 44 is a schematic diagram illustrating a further example of exposure pattern when a boundary pixel with a non-image portion 412 is exposed as a high power exposure pixel group 443. As FIG. 44 shows, in the electrostatic latent image forming method of the embodiment may regard 3 pixels in the main scanning direction as the non-exposure pixel group 441. In this case, high power exposure pixel group 443 (TC pixel) may be 3 pixels at the boundary between the image portion 411 and the non-exposure pixel group 441 in correspondence with the number of pixels thereof.

When each of the non-exposure pixel group 441 and the high power exposure pixel group 443 have 2 pixels, a light power value to the high power exposure pixel group 443 is 400% of the target exposure power value (TC400%).

In the electrostatic latent image forming method of the embodiment, the number of pixels of the non-exposure pixel group 441 can be increased to a maximum value unless a light power value to the high power exposure pixel group 443 is limited.

The number of pixels of the non-exposure pixel group 441 may be set in correspondence with a status of the image pattern. For example, in correspondence with demands for image quality such as sharpness of the edge portion of the image portion 411 and reproducibility of hollow images, each of the non-exposure pixel group 441 and the high power exposure pixel group 443 may be one pixel as shown in FIG. 42.

In the electrostatic latent image forming method of the embodiment, the number of pixels of the non-exposure pixel group 441 may be the same from both edges of the image pattern so as not to collapse the symmetry of an image.

The TC exposure by the electrostatic latent image forming method of the embodiment may not necessarily be used on the whole of an image pattern.

Figure 45A:
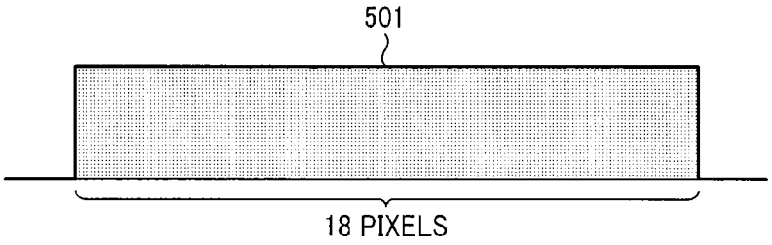
FIGS. 45A to 45C are schematic diagrams illustrating another example of exposure pattern when a boundary pixel with a non-image portion is exposed as a high power exposure pixel group.
Figure 45B:
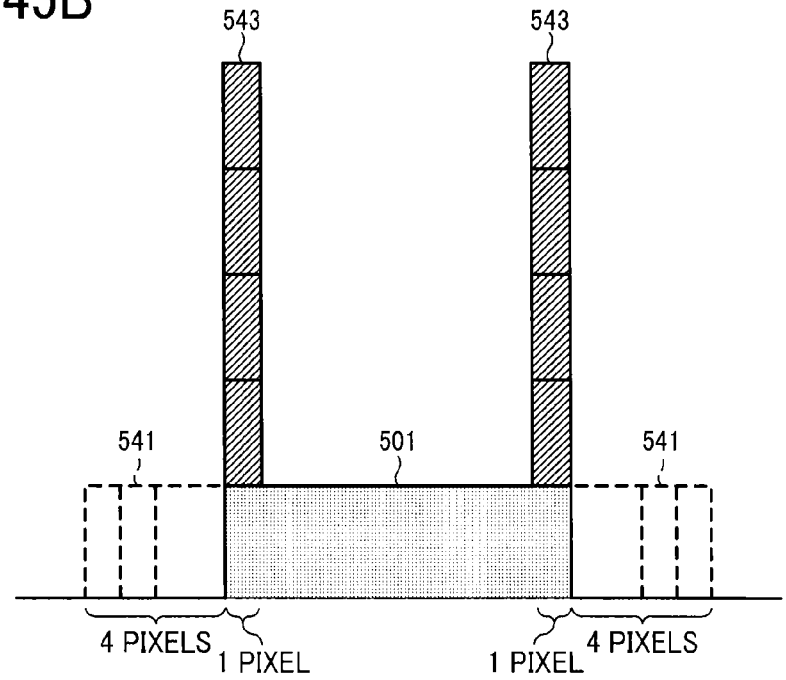
Figure 45C:
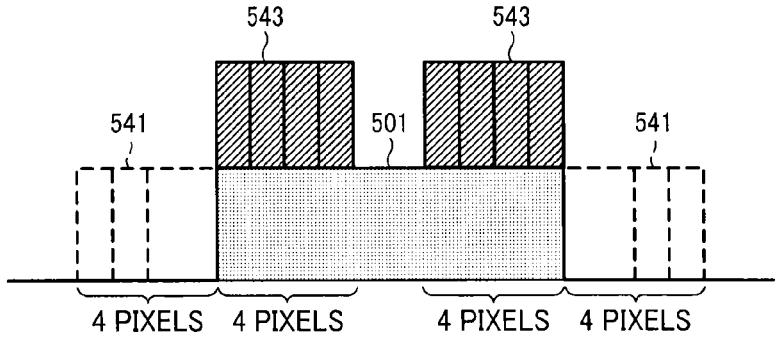

FIGS. 45A to 45C are schematic diagrams illustrating another example of exposure pattern when a boundary pixel with a non-image portion is exposed as a high power exposure pixel group. As shown in FIG. 45A, in this example, an image portion 501 of an image pattern has 18 pixels and a non-exposure pixel group 541 has an upper limit of pixels of 4.

When the light power value is not limited, as shown in FIG. 45B, the non-exposure pixel group 541 has 4 pixels and a high power exposure pixel group 543 is one pixel at the edge portion of the image portion 501. Then, a light power value to the high power exposure pixel group 543 is TC500% because a light power value to the non-exposure pixel group 541 can be all added to the high power exposure pixel group 543.

When the light power value has a limit of TC200%, as shown in FIG. 45C, a light power value of the 4 pixels of the non-exposure pixel group 541 is dispersed to 4 pixels of the high power exposure pixel group 543. In this case, a light power value per one pixel thereof is TC200% satisfying the limited condition of the light power value.

Figure 46A:
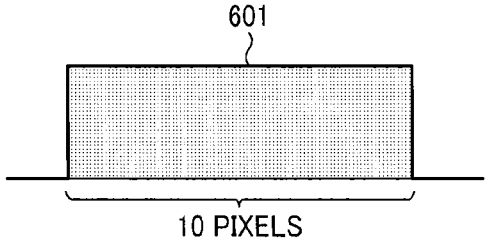
FIG. 46A to 46C are schematic diagrams illustrating a further example of exposure pattern when a boundary pixel with a non-image portion is exposed as a high power exposure pixel group.
Figure 46B:
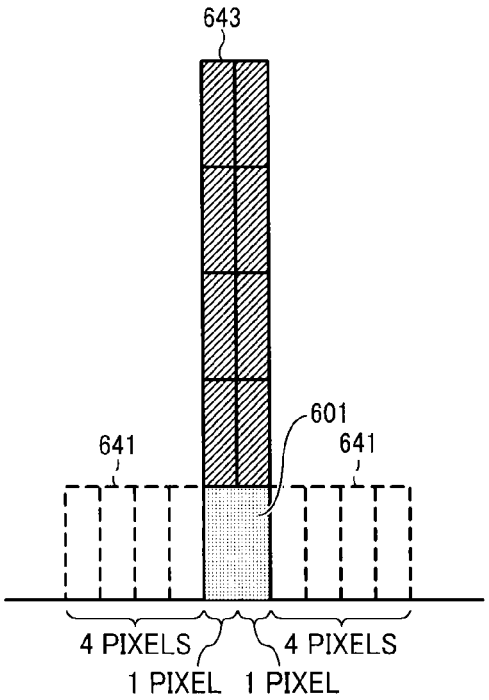
Figure 46C:
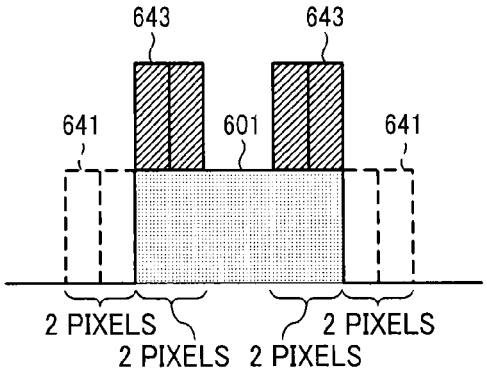

FIG. 46A to 46C are schematic diagrams illustrating a further example of exposure pattern when a boundary pixel with a non-image portion is exposed as a high power exposure pixel group.

In FIG. 45, the non-exposure pixel group 541 can have a maximum 4 pixels without being limited the upper limit of the light power value because the image portion 501 has sufficient 18 pixels.

However, there is a case where the non-exposure pixel group 541 cannot have a maximum pixels depending on the number of pixels of the image portion. As shown in FIG. 46A, an image portion 601 of an image pattern has 10 pixels and a non-exposure pixel group 641 has an upper limit of pixels of 4.

When the light power value of a high power exposure pixel group is not limited, as shown in FIG. 46B, the non-exposure pixel group 641 has 4 pixels and a light power value exposing the non-exposure pixel group 641 can be all added to the high power exposure pixel group 643 having one pixel. Then, the high power exposure pixel group 643 has a light power value of TC500%.

However, when the light power value has a limit of TC200%, as shown in FIG. 46C, each of the non-exposure pixel group 641 and the high power exposure pixel group 643 has 2 pixels.

From FIGS. 45 and 46, whether the number of pixels of the non-exposure pixel group can be increased to a maximum value which does not exceed a beam size depends on the number of pixels of an image portion in an image pattern and the upper limit of a light power value.

In the electrostatic latent image forming method of the embodiment, an exposure pattern can be generalized to be fixed when he number of pixels of the non-exposure pixel group is n, the number of pixels of the high power exposure pixel group is x, and the upper limit of the light power value is Y.

Figure 47A:
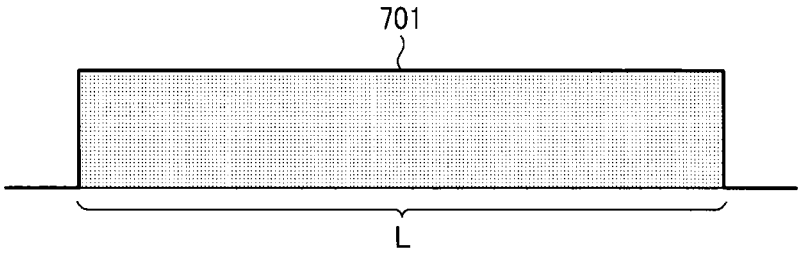
FIGS. 47A to 47C are schematic diagrams illustrating an example of exposure pattern by the electrostatic latent image forming method of the embodiment.
Figure 47B:
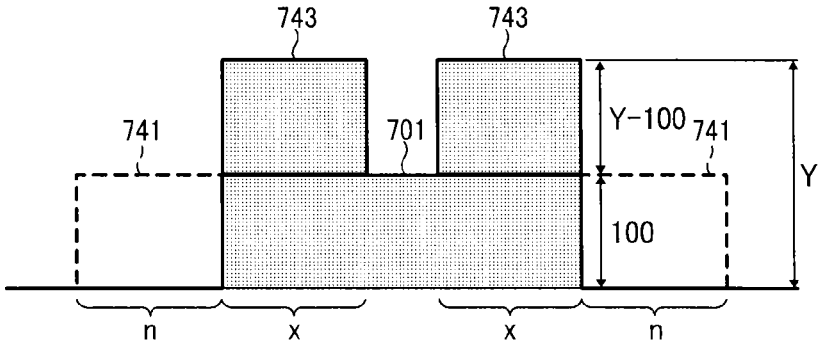
Figure 47C:
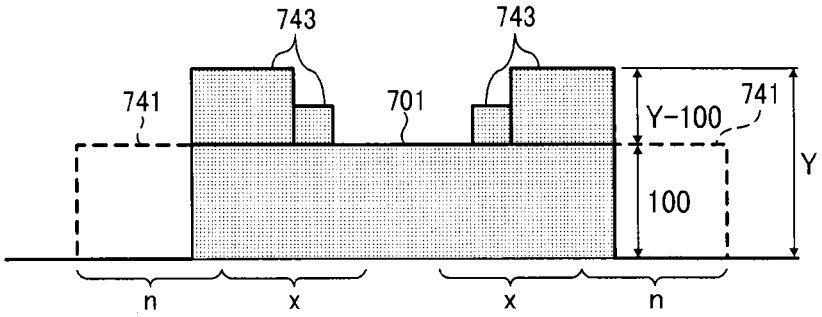

FIGS. 47A to 47C are schematic diagrams illustrating an example of exposure pattern by the electrostatic latent image forming method of the embodiment. As shown in FIG. 47A, a case where an image having an image portion 701 having the number of pixels of L and a non-exposure pixel group 741 having the number of pixels of n is applied with a TC exposure by the electrostatic latent image forming method of the embodiment is considered.

Depending on difference of Y, as shown in FIG. 47B, a case where a light power value of the non-exposure pixel group is equally added to a high power exposure pixel group 743 having the number of pixels of x, and as shown in FIG. 47C, a case where a light power value less than others is added only to an inside high power exposure pixel group having one pixel are considered. In case of FIG. 47C, the light power value monotonously decreases from the edge portion of the image portion 701 toward the inside.

An integrated energy of the high power exposure pixel group 743 satisfying conditions of FIGS. 47B and 47C is represented by the following formula (1).

$$(Y-100)\cdot x \geq 100n \quad (1)$$

The formula (1) shows a sum total of the light power value of the high power exposure pixel group 743 equals to a sum total of the light power value when the non-exposure pixel group 741 is exposed.

A formula on the number of pixels is the following formula (2).

$$2\cdot(n+x) \leq L \quad (2)$$

From the formula (1), $$x \geq 100/(Y-100) \cdot n \quad (3)$$

From the formula (2), $$x \leq (L/s) - n \quad (4)$$

From the formulae (2) and (4), $$100/(Y-100) \cdot n \leq x \leq (L/2) - n$$

Therefore, $$100/(Y-100) \cdot n \leq (L/2) - n$$

$$\{100/(Y-100+1\} \cdot n \leq L/2$$

$$n \leq L/2 \cdot (Y-100)/Y \quad (5)$$

Namely, a maximum value of n satisfying the formula (5) is the number of pixels of the non-exposure pixel group 741.

The number of pixels of the high power exposure pixel group 743 is preferably as little as possible to improve sharpness of the edge portion of the image portion, and a minimum value of x satisfying the formula (3) is the number of pixels of the high power exposure pixel group 743.

The number of pixels n of the non-exposure pixel group 741 defined by the formula (5) is preferably as large as possible to improve sharpness of the edge portion, but when the non-exposure pixel group 741 has a size larger than a beam size, an electrostatic latent image is not properly formed. Therefore, the number of pixels n of the non-exposure pixel group 741 has to be a maximum value N or less of the number of pixels n of the non-exposure pixel group 741 (n≤N).

Figure 48A:
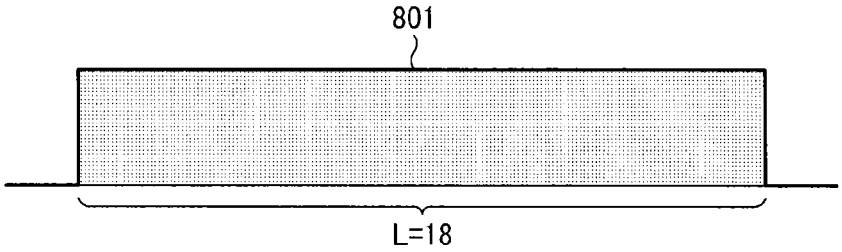
FIGS. 48A to 48C are schematic diagrams illustrating another example of exposure pattern by the electrostatic latent image forming method of the embodiment.
Figure 48B:
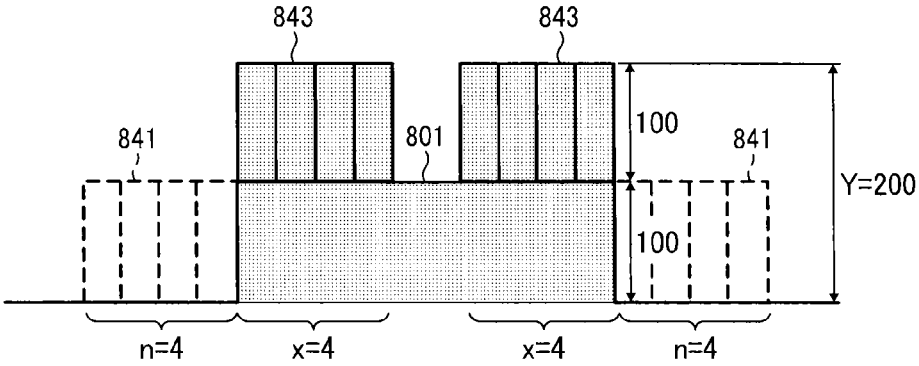
Figure 48C:
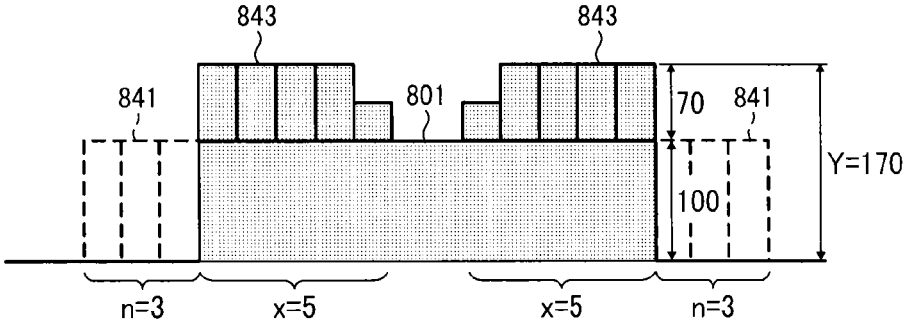

FIGS. 48A to 48C are schematic diagrams illustrating another example of exposure pattern by the electrostatic latent image forming method of the embodiment. On the image pattern in FIG. 48, the number of pixels x of a non-exposure pixel group 841 and the number of pixels n of a high power exposure pixel group 843 in the TC exposure of the electrostatic latent image forming method of the embodiment are determined from the formulae (3) and (5).

In FIG. 48B, when a beam diameter is 85 μm, 1200 dpi is equivalent to 4 dot. If the non-exposure pixel group 841 can be formed to the beam size, a maximum value N of off pixels is 4. The number of pixels L of an image portion 801 of an image pattern is 18, and a light power value Y of the high power exposure pixel group 843 is TC200%.

From the formula (5), n≥4.5, and a maximum integer of n satisfying this is 4. From the formula (3), x≥4, and a minimum integer of x satisfying this is 4.

A sum (integrated energy) of the light power value added to the high power exposure pixel group 843 is 4×100=400. Since the high power exposure pixel group 843 has 4 pixels, the light power value is equally added to each of the TC pixels by 100%.

In FIG. 48C, when a light power value Y of the high power exposure pixel group 843 is TC170%, from the formula (5), n≥3.64, and a maximum integer of n satisfying this is 3. From the formula (5), x≥4.28, and a minimum integer of x satisfying this is 5.

A sum (integrated energy) of the light power value added to the high power exposure pixel group 843 is 3×100=300. The high power exposure pixel group 843 has 5 pixels. When the light power value is equally added to each of the TC pixels by 70%, the sum thereof is 350% and exceeds the integrated energy of 300%.

In the exposure pattern in FIG. 48C, the light power value is not equally added to each of the TC pixels. The light power value is added to 4 pixels out of the TC pixels by 70% each and 20% to the rest 1 pixel. Thus, in the exposure pattern in FIG. 48C, a sum of the light power value of the high power exposure pixel group 843 is a sum of the light power value when the non-exposure pixel group 841 is exposed.

Should the light power value not be limited, Y is ∞, the formula (5) is n≤L/2. In this case, n is limited to a maximum value N or less of the non-exposure pixel group 841, which does not exceed a beam size, and is applied with N value.

When a pattern pixel number L is 24 and an upper limit of the light power value Y is 150%, n≤4 and the number of pixels of the non-exposure pixel group is 4. When there is a condition that a maximum value N of the number of pixels of the non-exposure pixel group is 3 to improve the sharpness of an image, the number of pixels n of the non-exposure pixel group is 3. When a TC exposure is applied to the edge portion of a hollow image, since a maximum value N of the number of pixels of the non-exposure pixel group of 2 improves latent image resolving power, from n≤N, the number of pixels of the non-exposure pixel group is 2.

Flowchart of Electrostatic Latent Image Forming Method

Figure 49:
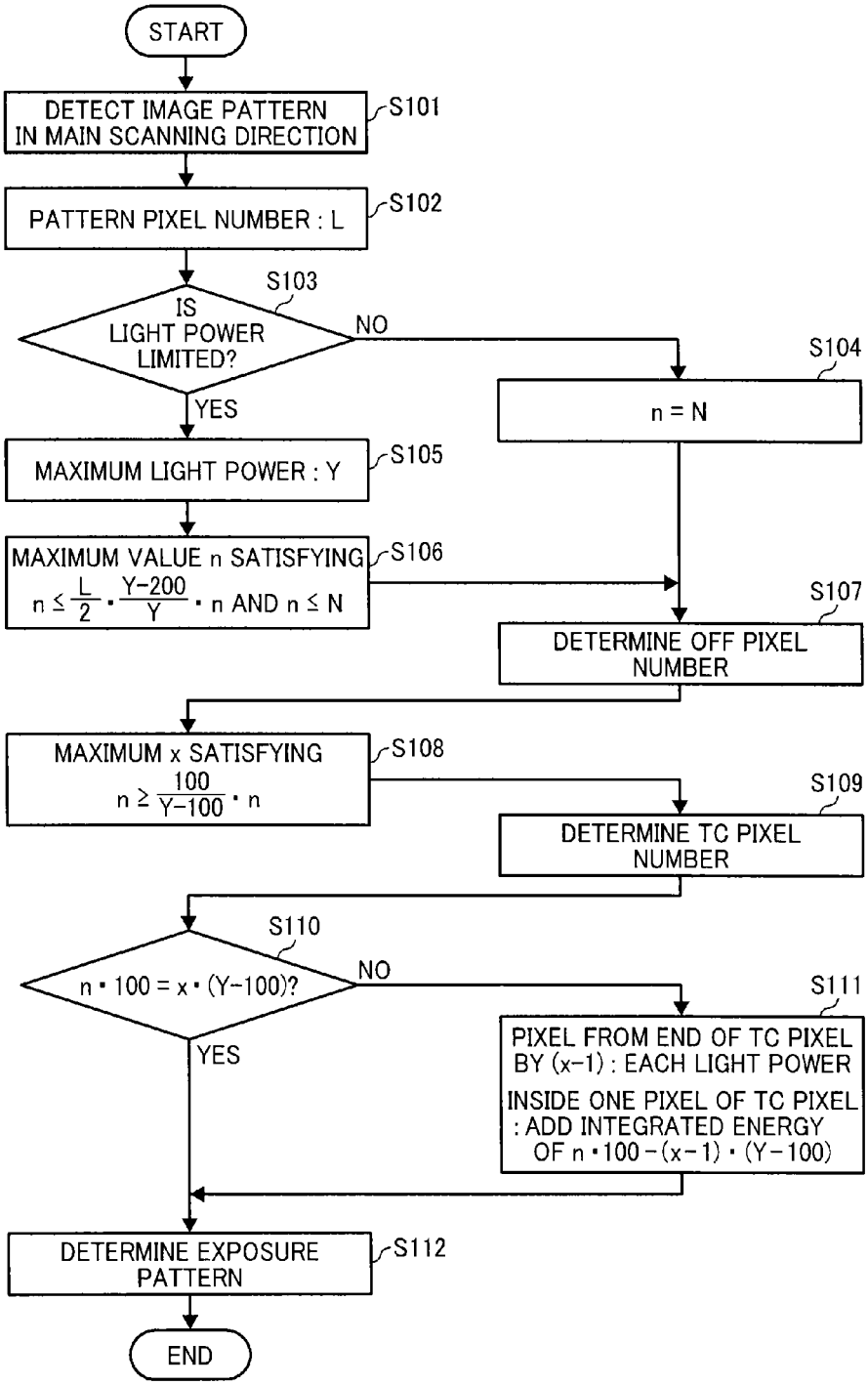
FIG. 49 is a flowchart of the electrostatic latent image forming method of the embodiment.

FIG. 49 is a flowchart of the electrostatic latent image forming method of the embodiment. An image forming apparatus 1000 detects an image pattern in a predetermined scanning direction, e.g., a main scanning direction (S101).

The image forming apparatus 1000 specifies the number of pixels of an image portion of the image pattern (S102).

The image forming apparatus 1000 judges whether the light power value has an upper limit Y when exposing by the electrostatic latent image forming method of the embodiment (S103).

When the light power value does not have an upper limit Y (S103: NO), the image forming apparatus 1000 proceeds to a step S107 regarding a maximum value N of the number of pixels of the non-exposure pixel group as the number of pixels thereof n (n=N) (S014).

When the light power value does has an upper limit Y (S103: YES), the image forming apparatus 1000 regards the upper limit of the light power value as Y (S105), and determines a maximum value of the number of pixels of the non-exposure pixel group n, based on the formula (5) (S106).

The image forming apparatus 1000 determines the number of (off) pixels of the non-exposure pixel group n, based on the step of S104 or S106.

The image forming apparatus 1000 determines a minimum value x of the number of pixels of the high power exposure pixel group (S108). The image forming apparatus 1000 determines the number of (TC) pixels of the high power exposure pixel group, based on the minimum value x (S109).

The image forming apparatus 1000 judges whether an integrated energy of the high power exposure pixel group is n·100=x·(Y−100) (S110).

When the integrated energy of the high power exposure pixel group is not n·100=x·(Y−100) (S110: NO), the image forming apparatus 1000 exposes each of the pixels from the edge portion of the TC pixel by (x−1) at a maximum value Y of the light power value. In addition, the image forming apparatus 1000 adds an integrated energy of n·100−(x−1)·(Y−100) to one inside (around the center) pixel of the TC pixel (S111).

When the integrated energy of the high power exposure pixel group is n·100=x·(Y−100) (S110: YES), or after the step of S111, the image forming apparatus 1000 determines an exposure pattern with the integrated energy (S112).

In the electrostatic latent image forming method of the embodiment, the number of pixels of the non-exposure pixel group and the TC pixels can be determined regardless of the pixel size.

The electrostatic latent image forming method of the embodiment applied in an exposure time control in a main scanning direction has been explained. When the integrated energy is regarded as an integration of the light power and the number of pixels, the same effect is exerted even in a sub-scanning direction.

Having now fully described the invention, it will be apparent to one of ordinary skill in the art that many changes and modifications can be made thereto without departing from the spirit and scope of the invention as set forth therein.

What is claimed is:

1. An image forming method, comprising:

exposing a surface of an image bearer with light according to an image pattern including an image portion and a non-image portion, the image portion constituted of a plurality of pixels, to form an electrostatic latent image correspondent to the image pattern, comparing the image pattern adjacent to each of the pixels with a comparison pattern constituted of a plurality of pixels to specify at least a group of pixels existing at a boundary with respect to the non-image portion as a group of non-exposure pixels among the pixels constituting the image portion, and executing determination of specifying at least a group of pixels adjacent to the group of non-exposure pixels as a group of high power exposure pixels exposed with light of a higher light power and a lower duty ratio than a predetermined light power and duty ratio required for exposing the image portion among the pixels constituting the image portion.

2. The image forming method of claim 1, wherein the comparison pattern includes a plurality of the comparison patterns.

3. The image forming method of claim 1, wherein the comparison pattern is a one-dimensional array and a relative position between the comparison pattern and the image pattern varies in four directions.

4. The image forming method of claim 1, wherein the comparison pattern is a symmetric two-dimensional array, and the determination is executed on a pixel of the image portion correspondent to a pixel on a symmetry axis of the comparison pattern when the image pattern has a portion identical to a portion of the comparison pattern.

5. The image forming method of claim 4, wherein the number of pixels of one side of the two-dimensional array is not less than twice of the sum of the number of continuous one line of pixels determined to be non-exposure pixels and the number of continuous one line of pixels determined to be high power exposure pixels.

6. The image forming method of claim 1, wherein a process of converting a part of the pixels determined as non-exposure pixels to high power exposure pixels is executed prior to executing the determination when the number of pixels of continuous one line of the image portion is less than twice of the sum of the numbers of the non-exposure pixels and the high power exposure pixels.

7. The image forming method of claim 1, wherein a group of pixels having a size smaller than a beam size of the light among the group of pixels existing at a boundary with respect to the non-image image portion of the pixels constituting the image portion is specified as a group of non-exposure pixels.

8. The image forming method of claim 7, wherein the group of non-exposure pixels exist at both ends of exposed portion in the image pattern in a main scanning direction.

9. The image forming method of claim 7, wherein the number of pixels of the group of non-exposure pixels is determined based on the number of pixels constituting the image pattern, and a maximum of the number of pixels constituting the group of non-exposure pixels and the number of pixels of the group of non-exposure pixels in the image pattern.

10. The image forming method of claim 7, wherein the number of pixels of the group of non-exposure pixels "n" is determined as a maximum of integers satisfying the following relations:

$$n \leq L/2 \cdot (Y-100)/Y \text{ and } n \leq N$$

wherein Y represents an upper limit of a light power, L represents the number of pixels constituting the image pattern, and N represents a maximum of the number of pixels constituting the group of non-exposure pixels.

11. The image forming method of claim 7, wherein the number of pixels of the group of high power exposure pixels "x" is determined as a minimum of integers satisfying the following relation:

$$x \geq 100/(Y-100) \cdot n$$

wherein Y represents an upper limit of a light power, and "n" represents the number of pixels of the group of non-exposure pixels.

12. The image forming method of claim 7, wherein the light power of the group of high power exposure pixels decreases from pixels at both ends of the image pattern toward the center of the image pattern.

13. The image forming method of claim 1, wherein when a value obtained by subtracting the predetermined light power value from light power value of light exposed to the high power exposure pixel is multiplied with the number of the high power exposure pixels as a total sum of light power values of light exposed to the high power exposure pixels, and when a value obtained by subtracting light power value of light exposed to the non-exposure pixel from the predetermined light power value is multiplied with the number of the non-exposure pixels as a total sum of light power values of light exposed to the non-exposure pixels, the total sum of light power values of light exposed to the high power exposure pixels is equal to the total sum of light power values of light exposed to the non-exposure pixels.

14. An image forming apparatus for exposing a surface of an image bearer with light according to an image pattern to form an electrostatic latent image correspondent to the image pattern including an image portion including a plurality of pixels and a non-image portion on the surface thereof, comprising:

a light source to emit the light;

a light source driver to generate a light drive current for driving the light source; and an optical system to lead the light emitted from the light source to the image bearer, wherein the light source driver compares the image pattern adjacent to each of the pixels with a comparison pattern constituted of a plurality of pixels to specify at least a group of pixels existing at a boundary with respect to the non-image portion as a group of non-exposure pixels among the pixels constituting the image portion, and specifies at least a group of pixels adjacent to the group of non-exposure pixels as a group of high power exposure pixels exposed with light of a higher light power value and a lower duty ratio than a predetermined light power value and duty ratio required for exposing the image portion among the pixels constituting the image portion to drive the light source with a light power and duty ratio correspondent to the specified group of high power exposure pixels and the group of non-exposure pixels.

15. The image forming apparatus of claim 14, wherein the comparison pattern includes a plurality of the comparison patterns.

16. The image forming apparatus of claim 14, wherein the light source driver executes determination on a pixel of the image portion correspondent to a pixel on a symmetry axis of the comparison pattern when the comparison pattern is a symmetric two-dimensional array and the image pattern has a portion identical to a portion of the comparison pattern.

17. The image forming apparatus of claim 14, wherein the light source driver specifies a group of pixels having a size smaller than a beam size of the light among the group of pixels existing at a boundary with respect to the non-image portion of the pixels constituting the image portion as a group of non-exposure pixels.

18. The image forming apparatus of claim 17, wherein the group of non-exposure pixels are equally located at both ends of the image portion in a main scanning direction, and the light source driver adds a light power value when exposing the group of non-exposure pixels to the predetermined light power value to expose the group of high power exposure pixels.

19. The image forming apparatus of claim 17, wherein the light source driver controls the light power value of the group of high power exposure pixels so as to decrease the light power from pixels at both ends of the image pattern toward the center of the image pattern.

20. A printed matter production method, comprising:

exposing a surface of an image bearer with light according to an image pattern including an image portion and a non-image portion, the image portion constituted of a plurality of pixels, to form an electrostatic latent image correspondent to the image pattern, comparing the image pattern adjacent to each of the pixels with a comparison pattern constituted of a plurality of pixels to specify at least a group of pixels existing at a boundary with respect to the non-image portion as a group of non-exposure pixels among the pixels constituting the image portion, and exposing at least a group of pixels adjacent to the group of non-exposure pixels as a group of high power exposure pixels exposed with light of a higher light power and a lower duty ratio than a predetermined light power value and duty ratio required for exposing the image portion among the pixels constituting the image portion.

* * * * *